US011560836B2

(12) United States Patent
Hogan

(10) Patent No.: US 11,560,836 B2
(45) Date of Patent: Jan. 24, 2023

(54) ZERO INTRUSION VALVE FOR INTERNAL COMBUSTION ENGINE

(71) Applicant: Robert P. Hogan, Beaverton, OR (US)

(72) Inventor: Robert P. Hogan, Beaverton, OR (US)

( * ) Notice: Subject to any disclaimer, the term of this patent is extended or adjusted under 35 U.S.C. 154(b) by 0 days.

(21) Appl. No.: 17/244,565

(22) Filed: Apr. 29, 2021

(65) Prior Publication Data

US 2022/0220888 A1 Jul. 14, 2022

Related U.S. Application Data

(63) Continuation of application No. 17/147,358, filed on Jan. 12, 2021, now Pat. No. 11,408,336.

(51) Int. Cl.

| | |
|---|---|
| ***F02B 75/04*** | (2006.01) |
| ***F02D 15/02*** | (2006.01) |
| ***F02B 75/06*** | (2006.01) |

(52) U.S. Cl.

CPC ..... *F02B 75/047* (2013.01); *F02B 75/065* (2013.01); *F02D 15/02* (2013.01)

(58) Field of Classification Search

CPC ..... F02B 75/047; F02B 75/04; F02D 15/00; F02D 15/02; F01L 13/08; F01L 1/30; F01L 1/44; F01L 1/047; F01L 1/462; F01L 3/20; F01L 5/04

See application file for complete search history.

(56) References Cited

U.S. PATENT DOCUMENTS

| | | | | |
|---|---|---|---|---|
| 3,090,368 A | | 5/1963 | Buchwald | |
| 4,821,695 A | | 4/1989 | Freudenstein | |
| 4,846,138 A | * | 7/1989 | Vallejos | F01L 3/20 123/188.3 |
| 5,970,934 A | * | 10/1999 | Vallejos | F02B 31/00 123/90.27 |
| 6,308,677 B1 | * | 10/2001 | Bohach | F01L 7/021 123/190.8 |
| 6,772,717 B2 | | 8/2004 | Dachtchenko | |

(Continued)

FOREIGN PATENT DOCUMENTS

| | | | |
|---|---|---|---|
| JP | H06146935 | A | 5/1994 |
| WO | 200058612 | A1 | 10/2000 |
| WO | 2014140497 | A1 | 9/2014 |

OTHER PUBLICATIONS

International Search Report established in PCT/US22/070161, dated May 18, 2022.

(Continued)

*Primary Examiner* — Grant Moubry

(74) *Attorney, Agent, or Firm* — Raven Patents, LLC; Anton E. Skaugset

(57) ABSTRACT

An example embodiment of an all-stroke-variable internal combustion engine may include a piston slidably positioned within an engine cylinder for asymmetrical reciprocation and a primary crankshaft and a half-speed crankshaft to be operatively engaged for rotation of the half-speed crankshaft at half of a speed of the primary crankshaft, wherein the rotation of the half-speed crankshaft at half of the speed of the primary crankshaft to result in the asymmetrical reciprocation of the piston so as to produce a stroke length that is independently variable over four distinct strokes of a full cycle of the all-stroke-variable internal combustion engine.

19 Claims, 34 Drawing Sheets

(56) References Cited

U.S. PATENT DOCUMENTS

| | | | | |
|---|---|---|---|---|
| 6,820,586 | B2 | 11/2004 | Watanabe | |
| 7,305,938 | B2 | 12/2007 | Watanabe | |
| 8,127,734 | B2 * | 3/2012 | Jolley, Jr. | F01L 5/02 123/188.5 |
| 8,210,147 | B2 * | 7/2012 | Cotton | F01L 7/14 123/188.5 |
| 8,573,178 | B2 * | 11/2013 | Cleeves | F01L 5/06 123/188.5 |
| 8,776,756 | B2 * | 7/2014 | Cotton | F01L 7/16 123/188.5 |
| 2003/0159665 | A1 * | 8/2003 | Coney | F02B 25/14 123/65 VD |
| 2004/0112312 | A1 * | 6/2004 | Masse | F01L 1/465 123/90.12 |
| 2006/0137632 | A1 | 6/2006 | Aoyama et al. | |
| 2011/0226199 | A1 | 9/2011 | Mohtashemi | |

OTHER PUBLICATIONS

Written opinion of the International Searching Authority established in PCT/US22/070161, dated May 18, 2022.

* cited by examiner

| P16 | | | | | | | |
|---|---|---|---|---|---|---|---|
| SLOPE=0 | | STROKE | | KCR | H | EXR | PWR |
| EX/IN | 24.98331 | IN | 1.27282 | 10.2 | 25.21591 | 13.99786 | 24.95396 |
| IN/CP | 23.71049 | CP | 1.37101 | 10.2 | 25.21591 | 13.99786 | 24.95396 |
| CP/PW | 25.0815 | PW | 3.35413 | 10.2 | 25.21591 | 13.99786 | 24.95396 |
| PW/EX | 21.72737 | EX | 3.25594 | 10.2 | 25.21591 | 13.99786 | 24.95396 |

| P17 | | | | | | | |
|---|---|---|---|---|---|---|---|
| SLOPE=0 | | STROKE | | KCR | H | EXR | PWR |
| EX/IN | 25.5282 | IN | 1.47041 | 10.2 | 25.69109 | 20.60435 | 23.13174 |
| IN/CP | 24.05779 | CP | 1.48747 | 10.2 | 25.69109 | 20.60435 | 23.13174 |
| CP/PW | 25.54526 | PW | 3.37331 | 10.2 | 25.69109 | 20.60435 | 23.13174 |
| PW/EX | 22.17195 | EX | 3.35625 | 10.2 | 25.69109 | 20.60435 | 23.13174 |

| P18 | | | | | | | |
|---|---|---|---|---|---|---|---|
| SLOPE=0 | | STROKE | | KCR | H | EXR | PWR |
| EX/IN | 25.5387 | IN | 1.48494 | 10.2 | 25.67794 | 24.09576 | 23.0955 |
| IN/CP | 24.05376 | CP | 1.47916 | 10.2 | 25.67794 | 24.09576 | 23.0955 |
| CP/PW | 25.53292 | PW | 3.34921 | 10.2 | 25.67794 | 24.09576 | 23.0955 |
| PW/EX | 22.18371 | EX | 3.35499 | 10.2 | 25.67794 | 24.09576 | 23.0955 |

| P19 | | | | | | | |
|---|---|---|---|---|---|---|---|
| SLOPE=0 | | STROKE | | KCR | H | EXR | PWR |
| EX/IN | 25.54916 | IN | 1.49966 | 10.2 | 25.66473 | 29.01728 | 23.05406 |
| IN/CP | 24.0495 | CP | 1.47101 | 10.2 | 25.66473 | 29.01728 | 23.05406 |
| CP/PW | 25.52051 | PW | 3.32478 | 10.2 | 25.66473 | 29.01728 | 23.05406 |
| PW/EX | 22.19573 | EX | 3.35343 | 10.2 | 25.66473 | 29.01728 | 23.05406 |

| P20 | | | | | | | |
|---|---|---|---|---|---|---|---|
| SLOPE=0 | | STROKE | | KCR | H | EXR | PWR |
| EX/IN | 25.55958 | IN | 1.51474 | 10.2 | 25.65151 | 36.45973 | 23.00636 |
| IN/CP | 24.04484 | CP | 1.46322 | 10.2 | 25.65151 | 36.45973 | 23.00636 |
| CP/PW | 25.50806 | PW | 3.30033 | 10.2 | 25.65151 | 36.45973 | 23.00636 |
| PW/EX | 22.20773 | EX | 3.35185 | 10.2 | 25.65151 | 36.45973 | 23.00636 |

| P21 | | | | | | | |
|---|---|---|---|---|---|---|---|
| SLOPE=0 | | STROKE | | KCR | H | EXR | PWR |
| EX/IN | 25.57 | IN | 1.53006 | 10.2 | 25.63827 | 49.07201 | 22.95319 |
| IN/CP | 24.03994 | CP | 1.45562 | 10.2 | 25.63827 | 49.07201 | 22.95319 |
| CP/PW | 25.49556 | PW | 3.2756 | 10.2 | 25.63827 | 49.07201 | 22.95319 |
| PW/EX | 22.21966 | EX | 3.35004 | 10.2 | 25.63827 | 49.07201 | 22.95319 |

| P22 | | | | | | | |
|---|---|---|---|---|---|---|---|
| SLOPE=0 | | STROKE | | KCR | H | EXR | PWR |
| EX/IN | 25.58036 | IN | 1.54571 | 10.2 | 25.62501 | 74.98912 | 22.89232 |
| IN/CP | 24.03465 | CP | 1.44836 | 10.2 | 25.62501 | 74.98912 | 22.89232 |
| CP/PW | 25.48301 | PW | 3.25062 | 10.2 | 25.62501 | 74.98912 | 22.89232 |
| PW/EX | 22.23239 | EX | 3.34797 | 10.2 | 25.62501 | 74.98912 | 22.89232 |

| P23 | | | | | | | |
|---|---|---|---|---|---|---|---|
| SLOPE=0 | | STROKE | | KCR | H | EXR | PWR |
| EX/IN | 25.59068 | IN | 1.56157 | 10.2 | 25.61174 | 158.9033 | 22.82708 |
| IN/CP | 24.02911 | CP | 1.44132 | 10.2 | 25.61174 | 158.9033 | 22.82708 |
| CP/PW | 25.47043 | PW | 3.2256 | 10.2 | 25.61174 | 158.9033 | 22.82708 |
| PW/EX | 22.24483 | EX | 3.34585 | 10.2 | 25.61174 | 158.9033 | 22.82708 |

| P24 | | | | | | | |
|---|---|---|---|---|---|---|---|
| SLOPE=0 | | STROKE | | KCR | H | EXR* | PWR |
| EX/IN | 25.60094 | IN | 1.57776 | 10.2 | 25.59846 | -1348.18 | 22.7459 |
| IN/CP | 24.02318 | CP | 1.43463 | 10.2 | 25.59846 | -1348.18 | 22.7459 |
| CP/PW | 25.45781 | PW | 3.20035 | 10.2 | 25.59846 | -1348.18 | 22.7459 |
| PW/EX | 22.25746 | EX | 3.34348 | 10.2 | 25.59846 | -1348.18 | 22.7459 |

*WILL NOT WORK (EX/IN>H)

ZERO INTRUSION VALVE FOR INTERNAL COMBUSTION ENGINE

This application is a continuation of U.S. patent application Ser. No. 17/147,358 entitled "ALL-STROKE-VARIABLE INTERNAL COMBUSTION ENGINE," filed Jan. 12, 2021, incorporated herein by reference in its entirety.

BACKGROUND

Field

Subject matter disclosed herein relates generally to internal combustion engines and, more particularly, to an all-stroke-variable internal combustion engine.

Information

Internal combustion engines are widely employed in automotive, railroad, maritime, or other industries, applications, etc. Generally, internal combustion engines convert chemical energy from fuel into mechanical energy, such as, for example, to move one or more associated pistons inside one or more respective cylinders. In some instances, automotive and/or like applications may employ, for example, a four-stroke and/or four-cycle internal combustion engine, such as a gasoline engine using an Otto cycle, as one example, with four strokes or cycles comprising intake, compression, combustion and/or expansion, and/or exhaust. Briefly, during an intake stroke, an intake valve opens and/or air may be drawn and/or forced into a cylinder as a piston moves down within the cylinder. During a compression stroke, a piston moves back up within the cylinder and/or compresses the air. During a combustion and/or expansion stroke, as the piston reaches an approximate top of its stroke within the cylinder, fuel may be injected and/or a compressed air/fuel mixture may be ignited, thus forcing the piston in an opposite direction (e.g., back down). During an exhaust stroke, the piston moves back to the top, thus pushing exhaust created from the combustion out of an exhaust valve. As a result of the piston being connected to a crankshaft, a substantially linear reciprocating motion of the piston (e.g. up and/or down) translates into a rotational motion of the crankshaft, and/or a rotating crankshaft may be used to rotate wheels of a car, ship propeller, etc. At times, instead of or in addition to gasoline engines, so-called "diesel" engines may be employed. Briefly, diesel engines are generally similar to gasoline engines, but may have no spark plugs to ignite fuel. Rather, diesel engines may typically have an air charge drawn and/or forced into a cylinder as a piston moves down within the cylinder. During a compression stroke, a piston moves back up within the cylinder and thus compresses the air. Fuel may be injected directly into a combustion chamber and the fuel may be ignited via heat resulting from compression of air within the combustion chamber.

Since an initial design of an internal combustion engine, such as a four-stroke internal combustion engine, as one example, there has been an ongoing effort to improve its performance. At times, performance may be measured in a number of ways, such as, for example, via power output per engine weight and/or cylinder volume, an ability to operate on lower octane fuels, an ability to operate with greater fuel efficiency, a reduction of a number of moving parts within an engine for reliability purposes, and/or the like. In some instances, performance may also be measured based, at least in part, on a reduction of noise, vibration, and/or harshness (HVC), for example. Thus, how to improve performance of an internal combustion engine continues to be an area of development.

BRIEF DESCRIPTION OF DRAWINGS

Claimed subject matter is particularly pointed out and/or distinctly claimed in the concluding portion of the specification. However, both as to organization and/or method of operation, together with objects, features, and/or advantages thereof, it may best be understood by reference to the following detailed description if read with the accompanying drawings in which:

Figure 1:
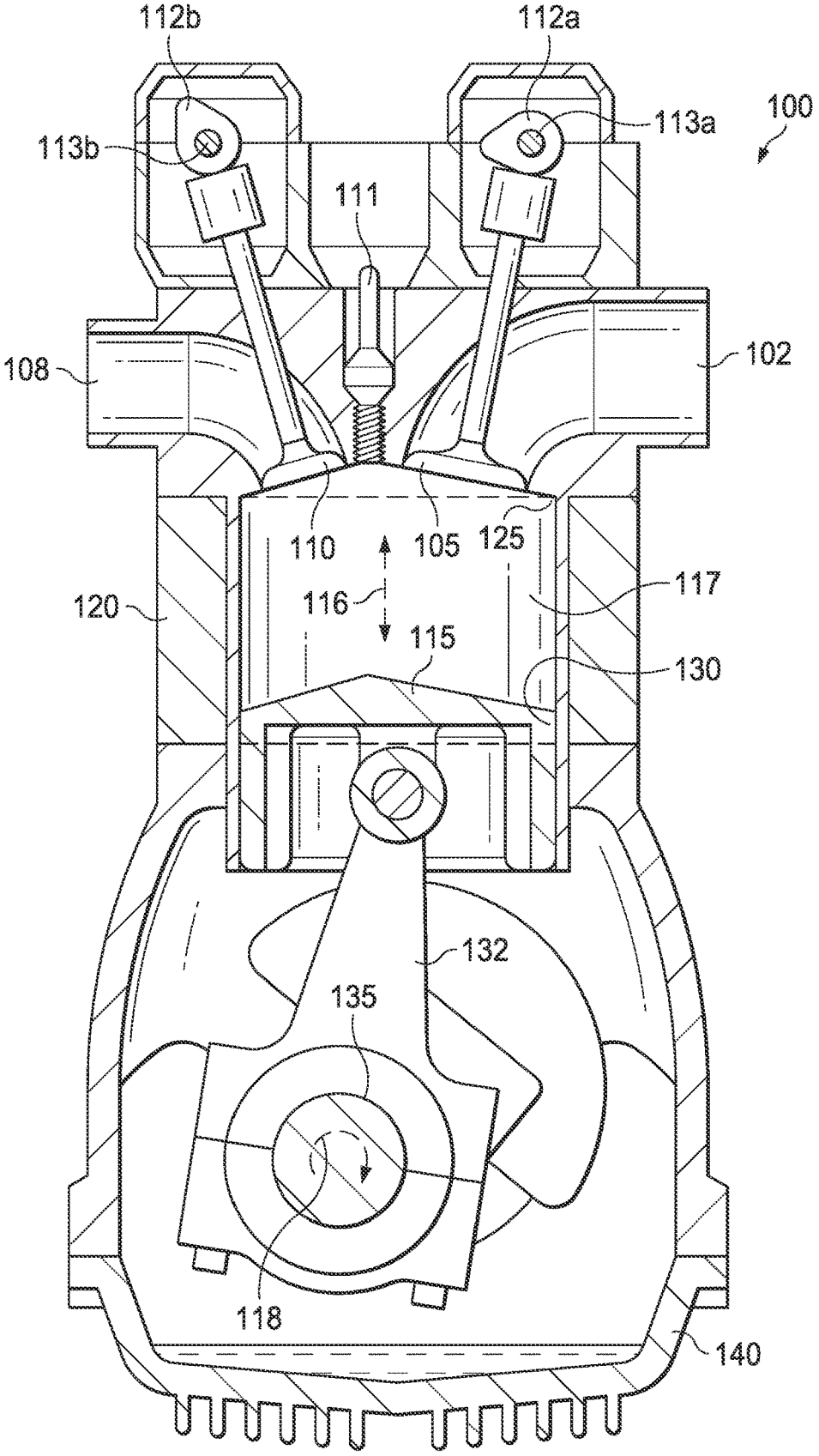
FIG. 1 depicts an example four-stroke internal combustion engine, in accordance with an embodiment.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and/or are not necessarily intended to refer to a complete claim set, to a particular combination of claim sets (e.g., method claims, apparatus claims, etc.), or to a particular claim. It should also be noted that directions and/or references, for example, such as up, down, top, bottom, vertical, horizontal, and/or so on, may be used to facilitate and/or simplify discussion of drawings and/or calculations and/or are not intended to restrict application of claimed subject matter. Therefore, the following detailed description is not to be taken to limit claimed subject matter and/or equivalents.

DETAILED DESCRIPTION

References throughout this specification to one implementation, an implementation, one embodiment, an embodiment, and/or the like means that a particular feature, structure, characteristic, and/or the like described in relation to a particular implementation and/or embodiment is included in at least one implementation and/or embodiment of claimed subject matter. Thus, appearances of such phrases, for example, in various places throughout this specification are not necessarily intended to refer to the same implementation and/or embodiment or to any one particular implementation and/or embodiment. Furthermore, it is to be understood that particular features, structures, characteristics, and/or the like described are capable of being combined in various ways in one or more implementations and/or embodiments and, therefore, are within intended claim scope. In general, of course, as has always been the case for the specification of a patent application, these and/or other issues have a potential to vary in a particular context of usage. In other words, throughout the patent application, particular context of description and/or usage provides helpful guidance regarding reasonable inferences to be drawn; however, likewise, "in this context" in general without further qualification refers to the context of the present patent application.

In accordance with one or more example embodiments, an all-stroke-variable internal combustion engine is provided. As used herein, an "all-stroke-variable internal combustion engine" refers to a four-stroke internal combustion engine in which individual strokes are variable. For example, as discussed in greater detail below, individual strokes of four strokes of an all-stroke-variable internal combustion engine may be selected and/or set and/or otherwise configured to implement and/or achieve an internal combustion engine having improved performance, such as illustrated via one or more performance characteristics and/or aspects, among others.

As alluded to previously, a four-stroke and/or four-cycle internal combustion engine may comprise, for example, an internal combustion engine in which a piston completes four separate strokes while turning a crankshaft to complete a full operating cycle. More specifically, in a four-stroke internal combustion engine, a piston may make two complete passes or travel four complete stroke lengths in a cylinder in order to complete an operating cycle. Thus, an operating cycle may involve two revolutions (720°) of a crankshaft. A "stroke," as used herein, refers to a travel of a piston between a top dead center (TDC) and/or a bottom dead center (BDC) along a cylinder, in either direction. A "stroke length" typically refers to a distance travelled by a piston in each cycle. Four separate strokes of a four-stroke internal combustion engine comprise intake, compression, combustion and/or expansion, and/or exhaust, as was also discussed.

Depending on an implementation, a four-stroke internal combustion engine may comprise one or more cylinders. At times, a cylinder may be oriented to be substantially vertical, such that a piston is disposed above a crankcase and/or valves are at a top of one or more cylinders, for example. A piston top and/or a top of a bore may be flat and/or approximately perpendicular to a bore centerline for the convenience of a discussion herein. However, it should be appreciated that one of ordinary skill in the art may alter or change a cylinder based on a particular application, such as without deviating from the scope and/or spirit of the present disclosure.

With this in mind, FIG. 1 is an embodiment 100 of an example four-stroke internal combustion engine. Embodiment 100 may comprise, for example, an intake manifold 102, an intake valve 105, an exhaust manifold 108, an exhaust valve 110, a spark plug 111, an intake cam or lobe 112*a*, an intake camshaft 113*a*, an exhaust cam or lobe 112*b*, an exhaust camshaft 113*b*, and/or a piston 115. As referenced generally via an arrow at 116, piston 115 may move or travel within a cylinder 117 of a cylinder block 120 between a top dead center (TDC) 125 and/or a bottom dead center (BDC) 130. A "top dead center" or "TDC," as used herein, refers to a position of piston 115 in which piston 115 is farthest from a main bearing centerline of a crankshaft 135 during operation. A "bottom dead center" or "BDC," as used herein, refers to a position of piston 115 in which piston 115 is closest to main bearing centerline of crankshaft 135 during operation. In accordance with embodiment 100, for example, piston 115 may be rotatably coupled to crankshaft 135 via a connecting rod 132. As was indicated, a reciprocal linear movement of piston 115, such as between TDC 125 and/or BDC 130, for example, may cause crankshaft 135 to rotate, such as is illustrated generally via an arrow at 118. For example, expansion of combustion gases within cylinder 117 may impart force to push piston 115, such as between TDC 125 and/or BDC 130, such as to impart movement to connecting rod 132 via an associated crank-throw, which may, in turn, produce turning effort or torque, thus, causing crankshaft 135 to rotate.

In an implementation, an intake stroke may also be referred to as an induction or suction stroke. An intake stroke of piston 115 may initiate or begin at TDC 125 and/or may complete or end at BDC 130. Here, intake valve 105 may be in an open position while piston 115 pulls an air-fuel mixture into cylinder 117 by producing vacuum-like low pressure in cylinder 117 through piston's 115 downward motion. Ambient atmospheric pressure may force an air-fuel mixture through an open intake valve 105 into cylinder 117 to fill a low-pressure area created by movement of piston 115. In some instances, cylinder 120 may continue to fill slightly past BDC 130 as an air-fuel mixture continues to flow by its own inertia while piston 115 begins to change direction. Intake valve 105 may remain open a few degrees of crankshaft's 135 rotation after piston 115 has reached BDC 130, depending at least in part on a particular internal combustion engine design. Intake valve 105 may subsequently close to seal an air-fuel mixture inside cylinder 117.

According to an implementation, a compression stroke may begin at BDC 130, for example, and/or just at an end of a suction stroke, and/or may end at TDC 125. In a compression stroke, piston 115 may compress an air-fuel mixture in preparation for ignition during a combustion and/or expansion stroke. During a compression stroke, both intake valve 105 and/or exhaust valve 110 may be closed. A combustion chamber of cylinder 117 may be sealed to form a charge. A "combustion chamber," as used herein, refers to an enclosed space (e.g., of cylinder 117) in which combustion occurs. A "charge," as used herein, refers to a volume of compressed air-fuel mixture trapped inside a combustion chamber (e.g., of cylinder 117) and/or ready for ignition. Compressing an air-fuel mixture may allow more energy to be released as a charge is ignited. Intake valve 105 and/or exhaust valve 110 may be closed to ensure that cylinder 117 is substantially sealed to provide compression. "Compression," as used herein, refers to a process of reducing and/or squeezing a charge from a large volume to a smaller volume, such as in a combustion chamber of cylinder 117 above piston 115, for example.

In an implementation, as piston 115 compresses a charge, an increase in compressive force supplied by work being done by piston 115 may cause heat to be generated. Compression and/or heating of an air-fuel vapor in a charge may result in an increase in charge temperature and/or an increase in fuel vaporization. An increase in fuel vaporization may occur as small droplets of fuel become vaporized more completely from heat generated. An increased droplet surface area exposed to an ignition flame may allow for a more complete burning of a charge in a cylinder.

In some instances, a four-stroke internal combustion engine, such as an internal combustion engine illustrated in embodiment 100, for example, may be implemented to increase a compression ratio, such as in a suitable manner. A "compression ratio," as used herein, refers to a measure of a volume of a cylinder 117 with piston 115 at BDC 130 divided by a volume of a cylinder 117 with piston 115 at TDC 125. "Swept volume," as used herein, refers to a volume in cylinder 117 displaced by piston 115 as it travels from TDC 125 to BDC 130. A measurement of swept volume may, for example, be determined using stroke and/or bore measurements and/or may indicate how much fuel and/or air is sucked in and/or swept out of cylinder 117. Generally, for a relatively higher compression ratio, an internal combustion engine may be relatively more fuel-efficient. A higher compression ratio may, for example, provide a gain or improvement in combustion pressure or force on piston 115.

Continuing with the above discussion, an expansion stroke may also be referred to as power, ignition, and/or combustion stroke. An expansion stroke may, for example, begin at a start of a second revolution of crankshaft 135 of a four-stroke cycle. At this point during a cycle, crankshaft 135 may have completed a full 360° revolution, such as within and/or in relation to a crankcase 140. While piston 115 is at TDC 125, at an end of a compression stroke, a compressed air-fuel mixture may be ignited by spark plug 111 (e.g., in a gasoline internal combustion engine), for example, or by heat generated by high compression (e.g., in a diesel or compression ignition internal combustion engine), thus, forcefully pushing or returning piston 115 to BDC 130. As was indicated, an expansion stroke may, for example, produce mechanical work so as to turn crankshaft 135. Thus, expansion of gases within cylinder 117 during an expansion stroke may impart force to push piston 115, such as from TDC 125 to BDC 130, for example, and/or may impart movement to connecting rod 132, which may, in turn, cause crankshaft 135 to rotate.

An exhaust stroke may also be referred to as "outlet." During an exhaust stroke, piston 115 may return from BDC 130 to TDC 125, such as while exhaust valve 110 is open as pressure within cylinder 117 drops and/or while gas is expelled, for example. Thus, as piston 115 reaches BDC 130 during an expansion stroke, such as discussed above, before and/or as combustion is complete, inertia of crankshaft 118 (e.g., of a flywheel and/or other moving parts) may push piston 115 back to TDC 125, for example, thus, forcing exhaust gases and/or unburnt fuel and/or air out through open exhaust valve 110. Typically, an exhaust stroke may clear or expel cylinder 117 of spent exhaust, such as in preparation for another operational cycle, for example, via exhaust valve 110 and/or associated manifold 108. In some instances, here, a portion of exhaust gas may also enter intake manifold 102, for example, and/or may be sucked back into cylinder 117 during an intake stroke. At the end of an exhaust stroke, piston 115 is yet again at TDC 125 and/or a full operating cycle of a four-cycle internal combustion engine of example embodiment 100 has been completed.

In certain four-stroke internal combustion engines, such as isometric-isochronal engines, as one example, all four strokes are typically the same length and/or have the same TDC and/or BDC. As a result, in some instances, an intake stroke may, for example, have less than suitable and/or desired stroke length and, thus, less than suitable and/or desired efficiency. If an intake stroke begins or starts from higher in a cylinder, however, the intake stroke may be more efficient and/or more effective due, at least in part, to a relatively smaller cylinder volume at TDC causing greater and/or quicker pressure differential across an intake system and/or a cylinder. At times, in a four-stroke internal combustion engine having all four strokes of substantially the same length, a compression stroke may compress less air, for example, because an intake stroke may not provide air that a longer and/or more efficient and/or effective stroke may have in the case of internal combustion engines without a throttle, such as a diesel engine, or gas engines at wide-open throttle, for example. Further, an expansion stroke of a four-stroke internal combustion engine having all strokes of the same length may not be sufficiently long to allow an expansion process to convert all or nearly all of the energy of combustion into mechanical energy, leaving a significant fraction of the energy of combustion not converted into mechanical energy because an exhaust valve may open before the conversion process is complete. At times, this may, for example, allow a significant fraction of expanding gas to escape out an exhaust system before it can be converted to mechanical power and/or energy. In addition, an exhaust stroke of a four-stroke internal combustion engine having all four strokes of the same length may not expel as much hot exhaust gas as it may expel in an implementation in which an exhaust-intake TDC is as close to a cylinder top as cylinder design and/or overall valve design allows. Thus, as was indicated, intake air may be unnecessarily contaminated with hot exhaust gas, such as before an expansion cycle starts, for example, because an exhaust stroke may not expel all possible exhaust gas. A fraction of exhaust gas contamination of intake air may vary with power output and/or internal combustion engine speed, for example, which may involve controlled internal combustion engine functions, such as ignition timing and/or fuel-to-air ratio to accommodate a wide range of varying operating parameters which, in turn, may result in controlled internal combustion engine functions being less than ideal. At times, an excess residual exhaust gas mixed in with combustion air may also displace clean air otherwise available for an expansion stroke, for example. In some instances, these and/or like issues (e.g., inefficiencies, excesses, etc.) may result in a relatively larger-footprint internal combustion engine that may, for example, take in and/or utilize relatively more air and/or fuel in order to produce a given amount of energy.

At times, to address these or like issues, such as in an effort to improve performance, for example, a partial-stroke-variable internal combustion engine may, for example, be utilized, in whole or in part. In this context, a "partial-stroke-variable internal combustion engine" refers to a four-stroke internal combustion engine in which BDC has a particular location for expansion-exhaust and/or in which BDC has a different location for intake-compression. In an embodiment, TDC for a partial-stroke-variable internal combustion engine may be identical for exhaust-intake and/or compression-expansion. Thus, for a particular implementation of a partial-stroke-variable internal combustion engine, intake and/or compression strokes may be substantially identical to one another. Also, for a particular implementation, expansion and/or exhaust strokes may be substantially identical to one another and/or may differ from intake and/or compression strokes. At times, movement of an expansion-exhaust BDC may, for example, improve or affect a fraction of energy of combustion converted to mechanical energy as compared to a four-stroke internal combustion engine having all four strokes of equal length and/or with TDCs and/or BDCs in the same corresponding places. For example, as an intake stroke starts from higher in a cylinder, the intake stroke may be more efficient and/or effective due, at least in part, to a reduced volume of the cylinder at an exhaust-intake TDC, thus, causing greater and/or quicker pressure differential across an intake system during the intake stroke and/or causing the intake stroke to be of increased volume.

In some instances, a partial-stroke-variable internal combustion engine, however, may compress less air and/or may be less efficient and/or effective than an all-stroke-variable internal combustion engine, such as discussed herein. Thus, depending on an implementation, an all-stroke-variable internal combustion engine may, for example, provide a suitable flexibility of design, such that an exhaust-intake TDC, an intake-compression BDC, a compression-expansion TDC, and/or an expansion-exhaust BDC are each selectively and/or suitably located and/or relocated so as to achieve the engine's particular performance and/or output. Accordingly, as will also be seen, all strokes of an all-stroke-variable internal combustion engine may be independently variable and, thus, all TDCs and/or all BDCs may also be independently variable, such as to achieve the engine's particular best or nearer to best possible performance and/or output. Thus, in some instances, an all-stroke-variable internal combustion engine may, for example, advantageously accommodate a best or otherwise suitable fit combination of four stroke ratios for an intended fuel and/or for an intended use of an internal combustion engine. At times, an all-stroke-variable internal combustion engine, as discussed herein, may also be implemented to have a predetermined desired or suitable length of each of four strokes, such as for flexibility of design, for example. As such, in some instances, an all-stroke-variable internal combustion engine may, for example, achieve a predetermined compression ratio, such as to accommodate an intended fuel and/or engine application.

Thus, as will be discussed in greater detail below, in accordance with a particular example embodiment, a location of a top of a bore of a cylinder of an all-stroke-variable internal combustion engine may, for example, be determined or otherwise identified, such as after a compression stroke length and/or locations of TDC and/or BDC have been determined or otherwise identified. As also discussed below, a predetermined compression ratio, a location of a bottom compression stroke, and/or a location of a top of a compression stroke may, for example, be used, at least in part, to calculate or determine a location of a top of a bore of a cylinder of an all-stroke-variable internal combustion engine. As will also be seen, a predetermined expansion ratio may, for example, be selected or otherwise utilized, in whole or in part, such as to accommodate an intended fuel and/or to more completely convert energy of combustion into mechanical energy before an exhaust valve of an all-stroke-variable internal combustion engine opens. An "expansion ratio," as used herein, refers to a ratio of a volume of a cylinder of an internal combustion engine from its smallest capacity to its largest capacity during an expansion stroke. For example, an expansion ratio may be calculated by dividing a swept volume of an expansion stroke by a volume of a cylinder when a piston is at the compression-expansion TDC.

As alluded to previously, a more effective and/or more efficient exhaust ratio may, for example, more completely expel exhaust gases. In this context, an "exhaust ratio" refers to a swept volume of an exhaust stroke divided by a volume of a cylinder when a piston is at an exhaust-intake TDC. Here, a piston may, for example, be raised to as near to a top of an engine cylinder as suitable and/or desired. It should be noted, however, that, in some instances, a fraction of exhaust gases expelled by an exhaust stroke may, for example, be limited by cylinder design, valve design, and/or valve timing. In some instances, use of a predetermined exhaust ratio may provide for taking advantage of various cylinder designs and/or valve designs, for example, which may improve current designs having limitations of an exhaust stroke. An exhaust ratio may be selected or otherwise utilized, which may be relatively close to infinity, for example, to result in a fraction of exhaust gases expelled being close to 100% or as great as dynamics of exhaust gases may permit. It should be appreciated, however, that in some implementations, a designer of an internal combustion engine may choose to keep a certain amount of exhaust gas in a cylinder. Further, in some implementations having an exhaust ratio relatively close to infinity an intake ratio may also be relatively close to infinity. Of course, claimed subject matter is not limited in scope in these respects.

As will also be seen, in some instances, an all-stroke-variable internal combustion engine may, for example, provide for improved efficiency and/or effectiveness of an intake stroke, for example, as a result of a relatively low cylinder volume at a start of the intake stroke. Namely, a relatively low cylinder volume at a beginning of an intake stroke may, for example, cause a relatively rapid buildup of pressure differential between a cylinder and/or an intake passage (e.g., intake manifold 102 of FIG. 1, etc.) at a start of an intake stroke. Additionally, with an exhaust-intake TDC being above a compression-expansion TDC, an intake stroke may be correspondingly longer, for example, which at times may result in additional air entering a cylinder of an internal combustion engine (e.g., without a throttle, at wide open throttle, etc.). As such, at times, a longer and/or more efficient and/or more effective intake stroke of an all-stroke-variable internal combustion engine may, for example, more effectively and/or more efficiently increase or otherwise alter displacement of an internal combustion engine, such as without increasing its overall bulk or footprint.

As was also indicated, in some instances, a number of advantages of a longer intake stroke of an all-stroke-variable internal combustion engine may, for example, be realized by an internal combustion engine which does not utilize a throttle. A "throttle," as used herein, refers to a mechanism for controlling an engine's power by regulating the amount of fuel and/or air entering the engine. For example, in some instances, an engine's power may be increased and/or decreased by restriction of inlet gases. As discussed above, an all-stroke-variable internal combustion engine may, for example, expel more exhaust gas than a partial-stroke-variable internal combustion engine, such as to avoid or reduce unnecessary contamination and/or displacement of intake air, for example. An exhaust stroke of a partial-stroke-variable internal combustion engine, however, may not be closer to desired and/or ideal as compared with an all-stroke-variable internal combustion engine having an exhaust-intake TDC that is closer to a top of a cylinder. As such, in a partial-stroke-variable internal combustion engine, for example, intake air may have greater contamination with hot exhaust gas before an expansion cycle starts than would an all-stroke-variable internal combustion engine. A fraction of exhaust gas contamination of intake air may vary with internal combustion engine speed, load, throttle setting and/or one or more other variables that may affect engine function. One or more controlled internal combustion engine functions, such as ignition timing and/or fuel mixture may, for example, accommodate identified variations and/or unidentified variations. With an all-stroke-variable internal combustion engine, a reduction in exhaust gas contamination of intake air may reduce causes of combustion variation, for example, and, in turn, may provide for certain engine functions, such as ignition timing and/or fuel mixture, for example, to be closer to desired.

According to an implementation, in some instances, in a partial-stroke-variable internal combustion engine, excess spent exhaust gas mixed with combustion air may, for example, displace clean air otherwise available for an expansions stroke. A partial-stroke-variable internal combustion engine may therefore have a larger engine footprint in order to produce a given amount of power from more fuel than would an all-stroke-variable internal combustion engine. At times, an all-stroke-variable internal combustion engine may also improve an intake ratio relative to that of a partial-stroke-variable internal combustion engine, for example. An "intake ratio," as used herein, refers to a volume of a cylinder when a piston is at an exhaust-intake TDC divided into a swept volume of an intake stroke. Thus, in some instances, an all-stroke-variable internal combustion engine may, for example, advantageously utilize a combination of four stroke ratios (e.g., compression, expansion, exhaust, and/or intake), which may more suitably fit an intended fuel and/or application of an all-stroke-variable internal combustion engine.

Embodiments described herein including, for example, the various example implementations mentioned, may include an all-stroke variable internal combustion engine. An all-stroke-variable internal combustion engine may include an engine cylinder, a piston slidably positioned within the engine cylinder for asymmetrical reciprocal movement, a piston rod having proximal and/or distal ends pivotally connected to the piston at the proximal end, a primary crankshaft rod pivotally connected to the piston rod at the distal end and/or rotatably connected to a primary crankshaft at an opposite end and a half-speed cycling rod pivotally connected to the piston rod at the distal end and/or rotatably connected to a half-speed crankshaft at an opposite end. Rods, levers and/or fulcrums may be used as may be advantageous and/or required to facilitate the half-speed cycling rod location and/or motion and/or power transmission between the half-speed crankshaft and the half-speed cycling rod. The primary crankshaft and/or half-speed crankshaft may be mounted on parallel axes to be operatively engaged for rotation of the half-speed crankshaft at half the speed of the primary crankshaft. The primary crankshaft rod and/or the half-speed cycling rod along with ancillary rods, levers and/or fulcrums may be arranged to cooperate with the piston rod during the reciprocal movements of the piston so as to produce a stroke length that is independently variably over four distinct stokes of a full cycle of the all-stroke-variable internal combustion engine.

Figure 2A:
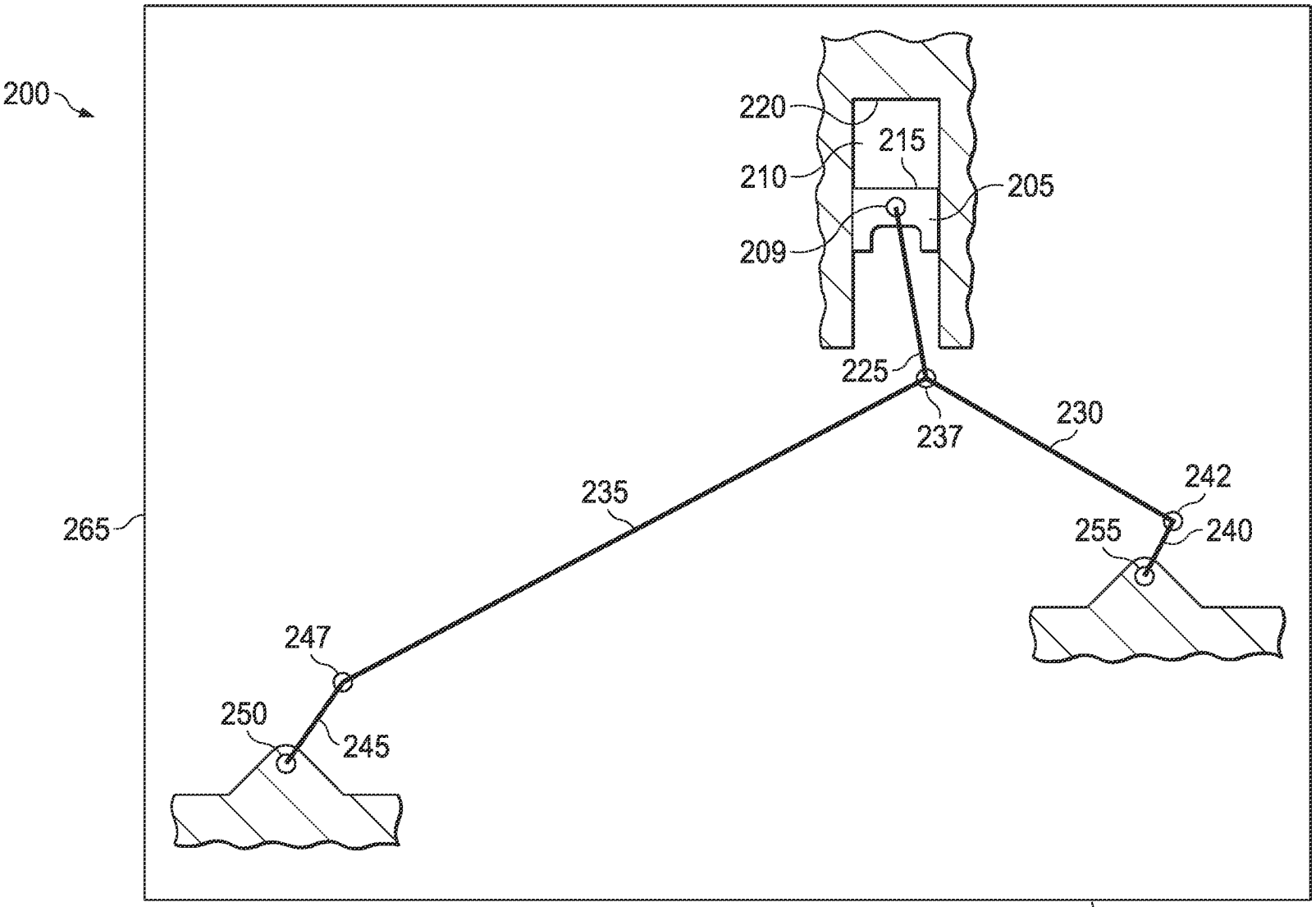
FIG. 2A depicts a schematic illustration of an all-stroke-variable internal combustion engine, in accordance with an embodiment.
Figure 2B:
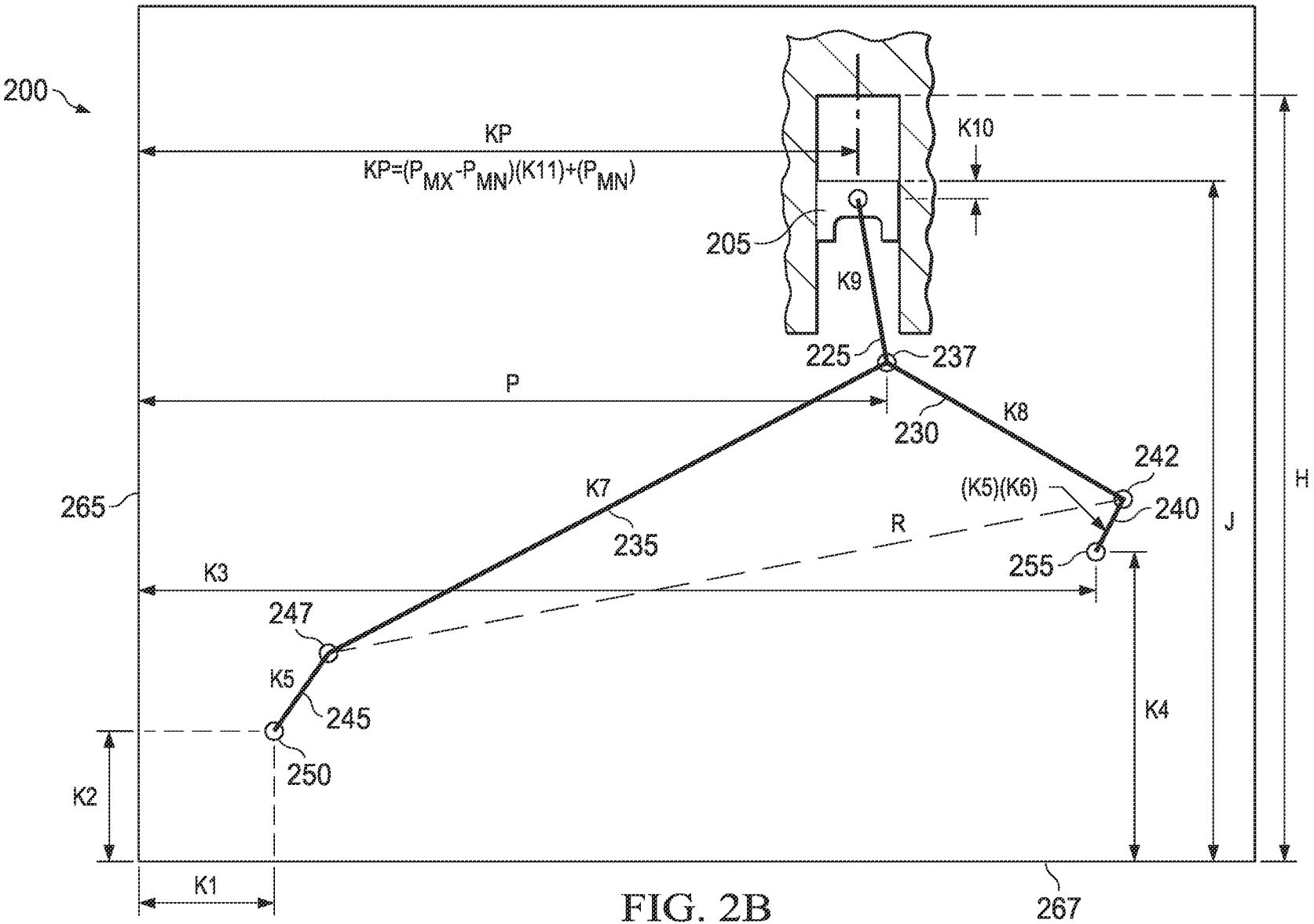
FIG. 2B depicts a schematic illustration of example measurements of various distances between various components of an all-stroke-variable internal combustion engine, in accordance with an embodiment.
Figure 2C:
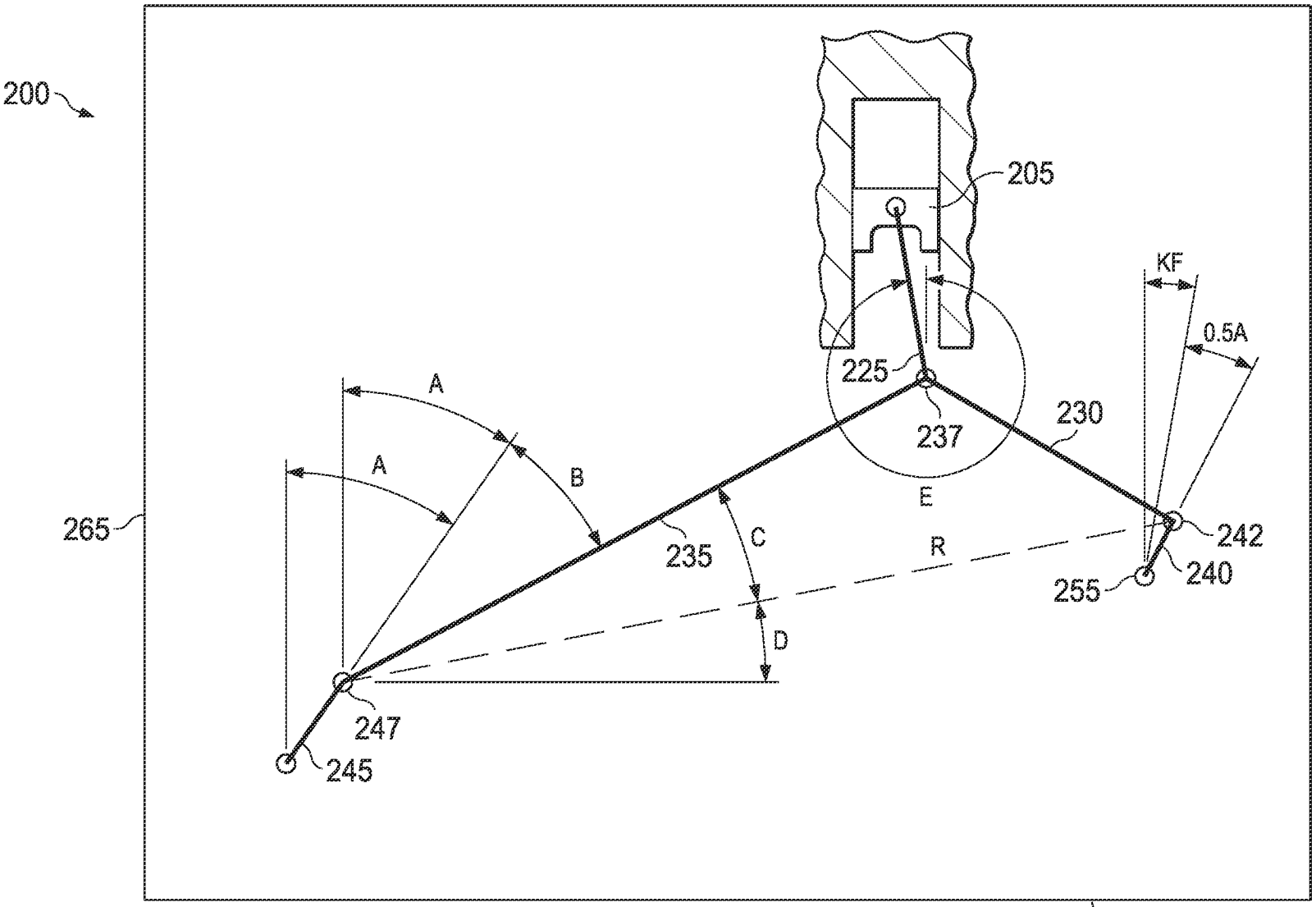
FIG. 2C depicts a schematic illustration of example measurements of various angles between various components of an all-stroke-variable internal combustion engine, in accordance with an embodiment.

FIGS. 2A-2C schematically illustrate an embodiment 200 and FIGS. 5A-5F schematically illustrate an embodiment 500 of an example all-stroke-variable internal combustion engine. For ease of illustration and/or discussion, in FIGS. 2A-2C and FIGS. 5A-5F, various portions of an example all-stroke-variable internal combustion engine are shown in crosshatch. Also, as illustrated, embodiment 200 depicted in FIGS. 2A-2C may include pivotal and/or rotatable connections between engine components, such as in six places for a particular implementation, and embodiment 500 depicted in FIGS. 5A-5F may include pivotal and/or rotatable connections between engine components, such as in nine places, for example. As illustrated, in an implementation of embodiment 200 as depicted in FIGS. 2A-2C, a piston 205 may be slidably positioned within a cylinder for reciprocal movements. Similarly, for an implementation of embodiment 500 depicted in FIGS. 5A-5F, a piston 505 may be slidably positioned within a cylinder for reciprocal movements. For example, piston 205 may move in a reciprocating manner within bore 210 and piston 505 may move in a reciprocating manner within a bore 510. Also, for example, a top 215 of piston 205 may move between top 220 of bore 210 and/or a location within bore 210 disposed a particular distance away from top 220. Also, for example, a top 514 of piston 505 may move between top 512 or bore 510 and/or a location within bore 510 disposed a particular distance away from top 512.

Further, again referring to example embodiments 200 and 500 of an example all-stroke-variable internal combustion engine, a piston rod 225 may, for example, pivotally connect or couple a body of piston 205 to a half-speed cycling rod 230 and/or a primary crankshaft rod 235 at or near connection 237. Also, similarly, a piston rod 516 may, for example, pivotally connect or couple to a body of piston 505 to a half-speed cycling rod 518 and/or a primary crankshaft rod 520 at or near connection 522. Piston rod 225 may have proximal and/or distal ends and/or may be pivotally connected to piston 205 at the proximal end, for example. Also, for example, piston rod 516 may have proximal and/or distal ends and/or may be pivotally connected to piston 505 at the proximal end. Primary crankshaft rod 235 may be pivotally connected to piston rod 225 at distal end and/or may be rotatably connected to a primary crankshaft 245 crank pin 247 at an opposite end, for example. Also, for example, primary crankshaft rod 520 may be pivotally connected to piston rod 516 at a distal end and/or may be rotatably connected to a primary crankshaft 540 at the primary crankshaft pin 570 at an opposite end.

Additionally, again referring to example embodiments 200 and 500 of an example all-stroke-variable internal combustion engine, half-speed cycling rod 230 may be pivotally connected or coupled to a half-speed crankshaft 240 at half-speed crankshaft crankpin 242, for example. The half-speed crankshaft 240 being suitably positioned and/or suitably timed and/or synchronized with the angular position of the primary crankshaft so as to translate and/or convert the rotative motion at the half-speed crankshaft crankpin connection 242 to the half-speed cycling rod 230 in a particular way at least in part into a desired regular and/or irregular orbital and/or oscillatory and/or reciprocal cyclic motion at connection 237. Those who practice the art may, due at least in part to explanations provided herein, recognize the significance of the location, magnitude and timing and/or synchronization of the half-speed crankshaft relative to primary crankshaft 245 of embodiment 200. It may also be recognized that in order to locate the half-speed crankshaft desirably, idler gears, rod drives, and/or other rotative power transmission devices may be used and/or may be advantageously employed. The regular and/or irregular orbital and/or oscillatory and/or reciprocal cyclic motion of connection 237 may cycle at a rate of one half the rate of primary crankshaft 245. For example, connection 237 will go through one complete orbit and/or oscillation and/or reciprocal cycle for every two revolutions of primary crankshaft 245.

Continuing, half-speed cycling rod 230 may be pivotally connected to piston rod 225 at or near a distal end and/or may be rotatably connected to half-speed crankshaft 240 at an opposite end. Primary crankshaft 245 and all rotative power transmission devices used to connect, drive and/or time crankshafts 240 and 245 with each other may be mounted on parallel axes to be operatively engages for rotation, placement and timing to create at least in part asymmetrical reciprocation of the piston in an all-stroke-variable internal combustion engine, for example. Continuing, similar to embodiment 200 depicted at FIGS. 2A-2C that may change rotative motion to reciprocal, orbital and/or oscillational motion at half-speed cycling rod 230 and may use rotative power transmission devices to, at least in part, drive, locate and time, among other things, the half-speed crankshaft and half-speed cycling rod, embodiment 500 depicted at FIGS. 5A-5F may have half-speed crankshaft 535 located in relative proximity and in some instances may be directly connected by a gear train and/or some rotative power transmission device such that the half-speed crankshaft 532 rotates at one-half the speed of primary crankshaft 540 as example half-speed crankshaft 240 rotates at one-half the speed of primary crankshaft 245. As with example embodiment 200 depicted in FIGS. 2A-2C, the half-speed crankshaft 532 of embodiment 500 depicted in FIGS. 5A-5F may provide the function of translation or conversion of rotational motion of half-speed crankshaft 532 into reciprocal, orbital and/or oscillational motion at rod 530, for example.

In some circumstances and/or implementations, the reciprocal, orbital and/or oscillational motion of rod 530 may not meet the requirements of location and/or direction as half-speed crankshaft 532 may not be located for that purpose, for example. In some circumstances and/or implementations, half-speed crankshaft 532 may have been located for purposes such as low or reduced noise, vibration and/or harshness, cost and/or size, to name but a few examples. In particular implementations, the principle functions of half-speed crankshaft 532 may be to, at least in part, rotate at one half the speed of primary crankshaft 540 and provide for, at least in part, the means for the translation of rotative motion into reciprocal and/or orbital and/or oscillational motion of rod 530.

Continuing further with an example, rod 530 having reciprocal and/or orbital and/or oscillational motion may not have acceptable location direction and/or magnitude of said motion. So, for example, FIGS. 5A-5F illustrate additional lever(s) 525 and/or fulcrum(s) 555 that may translate motion of rod 530 into, at least in part, reciprocal, orbital and/or oscillational motion that may have the acceptable location, direction and magnitude. Thus, among examples shown and/or among variations not shown, the combination of half-speed crankshaft 532, rod 530, lever 525, fulcrum 555 provides for at least in part the desired reciprocal, orbital and/or oscillational motion of half-speed cycling rod 518. Example embodiment 200 illustrated in FIGS. 2A-2C may perform in a similar fashion with the use of half-speed crankshaft 240 driven by a half-speed drive from primary crankshaft 245 (various example drive mechanisms not shown for ease of explanation), wherein the half-speed crankshaft having been desirably and/or advantageously positioned with and/or for the use required by and/or for rotative power transmission devices. Also, by way of further explanation, advantageous, or even perhaps essential in at least some implementations, aspects of a drive mechanism between primary crankshafts 245 and/or 540 and half-speed cycling rod 230 and/or 518 may be as follows: provide rotational motion that rotates at one-half the speed of a primary crankshaft; provide, at least in part, timing and/or synchronization of the half-speed cycling rod relative to an angular position of a primary crankshaft; provide, at least in part, location of a half-speed cycling rod; provide, at least in part, magnitude of a half-speed cycling rod motion; provide, at least in part, direction of a half-speed cycling rod motion; and/or provide, at least in part, motion to the half-speed cycling rod of the effective type of reciprocal, orbital and/or oscillational motion, for example. The above listing may include some aspects, among other possible aspects, that may be utilized to create desirable and/or advantageous asymmetrical piston strokes of various implementations of all-stroke-variable internal combustion engines. It should be noted that those who practice the art may, based at least in part on disclosure contained herein, be able to devise numerous sundry example implementations of example embodiments disclosed herein. Possible variations of implementations in accordance with disclosed embodiments and/or in accordance with claimed subject matter may be too numerous to detail and/or list herein. The scope of claimed subject matter may include any and/or all variations of implementations based on example embodiments disclosed herein, including, for example, implementations incorporating one or more aspects listed above.

Figure 13A:
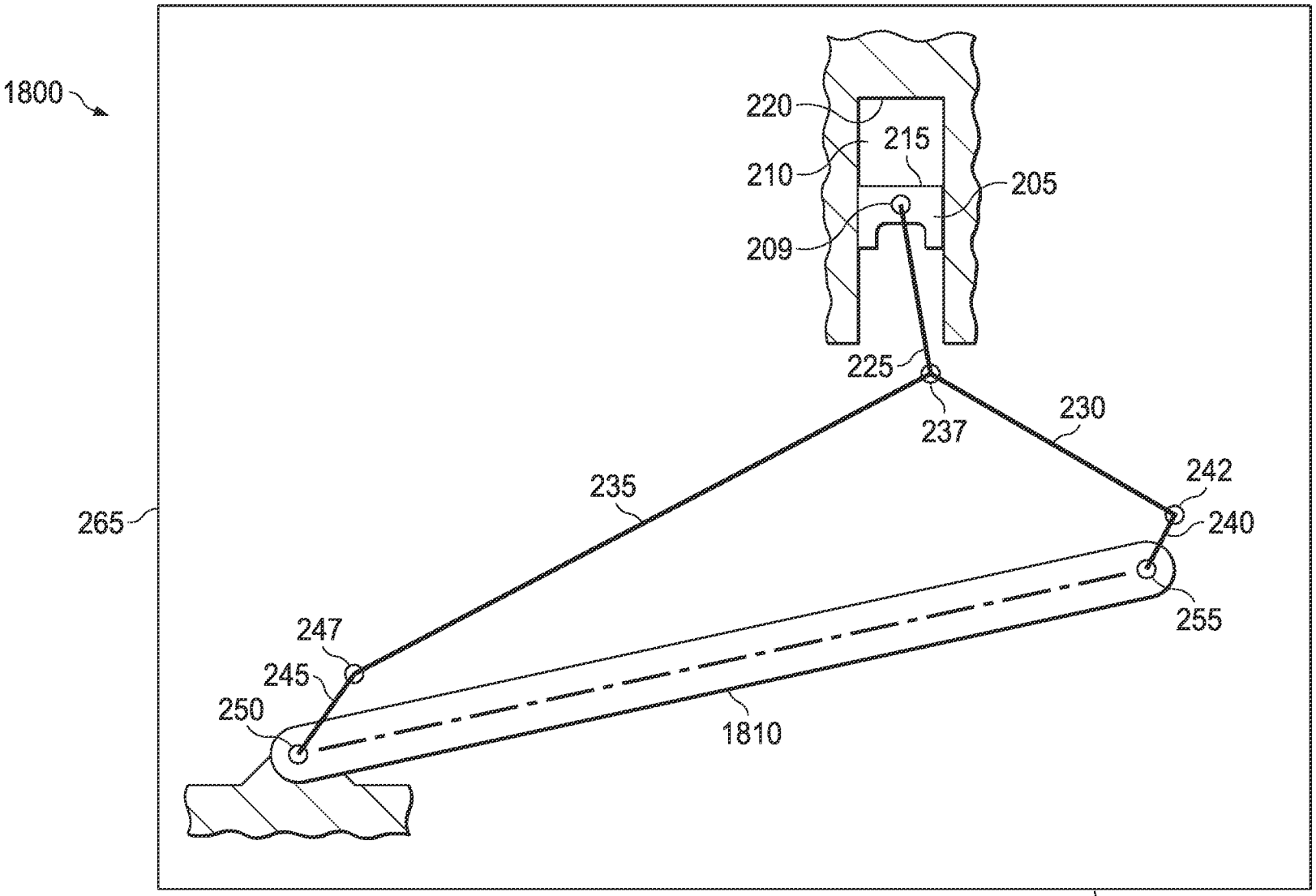
FIG. 13A depicts a schematic illustration of an all-stroke-variable internal combustion engine, in accordance with an embodiment.

As mentioned, and as may be seen in various figures, various drive mechanisms may operate between a primary crankshaft, such as primary crankshaft 245 of FIGS. 2A-2C and 13A-13B and/or primary crankshaft 540 of FIGS. 5A-5F, and a half-speed cycling rod, such as half-speed cycling rod 230 of FIGS. 2A-2C and 13A-13B and/or half-speed cycling rod 518 of FIGS. 5A-5F. For example, as seen in FIG. 13A (discussed in more detail below), mechanism 1810 and half-speed crankshaft 240 are coupled between primary crankshaft 245 and half-speed cycling rod 230. For this particular example, mechanism 1810 and half-speed crankshaft 240 may collectively be referred to as a "drive mechanism." Other example drive mechanisms coupled between a primary crankshaft and a half-speed cycling rod may be seen in FIGS. 2A-2C and FIGS. 5A-5F.

In particular implementations, drive mechanisms coupled between a primary crankshaft, such as primary crankshaft 245 and/or 540, and a half-speed cycling rod, such as half-speed cycling rod 230 and/or 518, may operate to drive a distal end (e.g., located at or near triple connection point 237 and/or 522) of the half-speed cycling rod to affect particular aspects of the distal end of the half-speed cycling rod. For example, such drive mechanisms may affect: (1) speed and/or frequency of a cycle of the distal end of the half-speed cycling rod cycle in relation to the primary crankshaft; (2) synchronization, coordination and/or timing of the distal end of the half-speed cycling rod cycle in relation to the primary crankshaft; (3) position of the distal end of the half-speed cycling rod cycle in relation to other features of an all-stroke-variable internal combustion engine; (4) direction of travel of the distal end of the half-speed cycling rod cycle in relation to other features of an all-stroke-variable internal combustion engine; and/or (5) magnitude of travel of the distal end of the half-speed cycling rod cycle in relation to other features of an all-stroke-variable internal combustion engine. The above-listed example effects realized at least in part via drive mechanisms coupled between a primary crankshaft, such as primary crankshaft 245 and/or 540, and a half-speed cycling rod, such as half-speed cycling rod 230 and/or 518, provide at least in part for the asymmetrical reciprocal motion of a piston of an all-stroke-variable internal combustion engine, in particular implementations.

Further, an end of a half-speed cycling rod, such as half-speed cycling rod 230 and/or 518, that is opposite the triple connection point, such as triple connection point 237 and/or 522, may be referred to as a proximal end of the half-speed cycling rod. In particular implementations, a proximal end of a half-speed cycling rod may be manipulated by various example drive mechanisms, such as those discussed above in reference to the distal end of the half-speed cycling rod. For example, as mentioned, mechanism 1810 and half-speed crankshaft 240 coupled between primary crankshaft 245 and half-speed cycling rod 230 as shown in FIG. 13A collectively comprise one such example drive mechanism. Example drive mechanisms may manipulate a proximal end of a half-speed cycling rod, such as half-speed cycling rod 230 and/or 518, to produce a motion of the proximal end of the half-speed cycling rod that may be circular, reciprocal, orbital and/or oscillatory with respect to a primary crankshaft, such as primary crankshaft 245 and/or 540. Further, for example, drive mechanisms may affect a frequency of a cycle of motion, a location of motion, a magnitude of motion, and/or a synchronization and/or coordination of motion of the proximal end of the half-speed cycling rod. Thus, in particular implementations, drive mechanisms such as those discussed above, for example, may provide at least in part relative magnitudes and/or locations of the four distinct strokes of a full cycle of an all-stroke-variable internal combustion engine.

By way of further explanation, as with example embodiment 200 depicted in FIGS. 2A-2C and/or with example embodiment 500 depicted in FIGS. 5A-5F, the half-speed drive mechanisms may translate rotative motion into reciprocal, orbital and/or oscillational motion at half-speed cycling rod 230 and/or 518, at least in part. Reciprocal motion of half-speed cycling rod 230 and/or half-speed cycling rod 518 may translate into an irregular reciprocal, orbital and/or oscillational motion at or near connection 237 and/or 522 and/or may cycle at a rate of one half the rate of primary crankshaft 245 and/or 540, respectively. Stated otherwise, for example, connection 237 and connection 522 may go through one complete cycle for every two revolutions of primary crankshaft 245 and primary crankshaft 540, respectively. Thus, various versions, embodiments, implementations, etc. may be utilized at least in part to create asymmetrical reciprocation of a piston as may be applied to an all-stroke-variable internal combustion engine.

Those who practice the art may recognize, based at least in part on disclosure provided herein, that half-speed crankshafts such as 240 and/or 532 may be utilized to mechanically drive various internal combustion engine components and/or features such as camshafts, such as camshafts 113*a*, 113*b*, etc., depicted in FIG. 1, for example. Also, various idlers of rotative power transmission devices may be sized and/or located to drive ancillary devices, such as water pumps, alternators, hydraulic pump and/or power take-offs, for example, at suitable speeds.

Continuing, there are two variations and/or implementations among essentially countless possible variations and/or implementations of example embodiments in accordance with claimed subject matter that may have mathematical relationships shown herein with respect to example embodiments 200 and/or 500. Those who practice the art will understand, based at least in part on disclosure provided herein, that variations and/or implementations that incorporate power transmission devices such as gear sectors, gear racks, slides, lost motion, bell-cranks, bevel gears with one or more drive shafts, multiple different combinations of levers and/or fulcrums, rods, etc., for example, not shown or discussed that may or may not include primary, secondary, tertiary, etc., systems that push, pull, rotate, alternate, pivot, revolve, turn, wheel, cycle, orbit, sequence, switch, rotate, etc., among other possibilities, may be utilized in an all-stroke-variable internal combustion engine. For example, all-stoke-variable internal combustion engines in accordance with claimed subject matter may include all of the example aspects described herein, fewer than the example aspects described herein, or more than the example aspects described herein without deviating from the scope of claimed subject matter.

As was indicated, to implement an all-stroke-variable internal combustion engine, such as illustrated in example embodiment 200, for example, various different distances and/or angles between components may be selected, such as to determine respective locations for an exhaust-intake TDC, an intake-compression BDC, a compression-expansion TDC, and/or an expansion-exhaust BDC so as to achieve a particular use of the internal combustion engine. For example, distances and/or angles between components may be selected to determine which distances and/or angles result in a more efficient and/or more effective operation of an all-stroke-variable internal combustion engine, such as for a given fuel, for example, as discussed below.

Thus, FIG. 2B schematically illustrates example measurements of various distances between components of an all-stroke-variable internal combustion engine of embodiment 200. In turn, FIG. 2C schematically illustrates example measurements of various angles between components of an all-stroke-variable internal combustion engine of embodiment 200. Various distances between components are denoted in FIG. 2B and/or angles are denoted in FIG. 2C. More specifically, for this example, H denotes a distance between a top of a cylinder bore and/or a horizontal reference plane 267, such as illustrated in a top right quadrant via an example cartesian coordinate system. Horizontal reference plane 267 and/or a vertical reference plane 265 are shown for illustrative and/or calculative purposes and/or are non-limiting examples, such that any other suitable reference planes, coordinates, etc. may be used herein, in whole or in part, for example. Thus, in some instances, horizontal reference plane 267 and/or a vertical reference plane 265 may, for example, be utilized, at least in part, to facilitate and/or support calculations so as to create a General Shape Graph, as discussed below with reference to FIG. 3. J denotes a distance between a top 215 of piston 205 at a given angle A and/or horizontal reference plane 267, where angle A may be measured from a vertical line through primary crankshaft 245 main bearing centerline clockwise to a line through a primary crankshaft 245 main bearing centerline and/or a primary crankshaft crank pin bearing 247 centerline. Angle A may comprise, for example, a measurement of an angular position of primary crankshaft 245. At times, angle A may, for example, be measured clockwise from zero when crankshaft crank pin 247 is directly above primary crankshaft main bearing 250 centerline. Angle A may also be measured from a vertical line through primary crankshaft main bearing 250 clockwise to a line through the primary crankshaft main bearing 250 centerline and/or primary crankshaft crank pin 247 centerline.

In an implementation, K1 denotes a distance between a location of primary crankshaft crank main bearing 250 centerline and/or a vertical reference plane 265 of a top right quadrant of an example cartesian coordinate system shown. Further, K2 denotes a distance between crankshaft pin 250 and/or horizontal reference plane 267. Values for K1 and/or K2 may, for example, be selected so as to be sufficiently large so that an entire all-stroke-variable mechanism is within a top right quadrant of a cartesian coordinate system, for example, during an entire four-stroke cycle. Such an implementation in which an entire all-stroke-variable mechanism is within a top right quadrant of a cartesian coordinate system may be utilized, for example, to avoid and/or reduce complications relating to sign (+ or −) changes as parts of the mechanism may enter and/or encroach onto one or more other quadrants of an example cartesian coordinate system shown, for example. Further, for this example, K3 denotes a distance between vertical reference plane 265 and/or a vertical line through half-speed crankshaft main bearing 255 centerline, K4 denotes a distance between half-speed crankshaft main bearing 255 centerline and/or horizontal reference plane 267, and/or K5 denotes a length of primary crankshaft 245. Additionally, K6 denotes a distance of a length of half-speed crankshaft 240 divided by a length of a throw for primary crankshaft 245. A length of a throw for half-speed crankshaft 240 may comprise, for example, a product of K5 and/or K6. Further, K7 denotes a length of primary crankshaft rod 235, K8 denotes a length of half-speed cycling rod 230, K9 denotes a length of piston rod 225, K10 denotes a distance between a piston pin 209 and/or a top 215 of piston 205, and/or K11 denotes a piston slap factor. "Piston slap," as used herein, refers to a rocking and/or knocking of a piston in a cylinder during reciprocal movements due, at least in part, to an excessive angle between bore 210 and/or piston rod 225. For example, piston slap may be caused by lateral and/or side-to-side movement of piston 205 within bore 210 of a cylinder so that a piston skirt slaps in bore 210 as piston 205 travels up and/or down within the cylinder. Piston slap may, for example, occur if angle E of FIG. 2C is such that significant side loads of piston 205 are created by pressure of combustion, for example.

Continuing with FIG. 2B and/or FIG. 2C, in an implementation, KP denotes a distance between vertical reference plane 265 and/or a centerline of pin 209, P denotes a distance from a vertical centerline of connection 237 and/or a vertical reference plane 265 of a four-stroke cycle mechanism, $P_{MX}$ denotes a maximum distance between a vertical centerline of connection 237 and/or vertical reference plane 265, $P_{MN}$ denotes a minimum distance between a vertical centerline of connection 237 and/or vertical reference plane 265, and/or R denotes a distance between primary crankshaft crank pin 247 and/or half-speed crankshaft crankpin 242 of primary crankshaft 245 and/or half-speed crankshaft 240, respectively. In an embodiment, a designer may verify that $P_{MX}$ and/or $P_{MN}$ are part of an expansion stroke by graphing P, for example. For example, those who practice the art may graph P over one complete cycle (e.g., 720 degrees of revolution of primary crankshaft 245) of an all-stroke-variable engine configuration under examination. Such a graph of P may appear to be somewhat similar to a general shape depicted, for example, in FIG. 3. More precisely, there may be two high points (e.g., $P_{MX}$) and two low points (e.g., $P_{MN}$) of P for an individual cycle. $P_{MX}$ and $P_{MN}$ utilized to establish parameter KP may represent high and low points, respectively, of a curve that may be favorably suited to reduce and/or minimize side loads on a piston and/or to reduce and/or minimize power consumption during an expansion stroke and/or during all four strokes of a cycle. Further discussion follows below in connection with FIG. 4.

As also illustrated in FIG. 2C, angle B may comprise an angle between primary crankshaft rod 235 (also denoted as K7) and/or a line extending from primary crankshaft 245 through primary crankshaft main bearing 250 centerline and/or primary crankshaft crank pin 247 and/or which is parallel to primary crankshaft 245, for example. Angle C may comprise an angle between primary crankshaft rod 235 and/or line R. Angle D may comprise an angle between line R and/or a horizontal line through primary crankshaft crank pin 247. Angle E may indicate an obtuse angle between piston rod 225 and/or a vertical line through connection 237. A half-speed crankshaft offset angle, KF, may be measured clockwise from a vertical line through half-speed crankshaft main bearing 255 centerline to a line through half-speed crankshaft crankpin 242 at a beginning of a cycle where Angle A equals 0 degrees, for example.

As was indicated, various mathematical relations may be utilized, in whole and/or in part, to calculate one or more lengths/distances and/or angles, such as those illustrated in FIGS. 2B and/or 2C, for example. Thus, various computations and/or determinations may be performed, for example, to arrive at one or more suitable lengths/distances and/or angles, which may result in an all-stroke-variable internal combustion engine exhibiting an improved and/or otherwise suitable engine performance.

Thus, Relation 1 in conjunction with example embodiment 200 of FIGS. 2A-C may, for example, be utilized, in whole and/or in part, to determine a value of KP:

$$KP=(P_{MX}-P_{MN})(K11)+(P_{MN}) \quad \text{[Relation 1]}$$

In a particular example embodiment, with respect to FIGS. 2A-C, half-speed crankshaft 240 and/or primary crankshaft 245 may each rotate in a clockwise direction, and/or various relationships between distances and/or lengths and/or angles of components may be considered to identify and/or determine one or more applicable aspects. For example, here, an exhaust-intake TDC, an intake-compression BDC, a compression-expansion TDC, and/or an expansion-exhaust BDC may be identified and/or determined, so as to achieve a particular use of an all-stroke-variable internal combustion engine, as discussed above. It should be appreciated that relative directions of rotation of crankshafts other than clockwise may involve appropriate changes to relations as discussed below, for example.

In an implementation, half-speed crankshaft offset angle (KF) as shown in FIG. 2C may, for example, be measured clockwise from a vertical line through half-speed crankshaft main bearing centerline to a line through half-speed crankshaft main bearing 255 centerline and/or half-speed crankshaft crank pin 242 centerline. Angle KF may, for example, be measured at the start of a cycle (e.g., where angle A=zero degrees). In certain simulations, to identify a better and/or best and/or otherwise suitable measurement of angle KF for a particular set of lengths and/or positions K1 through K11, approximately ninety evaluations were performed, e.g., one evaluation for every four degrees, e.g., where angle KF equals 0, 4, 8, 12, 16, . . . , 360 degrees. Here, slap factor K11 may, for example, be chosen to reduce and/or minimize a side load on piston 205 in order to minimize piston slap and/or power loss caused by friction, for example. Further, as indicated above, distance P may be graphed against angle A and/or against other variables and/or factors such as cylinder combustion pressure, for example, such as to determine a desirable and/or suitable value of K11.

For example embodiment 200, Relation 2 may, for example, be utilized, in whole and/or in part, to calculate a location of a top, denoted as "J", of piston 205 relative to an angular position of primary crankshaft 245:

$$J=(K2)+(K5)\mathrm{Cos}(A)+(K7)\mathrm{Sin}(C+D)+(K9)\mathrm{Cos}(E)+(K10) \quad \text{[Relation 2]}$$

In some instances, Relation 2 may be determined based, at least in part, on Relations 3-10 as discussed below for example embodiment 200 of FIGS. 2A-C, for example. Relations 3-10 may be determined based on various geometric and/or arithmetic properties of shapes, such as triangles, in one or more example embodiments. Relations 3-10 may be utilized to determine suitable measurements of various features of example embodiment 200 so as, for example, to identity certain features of an all-stroke-variable internal combustion engine which have desired and/or improved performance characteristics. At times, Relation 3 may, for example, be employed, in whole and/or in part, to determine a value of $R^2$. Thus, consider:

$$R^2=[(K3)+(K5)(K6)\mathrm{Sin}(KF+0.5A)-[(K1)+(K5)\mathrm{Sin}(A)]]^2+[(K4)+(K5)(K6)\mathrm{Cos}(KF+0.5A)-[(K2)+(K5)\mathrm{Cos}(A)]]^2 \quad \text{[Relation 3]}$$

Having computed a square root of each side of the equation shown in Relation 3, a value for R may, for example, be calculated, as shown below in Relation 4.

$$R=[[(K3)+(K5)(K6)\mathrm{Sin}(KF+0.5A)-[(K1)+(K5)\mathrm{Sin}(A)]]^2+[(K4)+(K5)(K6)\mathrm{Cos}(KF+0.5A)-[(K2)+(K5)\mathrm{Cos}(A)]]^2]^{0.5} \quad \text{[Relation 4]}$$

A value for angle D may be determined via calculation of Relations 5 and/or 6 as shown below. Relation 5 may be calculated to determine a value of a sine of angle D. Relation 6 may be calculated to determine an angle of D by determining the inverse sine value of the value of the sine of angle D.

$$\mathrm{Sin}(D)=\frac{\left[\begin{array}{c}(K4)+(K5)(K6)\mathrm{Cos}(KF+0.5A)-\\ [(K2)+(K5)\mathrm{Cos}(A)]\end{array}\right]}{R} \quad \text{[Relation 5]}$$

-continued $$D = \mathrm{Sin}^{-1}\left[\frac{[(K4) + (K5)(K6)\mathrm{Cos}(KF + 0.5A) - [(K2) + (K5)\mathrm{Cos}(A)]}{R}\right] \quad \text{[Relation 6]}$$

At times, a value for angle C may, for example, be determined via calculation of Relations 7 and/or 8 as shown below. Relation 7 may be calculated to determine a value of a cosine of angle C. Relation 8 may be calculated to determine an angle of C by determining the inverse cosine value of the value of the cosine of angle C. Thus, consider, for example:

$$\mathrm{Cos}(C) = \frac{[(K7)^2 + R^2 - (K8)^2]}{[2(K7)(R)]} \quad \text{[Relation 7]}$$

$$C = \mathrm{Cos}^{-1}\left[\frac{[(K7)^2 + R^2 - (K8)^2]}{[2(K7)(R)]}\right] \quad \text{[Relation 8]}$$

In an implementation, a value for distance P may, for example, be determined via calculation of Relation 9 as shown below.

$$P=(K1)+(K5)\mathrm{Sin}(A)+(K7)\mathrm{Cos}(D+C) \quad \text{[Relation 9]}$$

A value for angle E may be determined via calculations of Relations 10 and/or 11 as shown below.

$$\mathrm{Sin}(E) = \frac{[(KP) - (P)]}{K9} \quad \text{[Relation 10]}$$

$$E = \mathrm{Sin}^{-1}\left[\frac{[(KP) - (P)]}{K9}\right] \quad \text{[Relation 11]}$$

Figure 3:
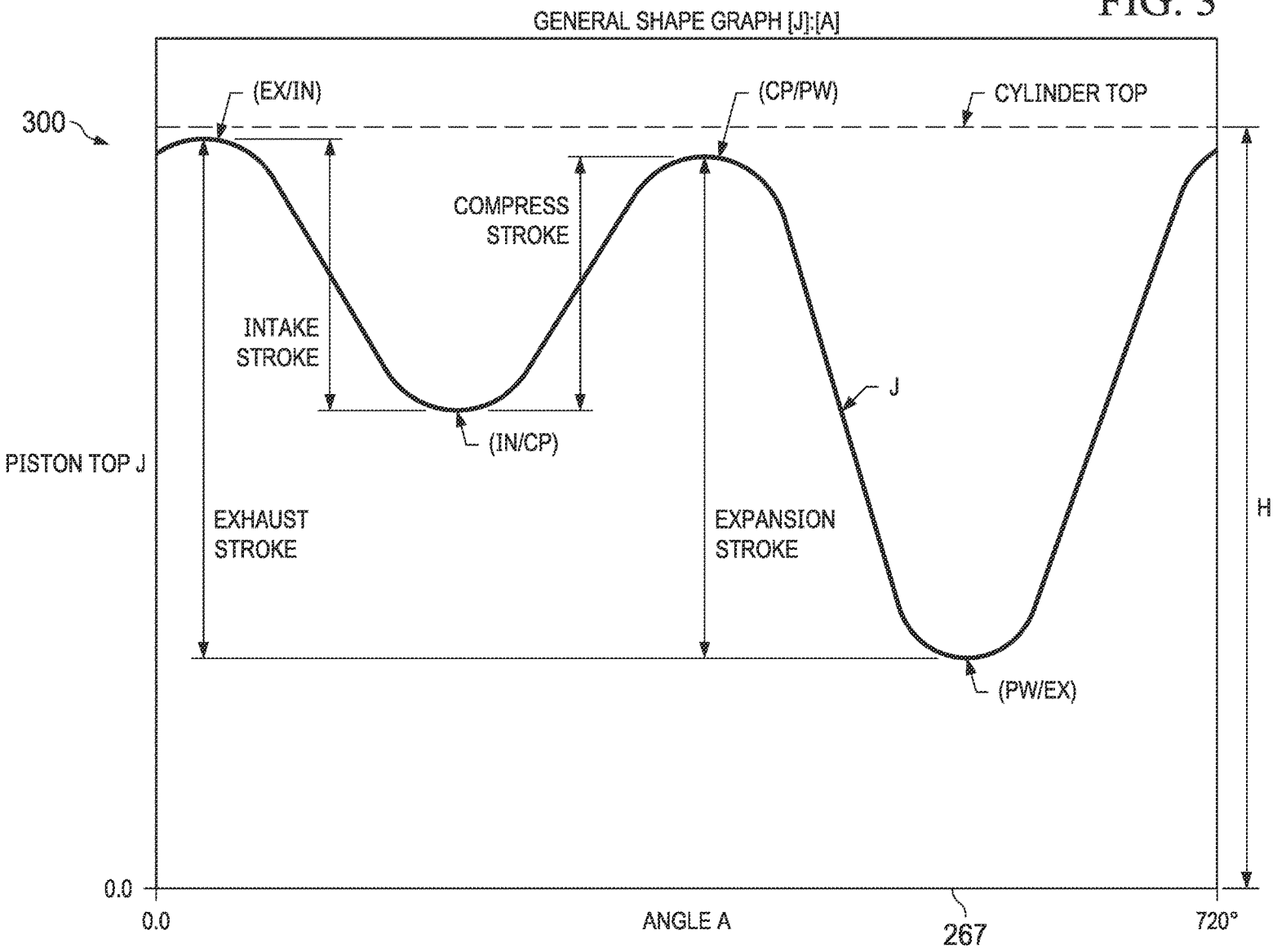
FIG. 3 depicts an illustration of an example general shape graph, in accordance with an embodiment.

FIG. 3 is an example General Shape Graph 300 according to an example embodiment. General Shape Graph 300 illustrates a relationship between a location of a top of a piston and/or angle A, such as with respect to example embodiment 200 of FIGS. 2A-C through each stroke of operation of an all-stroke-variable internal combustion engine. In some instances, General Shape Graph 300 may, for example, be generated by rotating primary crankshaft 245 of example embodiment 200 through two complete revolutions to plot a locus of points of a top of piston 205, denoted via J, with respect to a measurement of angle A. More specifically, angle A may vary from zero degrees to 720 degrees and/or zero radians to 4π radians to complete one cycle of an all-stroke-variable internal combustion engine. It should be noted that General Shape Graph is illustrated as an example, although it should be appreciated that by changing one or more parameters, a shape and/or slope of General Shape Graph may be altered in some manner, for example. The following relations may be used to examine and/or compare resulting graphs, such as to assess performance of an all-stroke-variable internal combustion engine, for example.

Thus, a value of Exhaust/Intake (Ex/In) may, for example, be utilized, in whole and/or in part, to locate an exhaust-intake TDC. In addition, a value of Intake/Compression (In/Cp) may, for example, be utilized, in whole and/or in part, to locate an intake-compression BDC. Further, a value of Compression/Expansion (Cp/Pw) may be utilized, in whole and/or in part, to locate a compression-expansion TDC. A value of Expansion/Exhaust (Pw/Ex) may be utilized, in whole and/or in part, to locate an expansion-exhaust BDC. A value of length H may be utilized, in whole and/or in part, to locate a top of a cylinder bore. A value of length J may be utilized, in whole and/or in part, to locate a top of a piston at a given angle A. A value of angle A may be utilized, in whole and/or in part, to locate an angular position of a primary crankshaft measured clockwise from vertical being equal to zero. A value of angle KF may be utilized, in whole and/or in part, to locate an angular position of a half-speed crankshaft measured clockwise from vertical being equal to zero when angle A has a value of approximately zero degrees and/or a machine is at a beginning of a four-stroke cycle, for example.

In an implementation, respective values of an Intake Stroke, Intake Ratio, Compression Stroke, Compression Ratio and/or KCR, Expansion Stroke, Expansion Ratio, Exhaust Stroke, and/or Exhaust Ratio, and/or a distance H may, for example, be determined based, at least in part, on relations 12-20 shown below. Thus, consider:

$$\text{Intake Stroke} = \left(\frac{Ex}{In}\right) - \left(\frac{In}{Cp}\right) \quad \text{[Relation 12]}$$

$$\text{Intake ratio} = \frac{\text{Intake Stroke}}{H - \left(\frac{Ex}{In}\right)} \quad \text{[Relation 13]}$$

$$\text{Compression Stroke} = \left(\frac{Cp}{Pw}\right) - \left(\frac{In}{Cp}\right) \quad \text{[Relation 14]}$$

$$KCR = \frac{\text{Compression Stroke}}{H - \left(\frac{Cp}{Pw}\right)} \quad \text{[Relation 15]}$$

$$\text{Expansion Stroke} = \left(\frac{Cp}{Pw}\right) - \left(\frac{Pw}{Ex}\right) \quad \text{[Relation 16]}$$

$$\text{Expansion Ratio} = \frac{\text{Expansion Stroke}}{H - \left(\frac{Cp}{Pw}\right)} \quad \text{[Relation 17]}$$

$$\text{Exhaust Stroke} = \left(\frac{Ex}{In}\right) - \left(\frac{Pw}{Ex}\right) \quad \text{[Relation 18]}$$

$$\text{Exhaust Ratio} = \frac{Exaust\ \text{Stroke}}{H - \left(\frac{Ex}{In}\right)} \quad \text{[Relation 19]}$$

$$H = \frac{\text{Compression stroke}}{\text{Compression ratio}} + \left(\frac{Cp}{Pw}\right) \quad \text{[Relation 20]}$$

If applicable and/or appropriate, a value for H may, for example, be recalculated, such as using one or more similar calculations from different all-stroke-variable implementations, such as in a similar manner. For example, it should be noted, that, in some instances, a single linkage length and/or position change and/or angle change other than angle A may involve recalculation of a value of H.

In an implementation, Relations 12-20 may, for example, utilize a single number to denote a compression ratio (KCR). For example, an all-stroke-variable internal combustion engine with 10.2 to 1 compression ratio may therefore have a compression ratio (KCR) of 10.2 in Relations 15 and/or 20 as shown above. Claimed subject matter is not so limited, of course.

At times, angle A may comprise, for example, a measurement of an angular position of a primary crankshaft. In at least one implementation, angle A may, for example, be measured clockwise from zero when a crankpin is directly above a main bearing of an internal combustion engine.

Further, angle KF may comprise, for example, an angular position of a half-speed crankshaft. In at least one implementation, angle KF may, for example, be measured from a vertical line through a main bearing centerline of a half-speed crankshaft, clockwise to a line through a crank pin centerline and/or a main bearing centerline of the half-speed crankshaft. Angle KF may comprise a measurement when angle A is zero at a start of a cycle. Angle KF may be referred to here as a "half-speed crankshaft offset angle." As discussed previously above, piston slap factor K11 may be selected and/or chosen to reduce and/or minimize a side load on piston 205, e.g., in order to minimize piston slap and/or power loss caused by friction during reciprocal movements of piston 205, for example.

In an implementation, similar locations for a locus of points may be applied to Relations 12-20 and/or results may be evaluated, such as in a similar manner. For example, a suitable number of graphs may include about ninety graphs so as to present a visual demonstration of an effect of about ninety different half-speed crankshaft offset angles (KF) (e.g., one graph for every four degrees) of a half-speed crankshaft from a primary crankshaft at a start of a cycle. Likewise, a number of evaluations may be performed on different variations of example embodiment 200 as shown in FIGS. 2A-C, for example. Resulting graphs may be analyzed, for example, to identify a number of desired and/or suitable implementations capable of producing one or more desirable expansion stroke ratios, exhaust stroke ratios, and/or intake stroke ratios. In one particular example embodiment, a compression ratio may be stipulated to remain constant for a particular evaluation, for example.

Accordingly, Relations 12-20 may, for example, be used, in whole and/or in part, to generate a graph similar to that of General Shape Graph of FIG. 3 so as to determine a position of a top of a cylinder of an all-stroke-variable internal combustion engine during each of four strokes of a complete operational cycle. In some instances, such as if appropriate, one or more Graphs for evaluations which show a top of a piston which is above a top of a cylinder of an internal combustion engine at any part of a cycle may be disregarded from consideration. In an example embodiment, a location of a top of a cylinder may, for example, be established after a graph has been evaluated and/or is fixed, such as once a compression stroke is identified, while a compression ratio is stipulated as having a fixed value, as was indicated.

Figure 4:
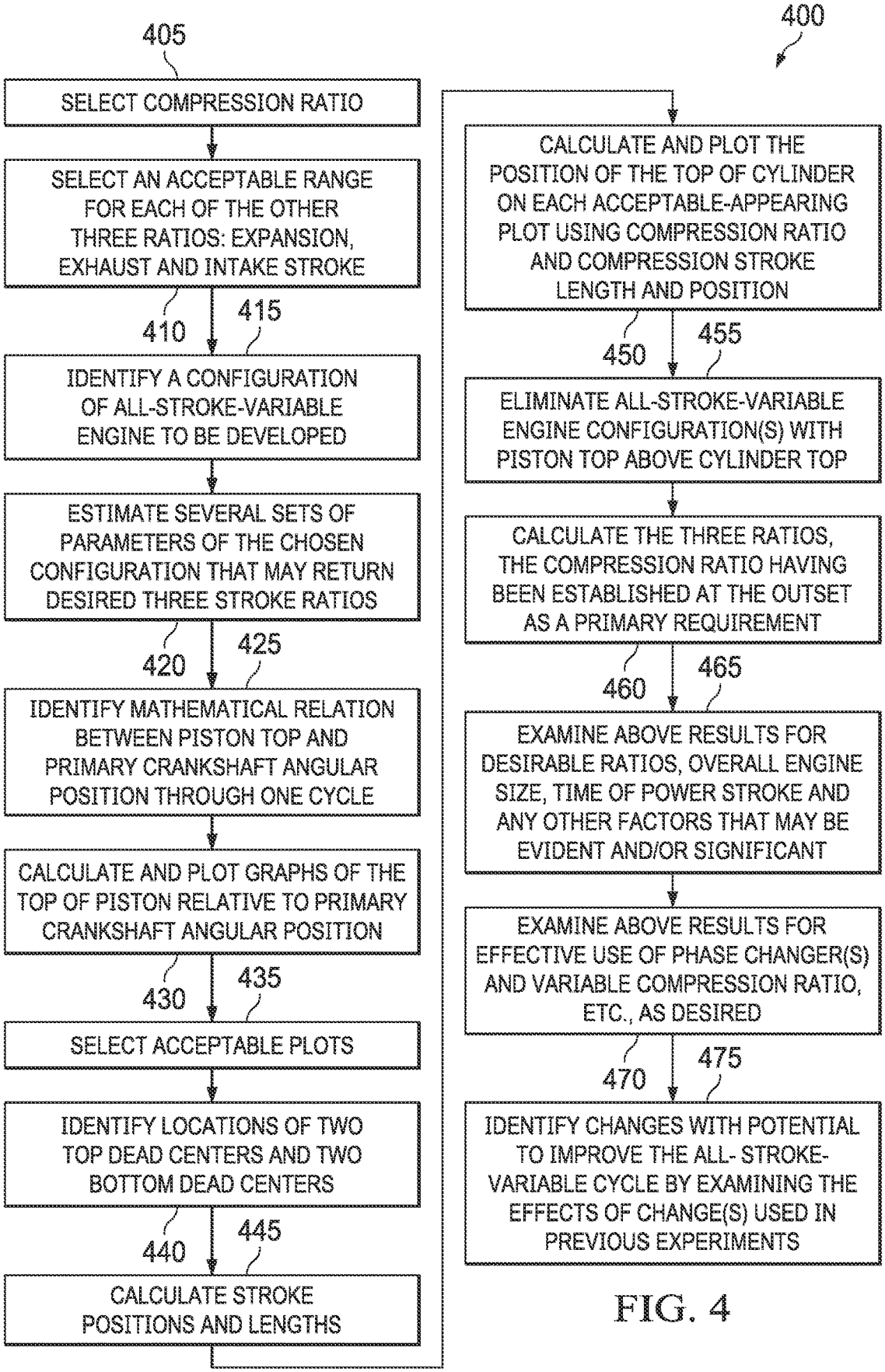
FIG. 4 depicts a schematic diagram of an example process for determining parameters of an all-stroke-variable internal combustion engine, in accordance with an embodiment.

Thus, FIG. 4 is an example embodiment 400 of a method and/or process for determining one or more suitable parameters of an all-stroke-variable internal combustion engine, such as discussed herein. Embodiments in accordance with claimed subject matter may include all of, less than, and/or more than blocks 405-475. Also, an order of blocks 405-475 is merely an example order. As was indicated, a method in accordance with example embodiment 400 may, for example, be implemented, at least in part, to identify and/or determine a particular set of strokes as well as TDCs and/or BDCs of an all-stroke-variable internal combustion engine. Example method and/or process 400 may begin at operation 405, at which a compression ratio may be selected and/or specified. At operation 410, acceptable ranges for sets of parameters for expansion ratio, exhaust ratio, and/or intake ratio may be selected and/or specified. At operation 415, a configuration for an all-stroke-variable engine to be developed may be identified. For example, as described herein, possible configurations may include those depicted and/or described in connection with FIGS. 2A-2C and/or 5A-5F. As described herein, particular implementations of an all-stroke-variable combustion engine may include various configurations of mechanisms and/or linkages to link a reciprocating piston with a primary crankshaft, such as primary crankshaft 245, and/or a half-speed crankshaft, such as half-speed crankshaft 240. As also described herein, particular implementations may include various alterations and/or adjustments to mechanisms and/or linkages such that four distinct strokes (e.g., intake, compression, expansion, exhaust) of an engine, such as embodiment 200, may be independently variable, for example.

At operation 420, estimates may be made for sets of parameters for a selected all-stroke-variable internal combustion engine configuration, such as may be selected at operation 415. For example, estimates may be made for sets of parameters for a selected all-stroke-variable internal combustion engine configuration that may yield a specified expansion ratio, exhaust ratio, and/or intake ratio. As mentioned previously, to identify a better and/or best and/or otherwise suitable measurement of angle KF for a particular set of lengths and/or positions K1 through K11, for example, approximately ninety evaluations may be performed, e.g., one evaluation for every four degrees, e.g., where angle KF equals 0, 4, 8, 12, 16, . . . , 360 degrees. To estimate permutations across a number of the possible variables for various potential configurations for an engine, such as embodiment 200, a relatively very large number of evaluations may be performed. In particular implementations, software tools and/or filters may be employed to help identify potential configurations for further consideration, for example. Example mathematical relations for example embodiments 200 and/or 500 are described herein. For other variations and/or configurations of an all-stroke-variable combustion engine, analogous relations may be generated and/or otherwise specified. At operation 425, one or more mathematical relations between piston top and/or primary crankshaft angular position through two revolutions may be identified, for example. At operation 430, graphs of the top of the piston relative to main crankshaft angular position may be calculated and/or plotted.

At operation 435, one or more acceptable plots and/or graphs may be selected from results of evaluations discussed above so as to identify parameters of a particular all-stroke-variable internal combustion engine configuration, for example. In particular implementations, operations 430 and/or 435 may be combined with other operations, such as operation 420, for example. Also, in particular implementations, whether to combine operations 430 and/or 435 with other operations may depend, at least in part, on capabilities of software tools that may be utilized to execute a method and/or process for determining suitable parameters for of an all-stroke-variable internal combustion engine.

At operation 440, locations of each of two TDCs and/or two BDCs may be identified on each plot and/or graph, as also discussed and/or illustrated above. At operation 445, stroke positions and/or lengths may be calculated based, at least in part, on calculations performed via use of Relations 12-20, as also discussed above. At operation 450, a location of a top of an engine cylinder may, for example, be calculated and/or otherwise identified based, at least in part, on a calculation performed via use of at least Relation 20, as discussed above. At operation 455, all and/or most suitable all-stroke-variable internal combustion engine configurations which indicate that a top of a piston is above a top of an engine cylinder at any point in a cycle may be eliminated and/or removed from consideration. At operation 460, expansion stroke ratios, exhaust stroke ratios, and/or intake stroke ratios may, for example, be determined based, at least in part, on calculations performed via use of Relations 13, 17, and/or 19, as discussed above. At operation 475, adjustments may be made to various parameters to determine and/or identify an acceptable and/or suitable all-stroke-variable internal combustion engine configuration, for example. Of course, in particular implementations, one or more of operations 405-475 may be repeated one or more times until suitable parameters of an all-stroke-variable internal combustion engine are determined and/or otherwise specified for applicable parameters. In particular implementations, one or more of operations 405-475 may be repeated in various combinations to experiment with additional sets of parameters in an effort to discover and/or otherwise determine improved configurations of all-stroke-variable combustion engines, and/or to refine specified configurations. Also, as mentioned, software tools may be implemented to perform any and/or all of operations 405-475 in particular implementations. Software tools may be utilized to experiment with various configurations and/or parameters and/or to analyze characteristics of specified all-stroke-variable internal combustion engines including, but not limited to, piston acceleration, piston speed, and/or time duration of an expansion stroke, for example.

Example operations, such as those discussed above in connection with embodiment 400, may help identify potential effects on all-stroke-variable internal combustion engine performance characteristics resulting from variations to lengths and/or positions of particular linkage mechanisms for specified all-stroke-variable internal combustion engine configurations. In example embodiments, such as embodiment 200, varying lengths and/or positions of particular linkage mechanisms may yield varying measures of impact to all-stroke-variable internal combustion engine performance characteristics. For example, varying a length of linkage 235, such as in accordance with one or more operations of embodiment 400, may have a relatively significant impact on performance characteristics. Varying lengths of linkages 230 and/or 240 may also have a relatively significant impact on all-stroke-variable internal combustion engine performance, whereas varying a length and/or position of linkage 225 may have a relatively reduced impact, for example. Further, for example, varying distances K3, K4 and/or K11 in accordance with one or more operations of embodiment 400, for example, may yield relatively significant effects on performance characteristics. Additionally, as previously mentioned, distance parameters for K1 and/or K2 may, for example, be selected so as to be sufficiently large so that an entire all-stroke-variable mechanism is within a top right quadrant of a cartesian coordinate system, for example, during an entire four-stroke cycle. During example operations, such as those discussed above in connection with embodiment 400, a length and/or position of linkage 245 (K5) may be designated as a "unit" length for a particular configuration of an all-stroke-variable internal combustion engine. In an embodiment, an all-stroke-variable internal combustion engine configuration may be resized at least in part by varying a unit length (e.g., length of linkage mechanism 245) to a desired parameter.

Continuing with the above discussion, a number of all-stroke-variable internal combustion engine configurations having acceptable and/or suitable stroke ratios may, for example, be identified after performing evaluations and/or analyzing plots and/or graphs of results, such as via implementation of a method in accordance with example embodiment 400. A particular proposed all-stroke-variable internal combustion engine configuration may be further examined for refinement including but not limited to parameters such as piston slap, piston speed, piston acceleration, and/or piston jerk, bounce, crackle, and/or pop, for example.

Thus, with respect to a piston slap, an evaluation, such as via software tool (e.g., spreadsheet application), as one possible example, may be made regarding a locus of points of a connection of a piston rod, primary crankshaft rod, and/or half-speed cycling rod to determine a side load applied to a piston as it reciprocates. Additionally, a plot and/or graph of angle E and/or the sine of angle E with combustion pressure and/or piston position such as one similar to the General Shape Graph one shown in FIG. 3, for example, may be generated so as to identify a configuration with a minimal piston side load and/or power consumption, for example.

More specifically, a first derivative of a graph of piston location relative to angle A of a primary crankshaft relative to vertical, such as in accordance with FIG. 3, may be utilized, in whole and/or in part, to identify a piston speed. For example, a piston speed and/or a duration of one or more strokes may be evaluated using information from a first derivative plot of a graph of piston location relative to angle A. A second derivative of a graph of piston location relative to angle A may, for example, be utilized, in whole and/or in part, to determine a piston acceleration. A second derivative graph may, for example, be used, in whole and/or in part, to evaluate vibration from acceleration of a reciprocating mass. Subsequent derivatives of a graph of piston location relative to angle A may, for example, be utilized, in whole and/or in part, to determine jerk, bounce, crackle, and/or pop, as these parameters are also generally known and/or need not be described herein in greater detail.

Figure 5A:
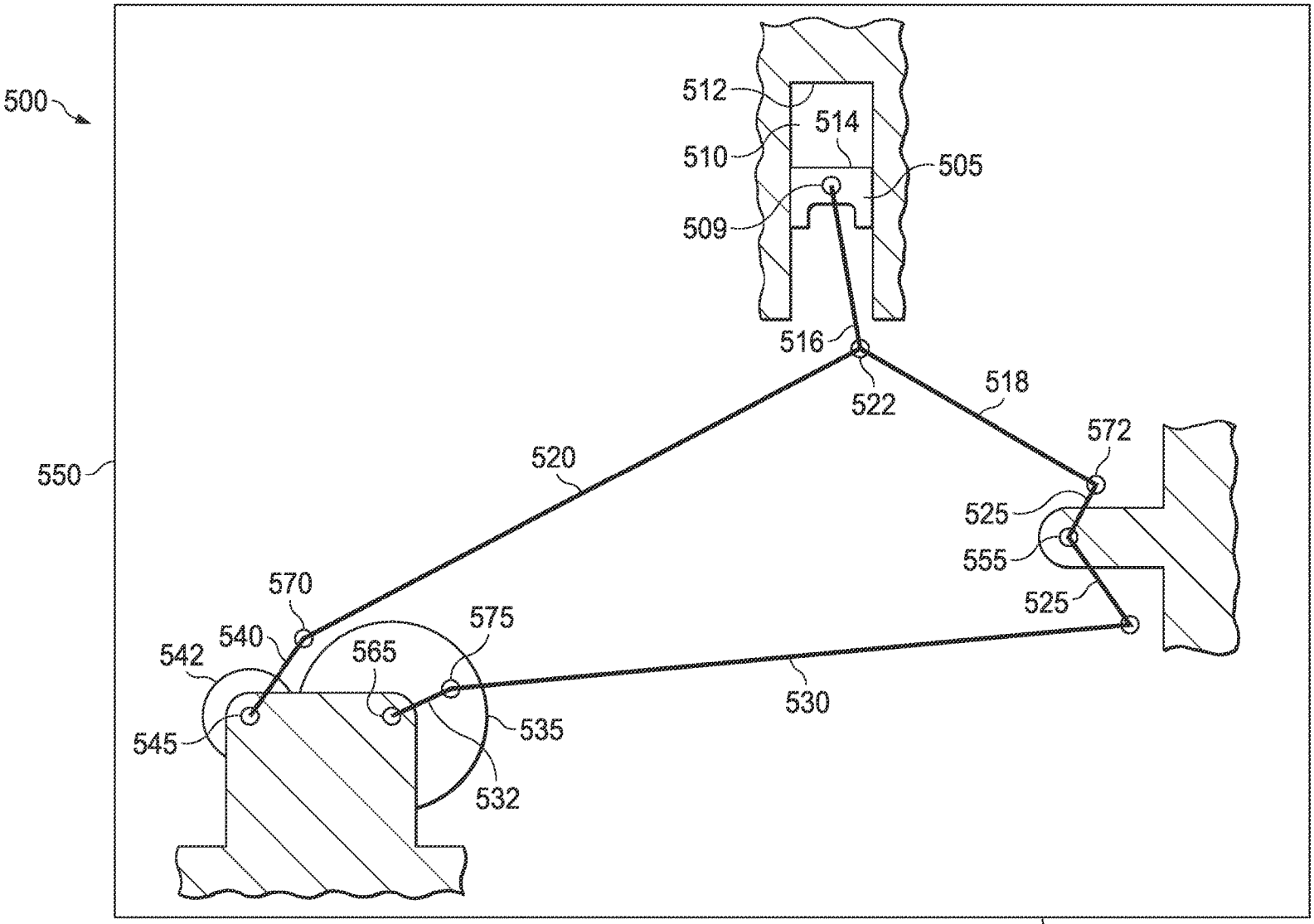
FIG. 5A depicts a schematic illustration of an all-stroke-variable internal combustion engine, in accordance with an embodiment.

FIG. 5A schematically illustrates another example embodiment 500 of an all-stroke-variable internal combustion engine. Similarly, in FIG. 5A, various portions of an engine are shown in crosshatch. Embodiment 500 may include pivotal and/or rotatable connections between components, such as in nine places, for this particular example.

As illustrated, embodiment 500 may include a piston 505, for example, which may move in a reciprocating manner within a bore 510. Bore 510 may include a bore top 512. Piston 505 may include a piston top 514. A piston rod 516 may movably couple piston 505 to a half-speed cycling rod 518 and/or a primary crankshaft rod 520. For example, piston rod 516 may be movably coupled to half-speed cycling rod 518 and/or to primary crankshaft rod 520 at connection 522. Half-speed cycling rod 518 may, for example, be coupled via an actuator lever 525 to a half-speed crankshaft actuator rod 530. Half-speed crankshaft actuator rod 530 may be movably coupled to a half-speed crankshaft 532 of a half-speed crankshaft gear 535. Primary crankshaft rod 520 may be movably coupled to a primary crankshaft 540 at connection 570. Primary crankshaft 540 may also be mechanically fixed to a primary crankshaft gear 542, for example. Primary crankshaft 540 and/or primary crankshaft gear 542, as a fixed assembly, may be moveably coupled to an engine block and/or other suitable mechanism, for example, such as at primary crankshaft main bearing 545.

Thus, in some instances, embodiment 500 may relate to an internal combustion engine having a piston 505 reciprocating in a bore 510, for example, and/or which is pivotally connected to piston rod 516. In turn, piston rod 516 may be pivotally connected to an end of a primary crankshaft rod 520, for example, and/or to one end of a half-speed cycling rod 518. The other end of primary crankshaft rod 520, for example, may be rotatably connected to primary crankshaft crankpin 570. Primary crankshaft 540 may include, and/or have affixed thereto, a power transmission and/or like device, such as primary crankshaft gear 542, for example. As with example embodiment 200, example embodiment 500 may include a half-speed crankshaft. For example, half-speed crankshaft 532 may include, and/or have affixed thereto, a power transmission and/or like device, such as a half-speed crankshaft gear 535. Primary crankshaft 540 and/or half-speed crankshaft 532 may be located in relatively close proximity and, in some instances, may be directly connected and/or connected by a gear train and/or some other power transmission and/or like device, such that half-speed crankshaft 532 rotates at one half the speed of primary crankshaft 540. Depending on an implementation, half-speed crankshaft 532 and/or primary crankshaft 540 may have the same and/or opposite direction of rotation. Half-speed crankshaft 532 may be rotatably coupled and/or connected to one end of half-speed crankshaft actuator rod 530 that may be utilized, at least in part, to span a distance to one or more levers and/or rods that may give half-speed cycling rod 518 the desired location and/or motion, for example. The other end of half-speed crankshaft actuator rod 530 may be pivotally connected to an actuator lever 525. Actuator lever 525 may be pivotally connected at an opposing end to half-speed cycling rod 518, such as at connection 572, for example. A fulcrum of actuator lever 525 may be pivotally and/or rotatably connected to an engine and/or a suitable part thereof, such as at actuator fulcrum 555, for example. Fulcrum 555, in conjunction with various levers, rods and/or half-speed crankshaft 532, for example, may function to locate and/or manipulate half-speed cycling rod 518 in a manner similar to and/or for a similar function as described above in connection with half-speed cycling rod 230 of example embodiment 200, discussed above. Actuator lever 525 may comprise, for example, a bell crank in example embodiment 500. In at least one implementation, half-speed crankshaft 532, primary crankshaft 540, and/or actuator lever 525 may operate on parallel axes. Half-speed crankshaft 532 may, for example, be used, at least in part, to drive camshafts and/or ancillary devices, such as described, for example, in connection with embodiment 200. Half-speed crankshaft actuator rod 530 may, for example, be movably coupled to half-speed crankshaft, such as at connection 575.

Figure 5B:
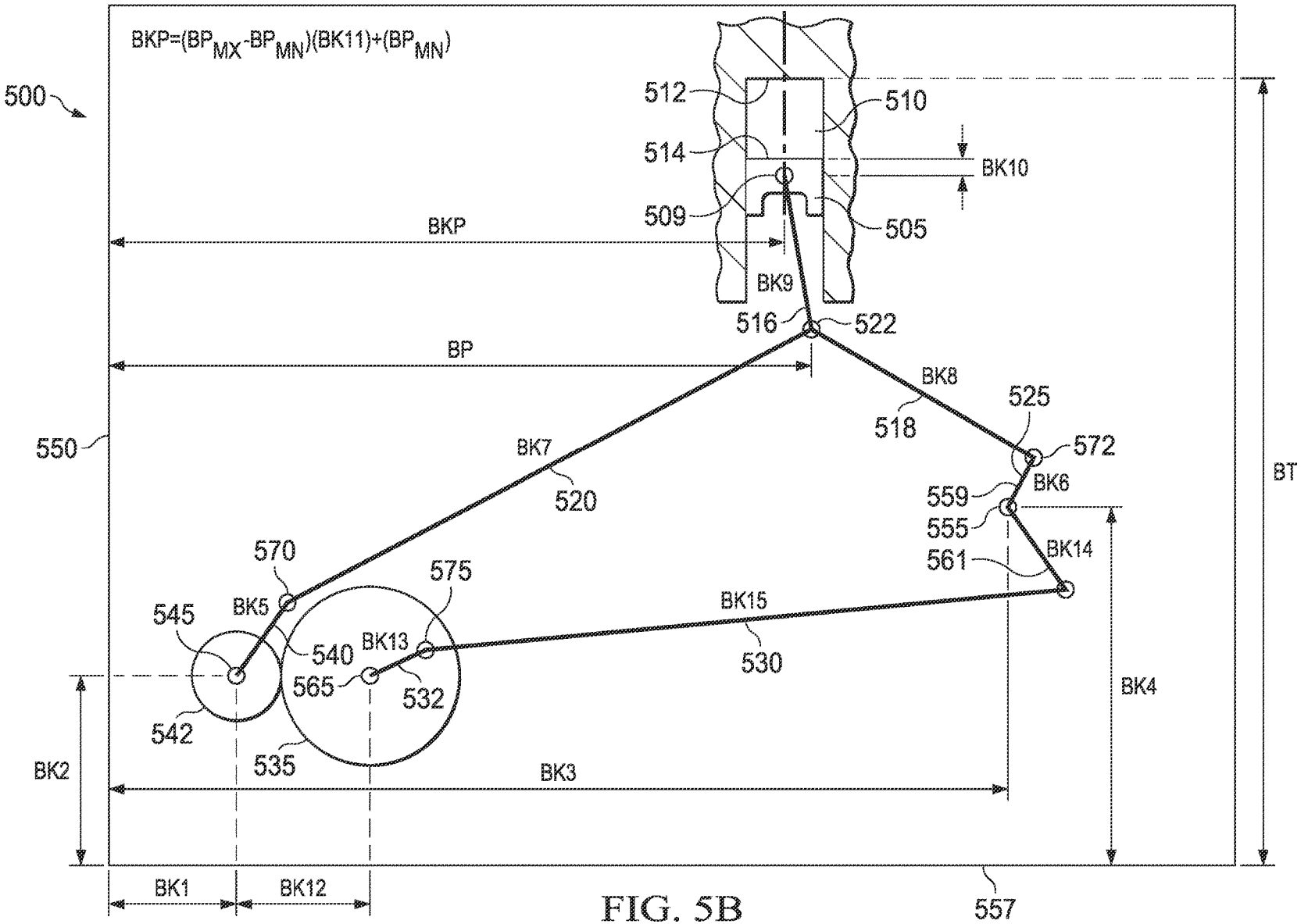
FIG. 5B depicts a schematic illustration of example measurements of various distances between components of an all-stroke-variable internal combustion engine, in accordance with an embodiment.

Similarly, FIG. 5B schematically illustrates measurements of various distances between components of an all-stroke-variable internal combustion engine of example embodiment 500. For purposes of explanation, BK1 denotes a distance between a location of primary crankshaft main bearing 545 and/or a vertical reference plane 550. BK2 denotes a distance between primary crankshaft main bearing 545 and/or a horizontal reference plane 557. BK3 denotes a distance between actuator lever pin 555 and/or vertical reference plane 550. BK4 denotes a distance between actuator lever pin 555 and/or a horizontal reference plane 557. BK5 denotes a length of a throw for primary crankshaft 540. BK6 denotes a length of a first segment 559, and/or BK14 denotes a length of a second segment 561 of lever actuator 525. BK7 denotes a length of primary crankshaft rod 520. BK8 denotes a length of half-speed cycling rod 518. BK9 denotes a length of a piston rod 516. BK10 denotes a distance between a piston pin 509 and/or a top 514 of piston 505. BK11 denotes a piston slap factor. BK12 denotes a distance between primary crankshaft main bearing centerline 545 and/or half-speed crankshaft main bearing 565. BK13 denotes a length and/or throw of half-speed crankshaft 532. BK15 denotes a length of half-speed cycling rod 530.

Further, BKP denotes a distance between a vertical reference plane 550 and/or a centerline of piston pin 505. BP denotes a distance between vertical reference plane 550 and/or a vertical centerline of connection 522. $BP_{MX}$ denotes a maximum distance between a vertical reference plane 550 and/or a vertical centerline of connection 522. $BP_{MN}$ denotes a minimum distance between a vertical centerline of connection 522 and/or vertical reference plane 550.

Figure 5C:
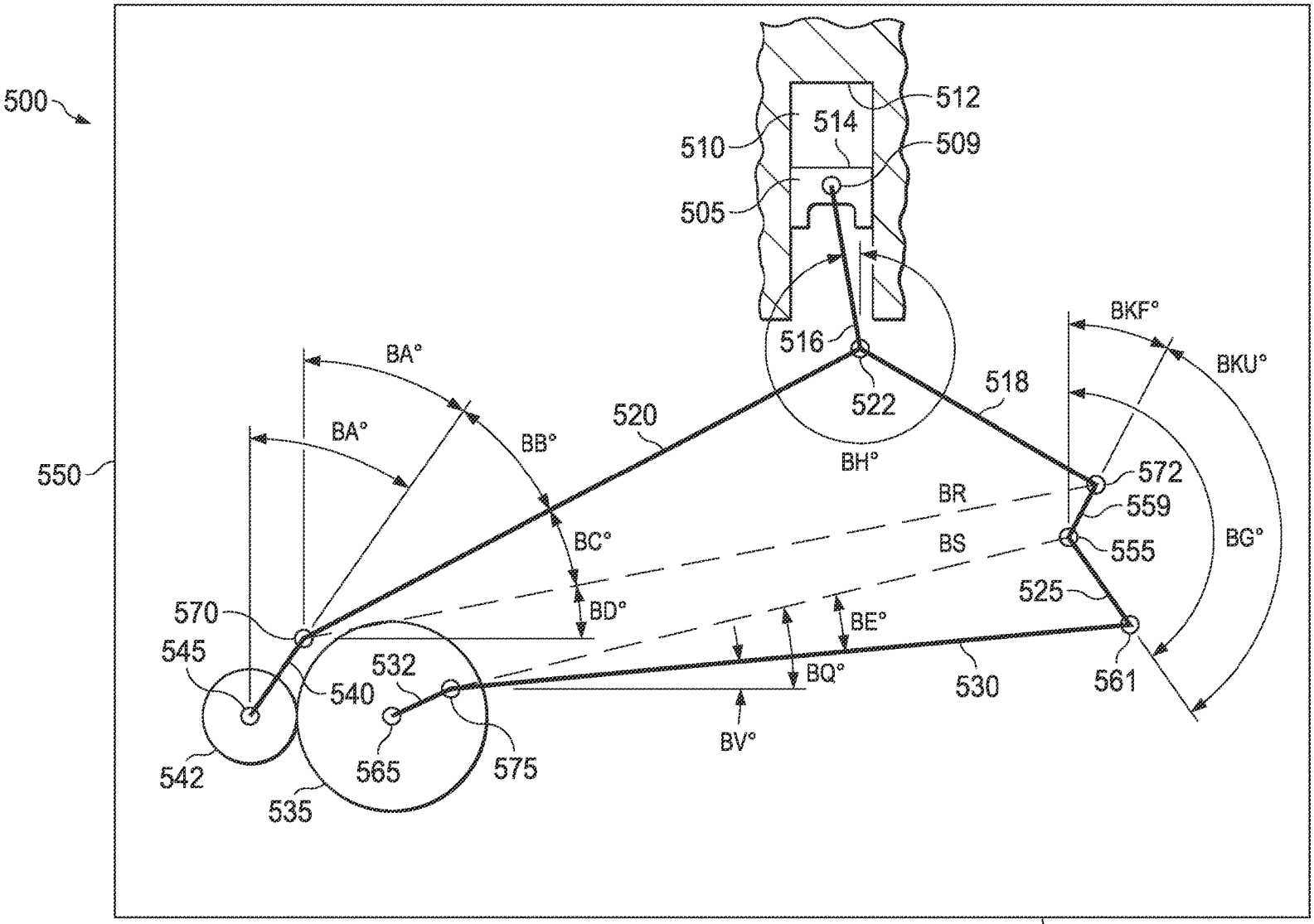
FIG. 5C depicts a schematic illustration of example measurements of various angles between components of an all-stroke-variable internal combustion engine, in accordance with an embodiment.

Likewise, FIG. 5C schematically illustrates example measurements of various distances between components of an all-stroke-variable internal combustion engine of example embodiment 500. For purposes of explanation, distance BR denotes a distance between connections 570 and/or 572. Distance BS denotes a distance between actuator lever pin 555 and/or connection 575. Angle BA denotes an angle between a vertical line through connection 570 and/or a line extending through primary crankshaft 540 main bearing center line 545. Angle BB denotes an angle between primary crankshaft rod 520 and/or a line extending through primary crankshaft 540. Angle BC denotes an angle between primary crankshaft rod 520 and/or BR, which extends between connections 570 and/or 572. Angle BD denotes an angle between a horizontal line through connection 570 and/or BR, which extends between connections 570 and/or 572. Angle BE denotes an angle between a horizontal line through connection 575 and/or line BS and/or half-speed actuator rod 530. Angle BV denotes an angle between half-speed actuator rod 530 and/or a horizontal line extending through connection 575. Line BS denotes a distance between actuator lever pin 555 and/or connection 575. Angle BQ denotes an angle between a horizontal line through connection 575 and/or line BS. Angle BH denotes an obtuse angle between piston rod 516 and/or vertical line through connection 522. Angle BKF denotes an angle between a vertical line through actuator lever pin 555 and/or a line extending through segment 559 of actuator lever 525. Angle BKU denotes an angle between a line extending through segment 559 of actuator lever 525 and/or a line extending through segment 561 of actuator lever 525. Angle BG denotes an angle between a vertical line through actuator lever pin 555 and/or a line extending through segment 561 of actuator lever 525.

Figure 5D:
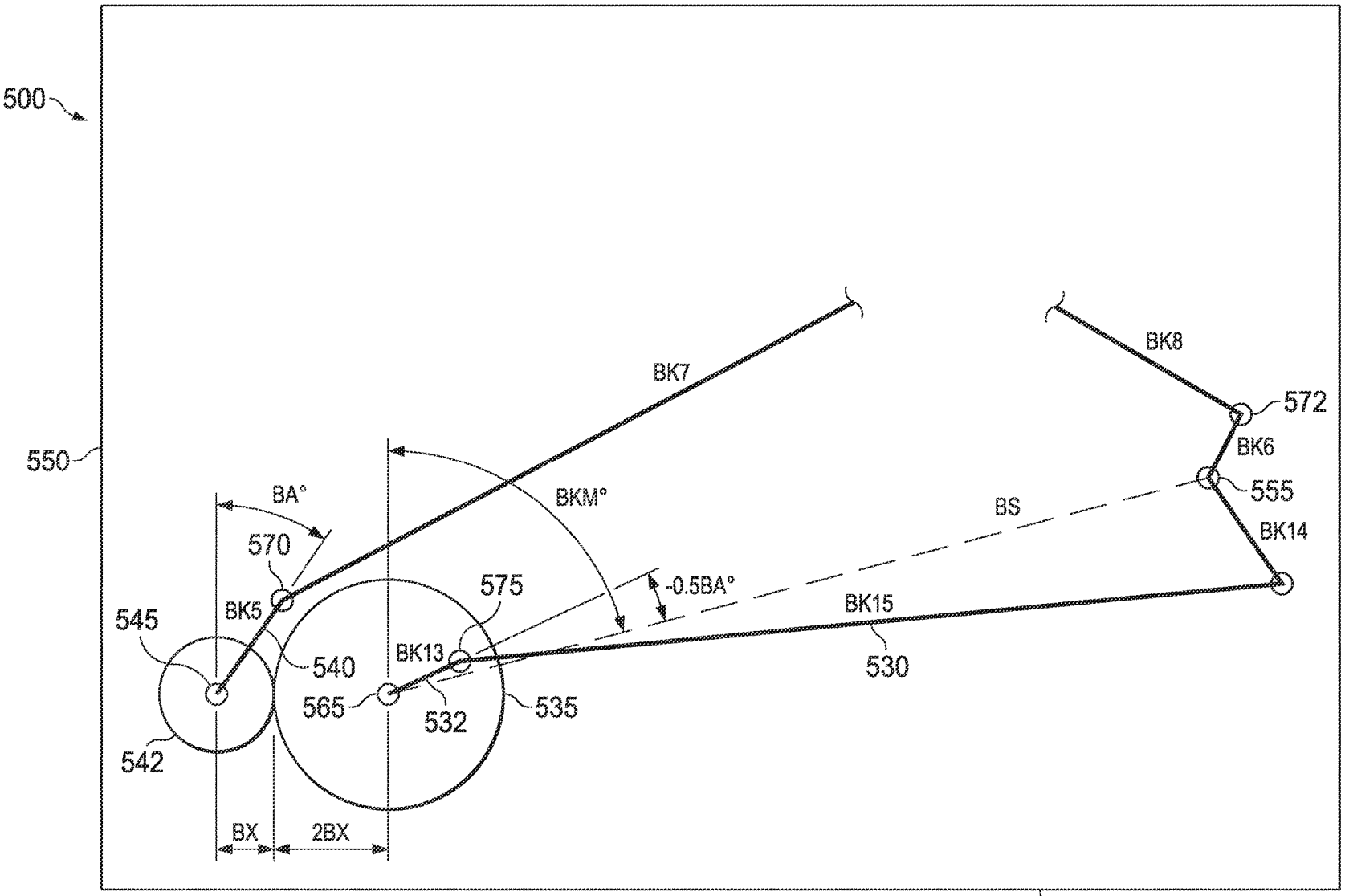
FIG. 5D depicts a schematic illustration of example measurements of various angles between components of an all-stroke-variable internal combustion engine in accordance with an embodiment.

Further, FIG. 5D is a schematic diagram illustrating additional measurements and/or angles for example embodiment 500. Likewise, for purposes of explanation, angle BA denotes an angle between a vertical line through connection 545 and/or a line extending through primary crankshaft 540. An angle having a negative value of half the magnitude, or (−0.5) BA is indicated as being formed between a line extending through half-speed crankshaft 532 and/or line BS, which itself extends between connection 565 and/or actuator lever pin 555. An angle BKM denotes an angle between a vertical line through connection 565 and/or line BS. A distance between primary crankshaft main bearing 545 and/or a pitch circle of primary crankshaft gear 542 is denoted as distance BX in FIG. 5D. In example embodiment 500, primary crankshaft gear 542 may have a pitch diameter equal to approximately half that of half-speed crankshaft gear 535. Accordingly, a distance between a center of half-speed crankshaft gear 535 and/or a pitch circle of half-speed crankshaft gear 535 is denoted as distance 2BX. Stated differently, primary crankshaft gear 542 may have one half as many teeth as half-speed crankshaft gear 535 and/or a pitch circle radius of a half-speed crankshaft gear 535 may be twice that of a pitch circle radius of primary crankshaft gear 542.

Figure 5E:
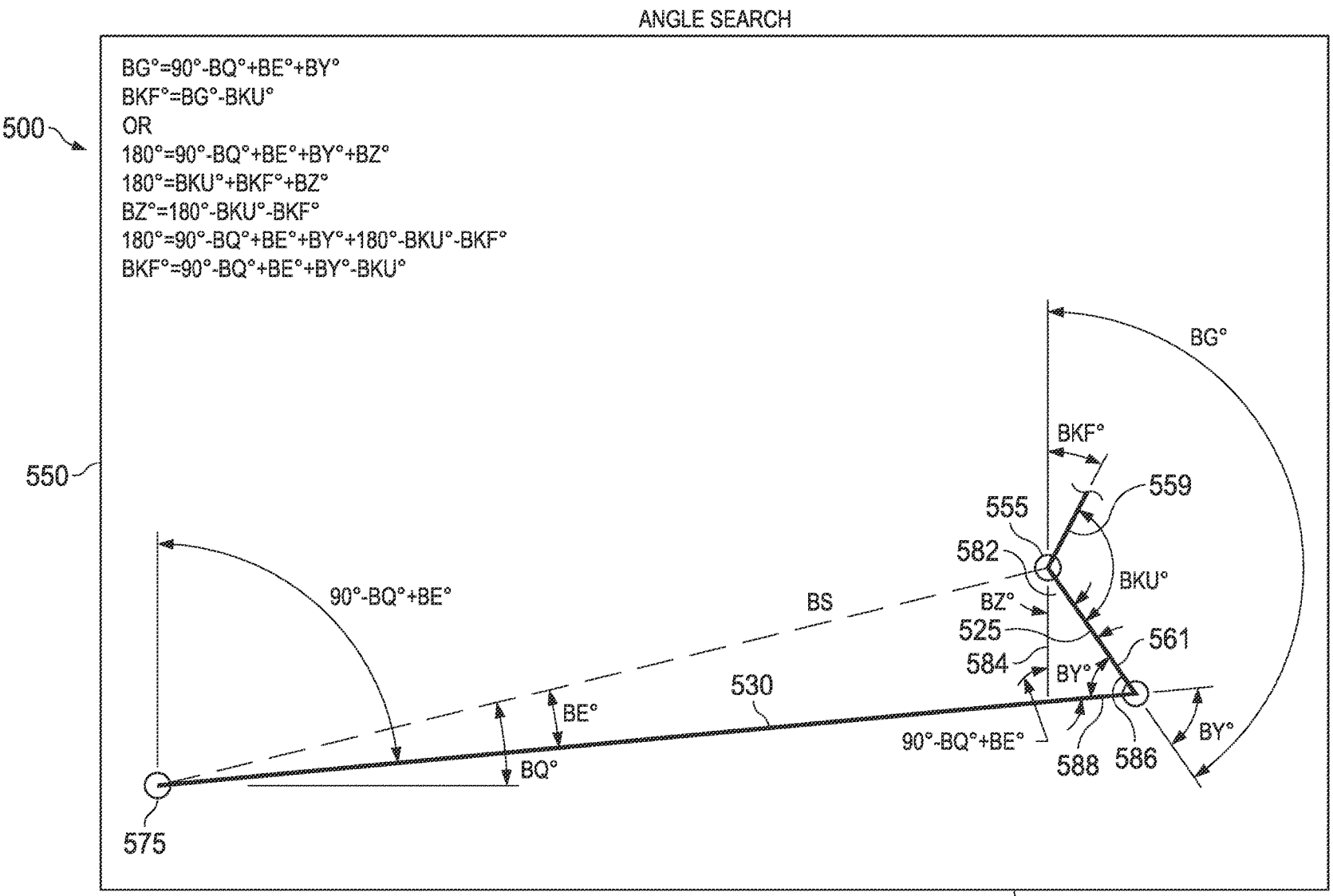
FIG. 5E depicts a schematic illustration of example measurements of various angles between components of an all-stroke-variable internal combustion engine in accordance with an embodiment.

FIG. 5E illustrates an example approach for an angle search and/or determination for example embodiment 500. Thus, in some instances, an angle between a vertical line through connection 575 and/or half-speed actuator rod may, for example, be determined by subtracting a value of angle BQ and/or adding a value of angle BE to 90°. Accordingly, a triangle 582 is illustrated as being formed with a first side 584 comprising a portion of a vertical line extending through actuator lever pin 555, for example, a second side 586 comprising segment 561 of actuator lever 525, and/or a third side 588 comprising a portion of half-speed crankshaft actuator rod 530 extending between an end of segment 561 and/or an intersection of half-speed crankshaft actuator rod 530 and/or a vertical line extending through actuator lever pin 555. As also illustrated in this example, an angle between first side 584 and/or second side 586 of triangle 582 comprises angle BZ, for example. Similarly, as also seen, an angle between second side 586 and/or third side 588 of triangle 582 comprises angle BY, for example. An angle between third side 588 and/or first side 584 of triangle 582 may comprise an angle having a value of 90°-BQ-BE, for example, as this angle may be parallel to an angle formed between a vertical line through connection 575 and/or half-speed actuator rod, as discussed and/or illustrated above.

Figure 5F:
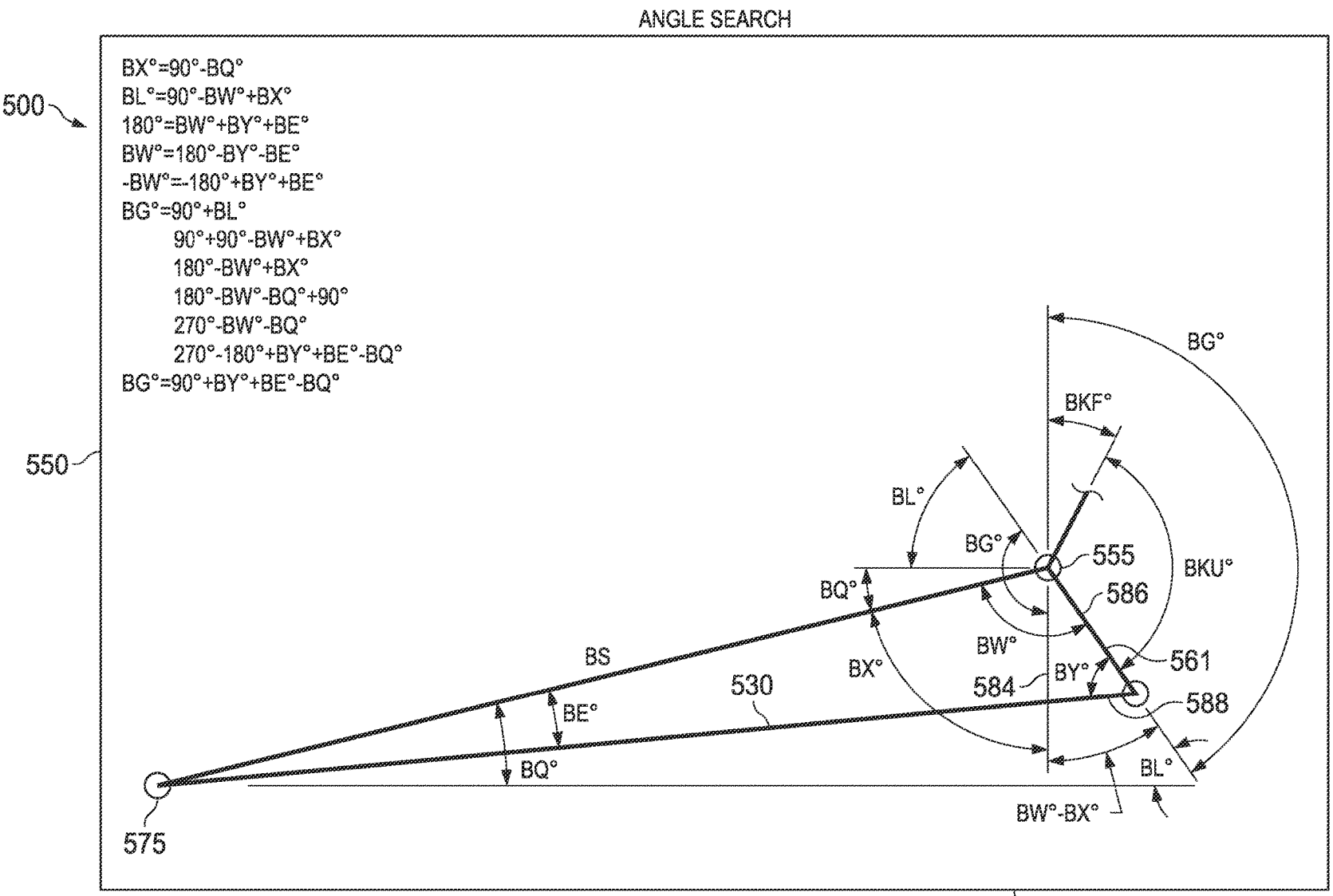
FIG. 5F depicts a schematic illustration of example measurements of various angles between components of an all-stroke-variable internal combustion engine in accordance with an embodiment.

FIG. 5F illustrates an example approach for an angle search for example embodiment 500. FIG. 5F illustrates several angles not shown in other drawings of example embodiment 500, such as angles BL, BW, and/or BX. Here, angle BL denotes an angle between a horizontal line extending from connection 555 and/or a line extending through second segment 561 of lever actuator 525, angle BW denotes an angle between line BS and/or a line extending through second segment 561 of lever actuator 525, and/or angle BX denotes an angle between a vertical line extending through actuator lever pin 555 and/or line BS.

Thus, continuing with the above discussion, Relation 21, shown below, may, for example, be utilized, at least in part, to identify and/or determine a location of a top (BJ) 514 of piston 505 relative to an angular position (angle BA) of primary crankshaft 540. Thus, consider, for example:

$$BJ=(BK2)+(BK5)\mathrm{Cos}(BA)+(BK7)\mathrm{Sin}(BC+BD)+(BK9)\mathrm{Cos}(BH)+(BK10) \quad \text{[Relation 21]}$$

In some instances, Relation 21 may, for example, be computed as discussed below for example embodiment 500. Depending on an implementation, features and/or values of parameters BK1-BK15, KCR, BKM, BKF, and/or BKU may be altered via various evaluations to create graphs and/or plots and/or identify versions of example embodiment 500 which may exhibit certain desirable characteristics. For example, in an implementation, BK5 may be used, in whole and/or in part, to determine an initial and/or base implementation of an all-stroke-variable internal combustion engine in accordance with example embodiment 500. Angles BKM, BKF, and/or BKU may comprise offset angles in example embodiment 500 evaluations, similar to Angle KF of example embodiment 200, as discussed above with respect to FIGS. 2A-C.

As was indicated, various relations may be utilized to calculate and/or determine one or more suitable angles and/or lengths and/or distances. For example, angle BY of example embodiment 500, such as shown in FIGS. 5E-F may be determined based, at least in part, on algebraic and/or geometric properties of triangles. For example, relations 22 and/or 23 as set forth below may be utilized, in whole and/or in part, to determine Angle BY. Thus, consider:

$$\mathrm{Cos}(BY)=\left[\frac{[(BK15)^2+(BK14)^2-BS^2]}{[2(BK15)(BK14)]}\right] \quad \text{[Relation 22]}$$

$$BY=\mathrm{Cos}^{-1}\left[\frac{[(BK15)^2+(BK14)^2-BS^2]}{[2(BK15)(BK14)]}\right] \quad \text{[Relation 23]}$$

In an implementation, Relations 24 and/or 25 may be utilized, at least in part, to identify a length of BR, which extends between connections 570 and/or 572 of example embodiment 500, such as illustrated in FIG. 5C. Thus, consider:

$$BR^2=[(BK3)+(BK6)\mathrm{Sin}(BKF)-[(BK1)+(BK5)\mathrm{Sin}(BA)]]^2+[(BK4)+(BK6)\mathrm{Cos}(BKF)-[(BK2)+(BK5)\mathrm{Cos}(BA)]]^2 \quad \text{[Relation 24]}$$

$$BR=[[(BK3)+(BK6)\mathrm{Sin}(BKF)-[(BK1)+(BK5)\mathrm{Sin}(BA)]]^2+[(BK4)+(BK6)\mathrm{Cos}(BKF)-[(BK2)+(BK5)\mathrm{Cos}(BA)]]^2]^{0.5} \quad \text{[Relation 25]}$$

Here, Relations 26 and/or 27 may be utilized, at least in part, to identify a length of BS, which extends between connection 575 and/or actuator lever pin 555, such as illustrated in FIG. 5C.

$$BS^2=[(BK4)-[(BK2)+(BK13)\mathrm{Cos}(BKM-0.5BA)]]^2+[(BK3)-[(BK1)+(BK12)+(BK13)\mathrm{Sin}(BKM-0.5BA)]]^2 \quad \text{[Relation 26]}$$

$$BS=[[(BK4)-[(BK2)+(BK13)\mathrm{Cos}(BKM-0.5BA)]]^2+[(BK3)-[(BK1)+(BK12)+(BK13)\mathrm{Sin}(BKM-0.5BA)]]^2]^{0.5} \quad \text{[Relation 27]}$$

Relations 28 and/or 29 may be utilized, at least in part, to identify a value of Angle BC, which is located between primary crankshaft rod 520 and/or BR, which extends between connections 570 and/or 572, such as is illustrated in FIG. 5C, for example.

$$\mathrm{Cos}(BC)=\left[\frac{[(BK7)^2+(BR)^2-(BK8)^2]}{[2(BK7)(BR)]}\right] \quad \text{[Relation 28]}$$

$$BC=\mathrm{Cos}^{-1}\left[\frac{[(BK7)^2+(BR)^2-(BK8)^2]}{[2(BK7)(BR)]}\right] \quad \text{[Relation 29]}$$

Relations 30 and/or 31 may be utilized, at least in part, to identify a value of Angle BD, which is located between BR and/or a horizontal line extending through connection 570, such as is illustrated in FIG. 5C, for example.

$$\mathrm{Sin}(BD)=\frac{\left[\begin{array}{c}[(BK4)+(BK6)\mathrm{Cos}(BKF)]-\\ [(BK2)+(BK5)\mathrm{Cos}(BA)]\end{array}\right]}{BR} \quad \text{[Relation 30]}$$

$$BD=\mathrm{Sin}^{-1}\left[\frac{\begin{array}{c}[(BK4)+(BK6)\mathrm{Cos}(BKF)]-\\ [(BK2)+(BK5)\mathrm{Cos}(BA)]\end{array}}{BR}\right] \quad \text{[Relation 31]}$$

Relations 32 and/or 33 may be utilized, at least in part, to identify a value of Angle BQ, which is located between a line BS, which extends from connection 555 to connection 575, and/or a horizontal line extending through connection 575, such as is illustrated in FIG. 5C, for example. Thus, consider:

$$\mathrm{Tan}(BQ) = \left[\frac{\left[\begin{array}{c}(BK4) - [(BK2) + \\ (BK13)\mathrm{Cos}(BKM - 0.5BA)]\end{array}\right]}{\left[\begin{array}{c}(BK3) - [(BK1) + (BK12) + \\ (BK13)\mathrm{Sin}(BKM - 0.5BA)]\end{array}\right]}\right] \quad \text{[Relation 32]}$$

$$BQ = \mathrm{Tan}^{-1}\left[\frac{\left[\begin{array}{c}(BK4) - [(BK2) + \\ (BK13)\mathrm{Cos}(BKM - 0.5BA)]\end{array}\right]}{\left[\begin{array}{c}(BK3) - [(BK1) + (BK12) + \\ (BK13)\mathrm{Sin}(BKM - 0.5BA)]\end{array}\right]}\right] \quad \text{[Relation 33]}$$

Relations 34 and/or 35 may be utilized, at least in part, to identify a value of Angle BE, which is located between line BS, which extends between connection 575 and/or actuator lever pin 555, and/or a line extending through half-speed crankshaft actuator rod 530, such as is illustrated in FIG. 5C. Thus, consider:

$$\mathrm{Cos}(BE) = \left[\frac{[(BS)^2 + (BK15)^2 - (BK14)^2]}{[2(BS)(BK15)]}\right] \quad \text{[Relation 34]}$$

$$BE = \mathrm{Cos}^{-1}\left[\frac{[(BS)^2 + (BK15)^2 - (BK14)^2]}{[2(BS)(BK15)]}\right] \quad \text{[Relation 35]}$$

Relation 36 may be utilized, at least in part, to determine a length of BP, which may indicate a distance between vertical reference plane 550 and/or vertical centerline of connection 522, such as is illustrated in FIG. 5B. Thus, consider:

$$BP=(BK1)+(BK5)\mathrm{Sin}(BA)+(BK7)\mathrm{Cos}(BC+BD) \quad \text{[Relation 36]}$$

Relation 37 may be utilized, at least in part, to determine a length of BKP, which may indicate a distance between vertical reference plane 550 and/or a centerline of piston 505, such as is illustrated in FIG. 5B. Thus, consider:

$$(BKP)=(BP_{MX}-BP_{MN})(BK11)+BP_{MN} \quad \text{[Relation 37]}$$

Relations 38 and/or 39 may be utilized, at least in part, to identify a value of Angle BH, which may indicate an obtuse angle between piston rod 519 and/or piston actuator rod 518, such as is illustrated in FIG. 5C. Thus, consider:

$$\mathrm{Sin}(BH) = \left[\frac{(BKP) - (BP)}{(BK9)}\right] \quad \text{[Relation 38]}$$

$$BH = \mathrm{Sin}^{-1}\left[\frac{(BKP) - (BP)}{(BK9)}\right] \quad \text{[Relation 39]}$$

Similarly, as with example embodiment 200, a primary crankshaft may, for example, be rotated through two complete revolutions to plot a locus of points so as to generate one or more appropriate graphs, such as for parameter evaluation. For example, Angle BA may vary from zero degrees to 720 degrees and/or zero radians to four π radians to complete one cycle of an all-stroke-variable internal combustion engine in accordance with example embodiment 500. BK11, denoting a piston slap factor, may be chosen to reduce and/or minimize power loss due to side loads on the piston, as with embodiment 200, for example.

Thus, here, a graph and/or plot similar to General Shape Graph of FIG. 3, for example, may be generated. Likewise, accompanying relations may be utilized, in whole and/or in part, to evaluate results and/or to calculate and/or illustrate locations of TDCs, BDCs, stroke lengths, and/or a top of a cylinder, for example. Additionally, an expansion ratio, exhaust ratio and/or intake ratio may, for example, be calculated using various relations, as discussed herein. Similarly, here, one or more configurations of an all-stroke-variable internal combustion engine which return results showing a piston top 514 being above a top of a cylinder at any part of an operation cycle may be disregarded from consideration. As with example embodiment 200, in example embodiment 500, a top of a cylinder may, for example, be determined and/or dictated by a compression ratio and/or a position of a compression stroke via implementation of various corresponding relations. As with example embodiment 200, one or more aspects of example embodiment 500 may be examined for refinements including, but not limited to, example embodiment 200 refinements as discussed above. In evaluations for example embodiment 500, each stroke and/or each stroke ratio may be variable.

A process of example embodiment 400 and/or other suitable process, such as may be based at least in part on one or more relations described herein, may be used, in whole and/or in part, to determine one or more implementations of an all-stroke-variable internal combustion engine having all and/or suitable number of desired and/or suitable strokes and/or desired and/or suitable stroke ratios. Table 1 shown below illustrates example parameter values for evaluations, such as discussed above with respect to FIG. 4, in accordance with a process of example embodiment 200, for example.

TABLE 1 examples of variables and/or parameter values for an example embodiment of an all-stroke variable configuration depicted in FIGS. 2A-2C

| Variable | Value |
|---|---|
| K1 | 10 |
| K2 | 10 |
| K3 | 24 |
| K4 | 11 |
| K5 | 1 |
| K6 | 0.75 |
| K7 | 8 |
| K8 | 8 |
| K9 | 10 |
| K10 | 0.2 |
| K11 | 0.8125 |
| KF | 0-360° |
| KCR | 10.2 |

In certain simulations, ninety evaluations have been performed on various values of angle KF, with one evaluation for every four degrees of offset angle KF. Here, a spreadsheet may, for example, be employed with the above conditions for an example embodiment having angle KF equal to zero degrees in a first calculation, and/or subsequent calculations having only one change, such as where angle KF is four degrees larger than with a prior calculation.

Figure 6A:
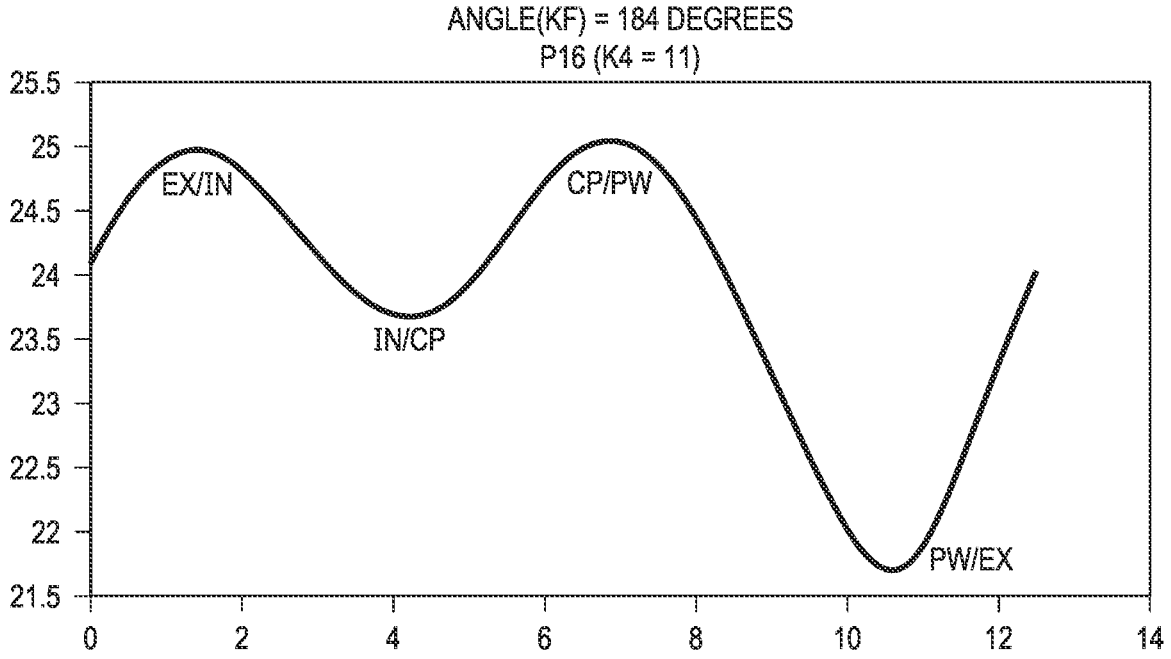
FIG. 6A is an example graph illustrating an example relationship between a location of a top of a piston and/or a measurement of an angular position of a primary crankshaft, in accordance with an embodiment.
Figure 6B:
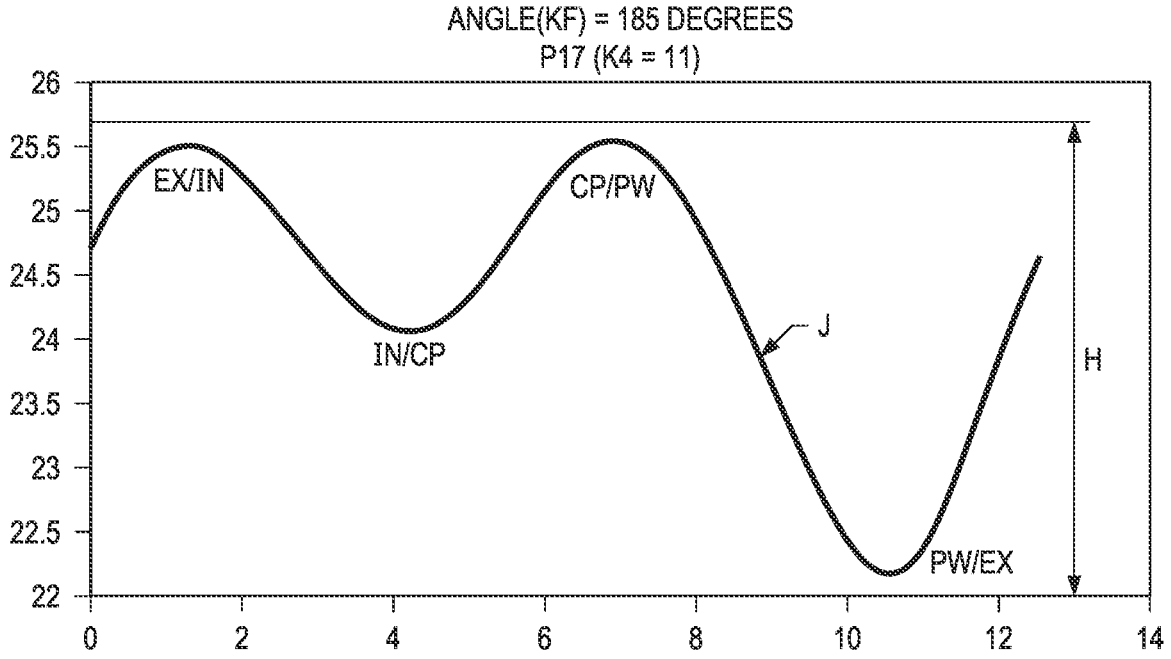
FIG. 6B is an example graph illustrating an example relationship between a location of a top of a piston and/or a measurement of an angular position of a primary crankshaft, in accordance with an embodiment.
Figure 6C:
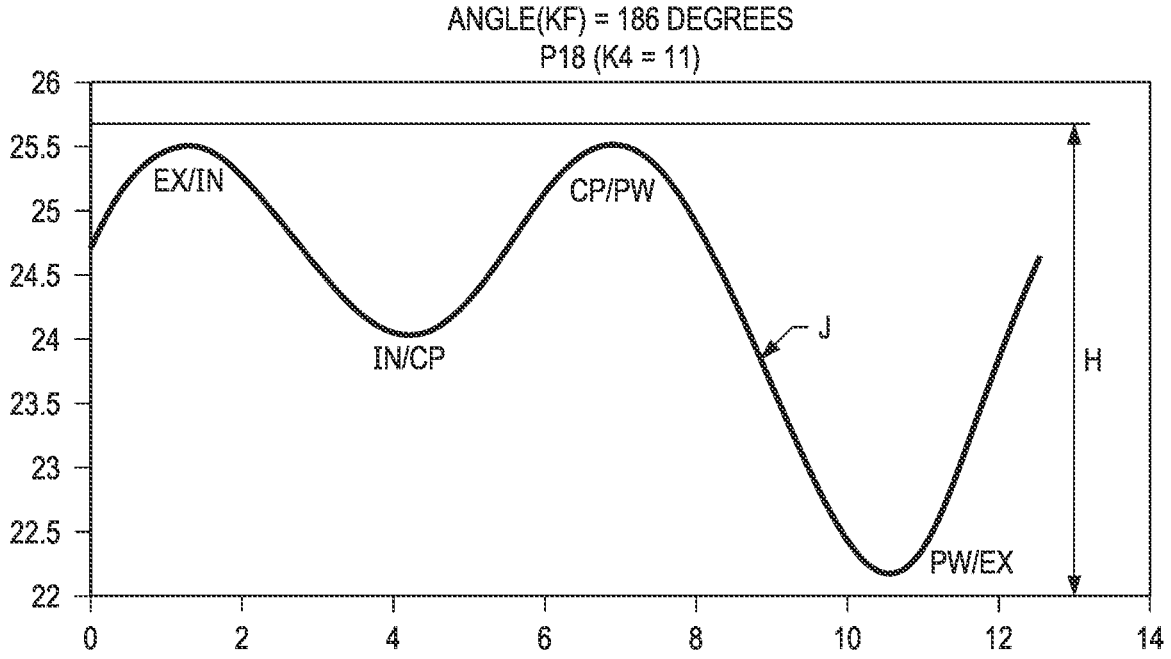
FIG. 6C is an example graph illustrating an example relationship between a location of a top of a piston and/or a measurement of an angular position of a primary crankshaft, in accordance with an embodiment.
Figure 6D:
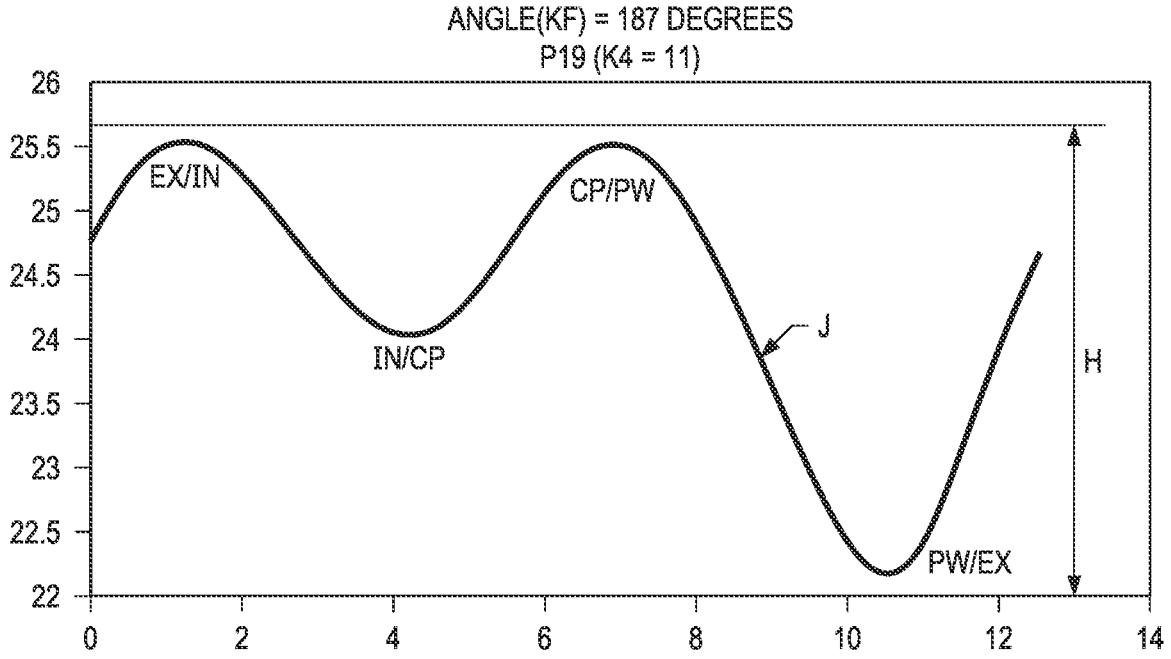
FIG. 6D is an example graph illustrating an example relationship between a location of a top of a piston and/or a measurement of an angular position of a primary crankshaft, in accordance with an embodiment.
Figure 6E:
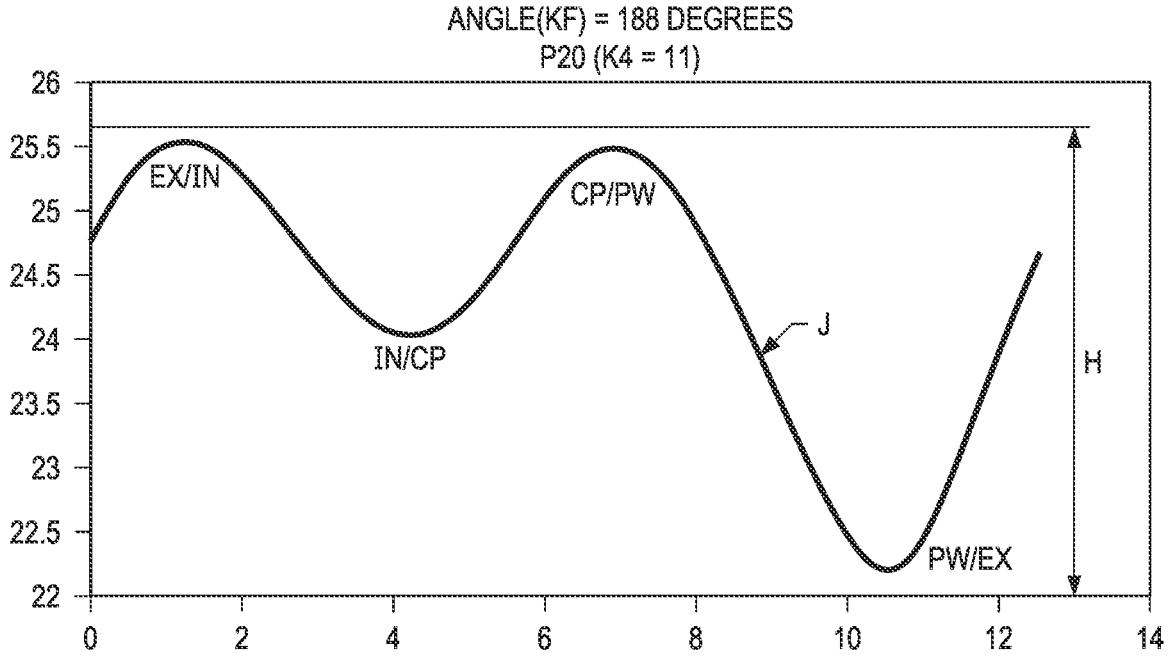
FIG. 6E is an example graph illustrating an example relationship between a location of a top of a piston and/or a measurement of an angular position of a primary crankshaft, in accordance with an embodiment.
Figure 6F:
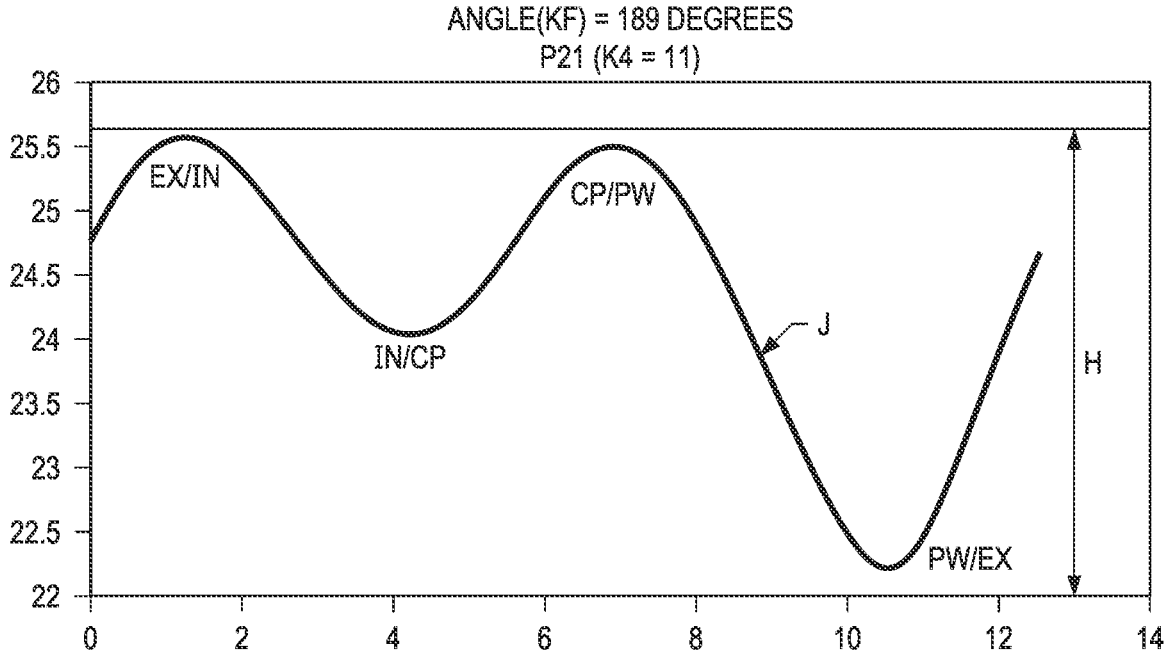
FIG. 6F is an example graph illustrating an example relationship between a location of a top of a piston and/or a measurement of an angular position of a primary crankshaft, in accordance with an embodiment.
Figure 6G:
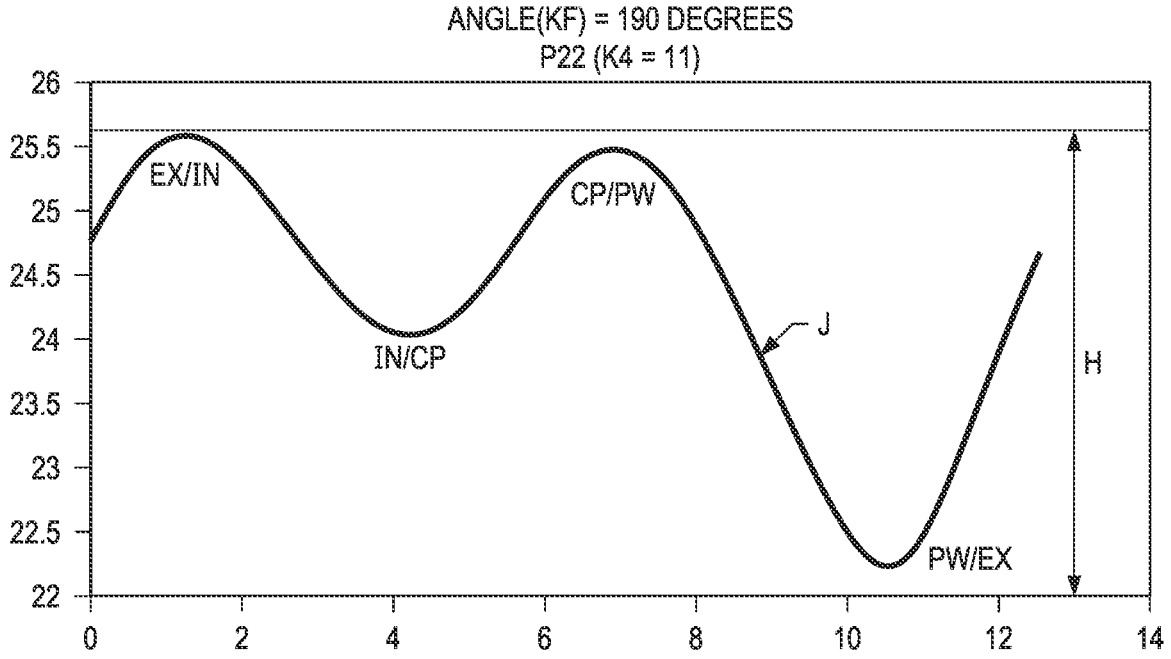
FIG. 6G is an example graph illustrating an example relationship between a location of a top of a piston and/or a measurement of an angular position of a primary crankshaft, in accordance with an embodiment.
Figure 6H:
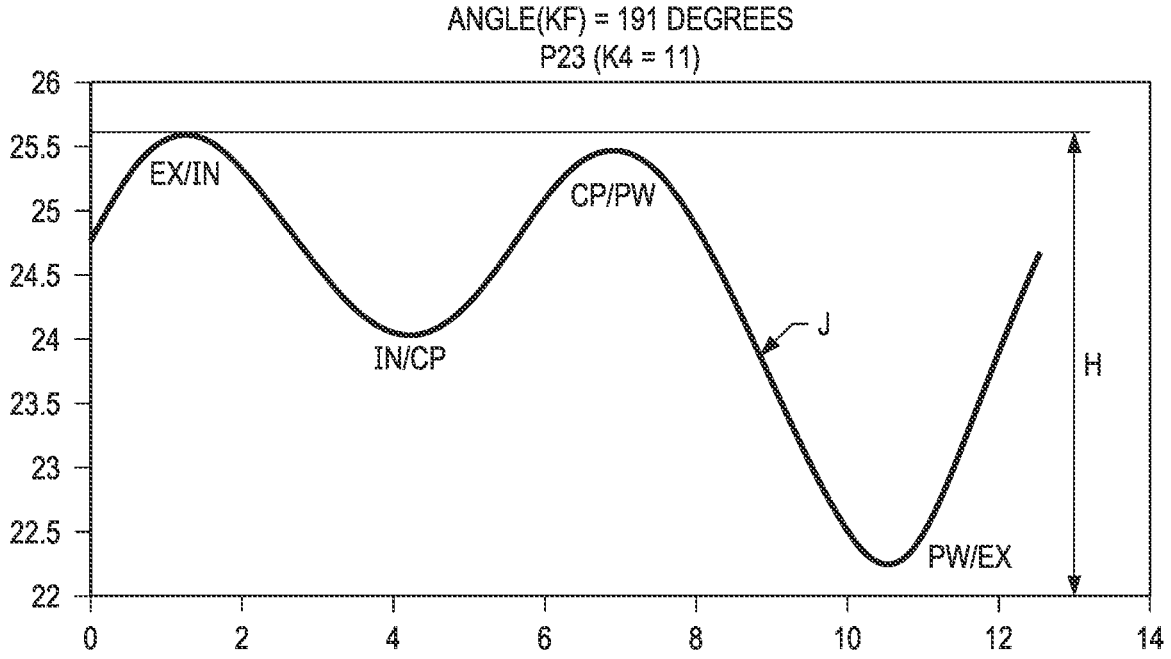
FIG. 6H is an example graph illustrating an example relationship between a location of a top of a piston and/or a measurement of an angular position of a primary crankshaft, in accordance with an embodiment.
Figure 6I:
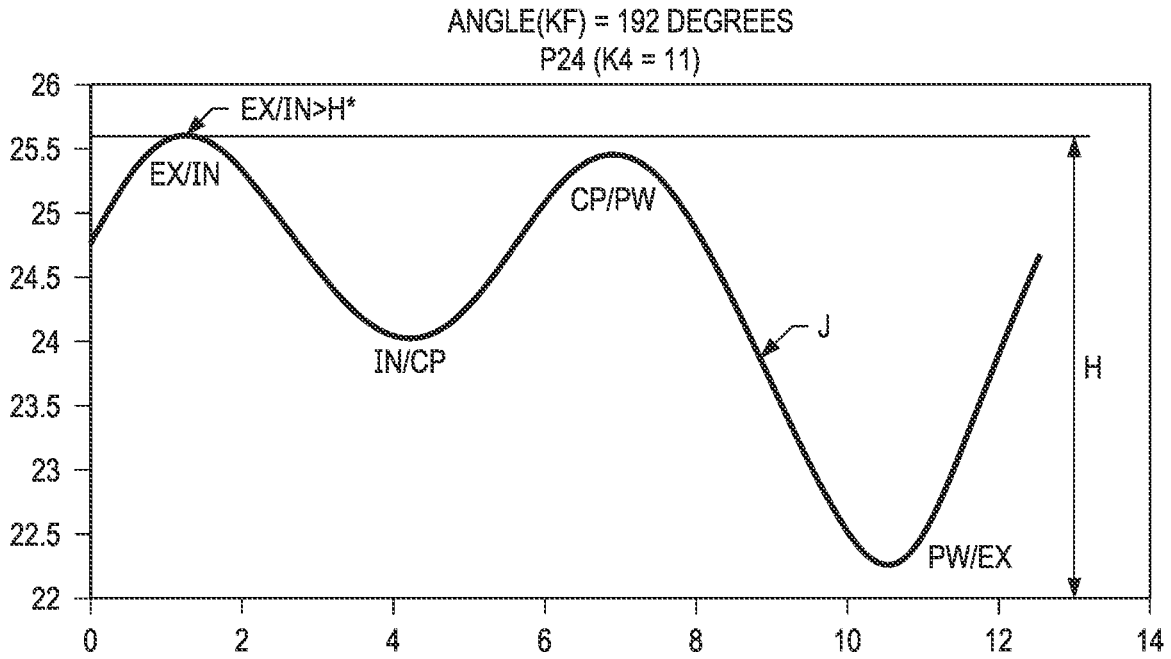
FIG. 6I is an example graph illustrating an example relationship between a location of a top of a piston and/or a measurement of an angular position of a primary crankshaft, in accordance with an embodiment.

FIGS. 6A-I are graphs illustrating a relationship between a location of a top of a piston and/or angle A, such as with respect to example embodiment 200 with parameters shown in Table 1. Each graph may be generated by rotating a primary crankshaft of example embodiment 200 through two complete revolutions to plot a locus of points of [J] with respect to a measurement of Angle [A]. Each graph may be generated by keeping variables K1-K11 and/or KCR at constant values and/or varying angle KF. By way of example, FIG. 6A illustrates a graph generated where angle KF has a value of 184°; FIG. 6B illustrates a graph generated where Angle KF has a value of 185°; FIG. 6C illustrates a graph generated where Angle KF has a value of 186°. FIG. 6D illustrates a graph generated where Angle KF has a value of 187°. FIG. 6E illustrates a graph generated where Angle KF has a value of 188°. FIG. 6F illustrates a graph generated where Angle KF has a value of 189°. FIG. 6G illustrates a graph generated where Angle KF has a value of 190°; FIG. 6H illustrates a graph generated where Angle KF has a value of 191°; and/or FIG. 6I illustrates a graph generated where Angle KF has a value of 192°.

Results of examples of nine evaluations with angle KF equal to 184 to 192 degrees are shown below in Table 2.

TABLE 2 examples of angle KF and/or various parameter ratios

| Angle (KF) | Exhaust Ratio | Intake Ratio | Expansion Ratio | Compression Ratio |
|---|---|---|---|---|
| 184° | 14.00 | 5.47 | 25.00 | 10.20 |
| 185° | 20.60 | 9.00 | 23.10 | 10.20 |
| 186° | 24.10 | 10.70 | 23.10 | 10.20 |
| 187° | 29.00 | 13.00 | 23.00 | 10.20 |
| 188° | 36.50 | 16.50 | 23.00 | 10.20 |
| 189° | 49.00 | 22.40 | 23.00 | 10.20 |
| 190° | 75.00 | 34.70 | 22.90 | 10.20 |
| 191° | 159.00 | 74.60 | 22.80 | 10.20 |
| 192° | −1348.0* | — | 22.75 | 10.20 |

*May be less suitable (Ex/In > H)

Results shown in Table 2 with angle KF equal to 184 degrees and/or 185 degrees illustrate an exhaust ratio less than an expansion ratio, which is an all-stroke-variable configuration having added valve clearance at an exhaust TDC. Results for an all-stroke-variable internal combustion engine having an Angle KF equal to 186 degrees illustrate an exhaust ratio slightly greater than an expansion ratio, demonstrating that an all-stroke-variable implementation having an angle KF of between 185 degrees and/or 186 degrees may have substantially equal exhaust ratio and/or expansion ratio. For implementations of all-stroke-variable internal combustion engines having substantially equal expansion and/or exhaust ratios, the two TDC may be similarly positioned. However, it should be appreciated that an all-stroke-variable internal combustion engine need not be limited to this configuration. A TDC for an exhaust stroke may be located to accommodate and/or take advantage of a particular valve design and/or timing, and/or a TDC for a compression stroke may be located to accommodate compression ratio independently of each other, for example. Locations of TDCs, for example, may be determined with a desired and/or suitable compression ratio, expansion ratio, exhaust ratio, and/or intake ratio. Evaluation results with angle KF equal to 186 degrees through 191 degrees indicate that an exhaust ratio may be increasing, for example, and/or may be greater than an expansion ratio as Angle KF increases. As angle KF increases from 186 to 191 degrees, an exhaust ratio may increase from 24.1 to 159, for example. A configuration with angle KF equal to 191 degrees may put a top of a piston close to a top of a cylinder bore at an exhaust TDC. One more degree added to Angle KF, making it 192 degrees, may return an exhaust ratio of (−1348), which puts a top of a piston past a top of a cylinder bore and/or the linkage fails, demonstrating that a procedure for identifying all-stroke-variable internal combustion engine configurations may employ a filter to disregard implementations having exhaust ratios less than zero. Those who practice the art would appreciate, using the present disclosure, how to manipulate a configuration of an all-stroke-variable mechanism to establish a particular set of desirable stroke ratios. Features of all-stroke-variable internal combustion engines may, for example, be altered and/or adjusted while manipulating an engine configuration, for example, to identify a configuration which produces and/or returns desired and/or suitable stroke ratios.

Examination of some evaluations and/or results in accordance with parameter values as shown in Table 1 may show that a phase changer used to change Angle KF from 186 to 190 degrees, for example, may be implemented herein. For example, such a phase changer may be capable of changing an exhaust ratio from about 29.7 (about the same as an expansion ratio) to about 46:5, and, thus, an intake ratio may change from about 13.1 to about 21.5, and/or an expansion ratio may change from about 28 to about 19, as a way of illustrations. Such changes may result with angle KF being changed in an all-stroke-variable configuration with a KF angle of 188 degrees. More specifically, an all-stroke-variable internal combustion engine may be implemented utilizing parameters illustrated in Table 1, including angle KF being equal to 188 degrees. Such an internal combustion engine may, for example, be implemented with angle KF being changed to 186 degrees by a phase changer with no other changes being made. An internal combustion engine may similarly be implemented with angle KF changed to 190 degrees. As a way of illustration, Table 3 below shows examples of resulting changes made to four stroke ratios in response to a phase changer altering a KF angle.

TABLE 3 examples of angle BKF and/or various parameters

| BKF | KCR | PWR | EXR | INR |
|---|---|---|---|---|
| 186° | 12.3 | 28 | 29.7 | 13.1 |
| 188° | 10.2 | 23 | 36.5 | 16.5 |
| 190° | 8.4 | 19 | 46.5 | 21.5 |

Thus, Table 3 demonstrates that a phase changer may be utilized to implement an all-stroke variable internal combustion engine having variable compression ratio, variable expansion (i.e., power) ratio, variable exhaust ratio and/or variable intake ratio.

One or more other configurations may be evaluated, such as by changing various lengths, positions, and/or angles of an all-stroke-variable internal combustion engine with a phase changer in a similar manner to find improved and/or desirable flexibility and/or performance. In some instances, one or more stroke ratios may, for example, be made and/or selected while an internal combustion engine is operating (e.g., in operative use) and/or while an internal combustion engine is not operating (not in operative use, stationary). Changes may be made in response to one or more operating conditions, such as load, seed, etc. and/or some other conditions, such as changing and/or converting to a different fuel.

Here, any suitable phase changer may, for example, be utilized. For example, in an implementation, a phase changer may comprise a tubular and/or sleeve spiral gear with different spiral angles on inside and/or outside surfaces of a tube and/or sleeve. An inside spiral of a sleeve may engage a matching spiral on a half-speed crankshaft and/or primary crankshaft, for example. In turn, an outside spiral of a sleeve may, for example, engage a matching spiral on a bore of a half-speed crankshaft gear and/or primary crankshaft gear. Inside and/or outside spiral engagements may be of slidable-type connections. A control device, for example, may be used, at least in part, to move a phase change sleeve along an axis of a crankshaft, which may result in an alteration of angle KF.

Figure 7A:
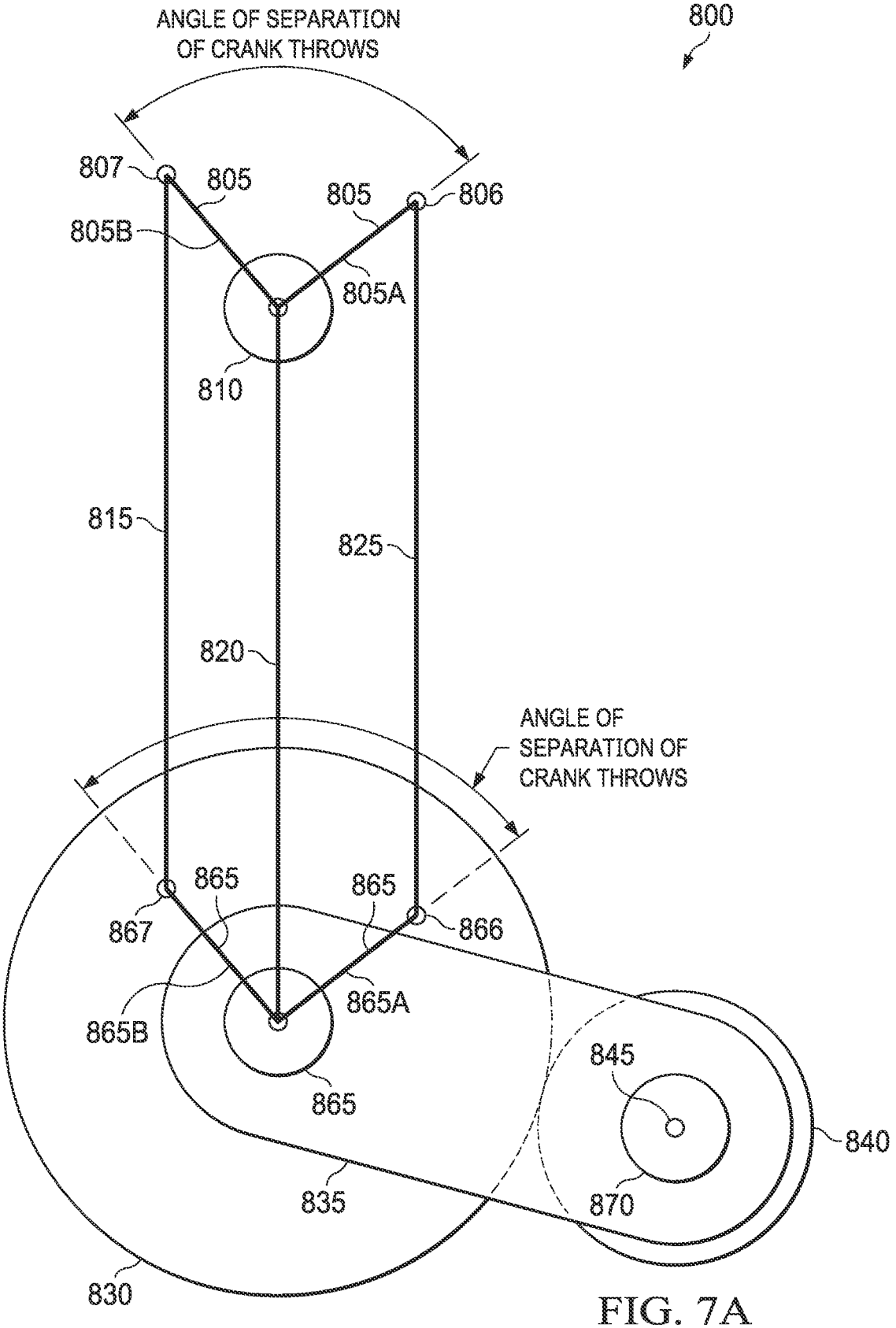
FIG. 7A depicts a schematic illustration a front view of an example rod drive to drive a camshaft, in accordance with an embodiment.
Figure 7B:
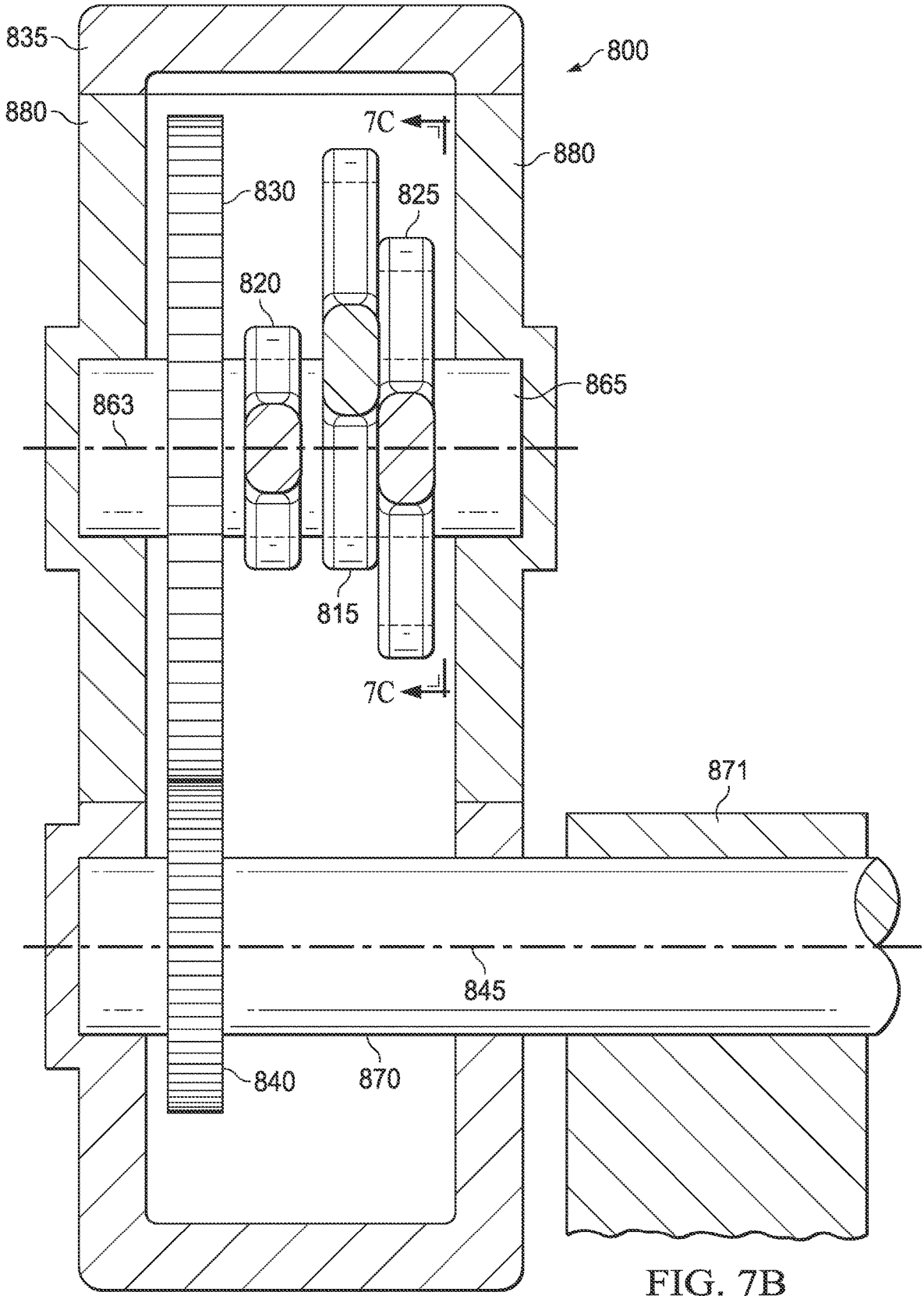
FIG. 7B depicts a schematic illustration of a plan view of an example rod drive to drive a camshaft, in accordance with an embodiment.
Figure 7E:
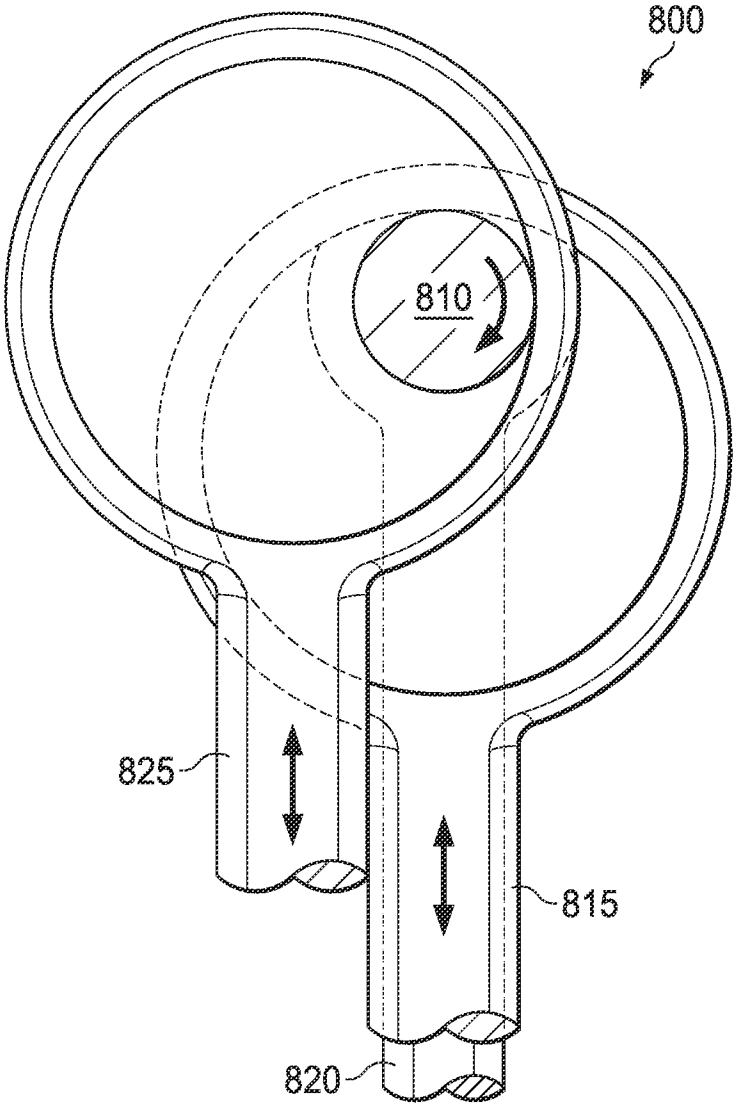
FIG. 7E depicts a schematic illustration of a front view of an example rod drive driven crankshaft and/or rods assembly of a driven crankshaft end, in accordance with an embodiment.
Figure 7C:
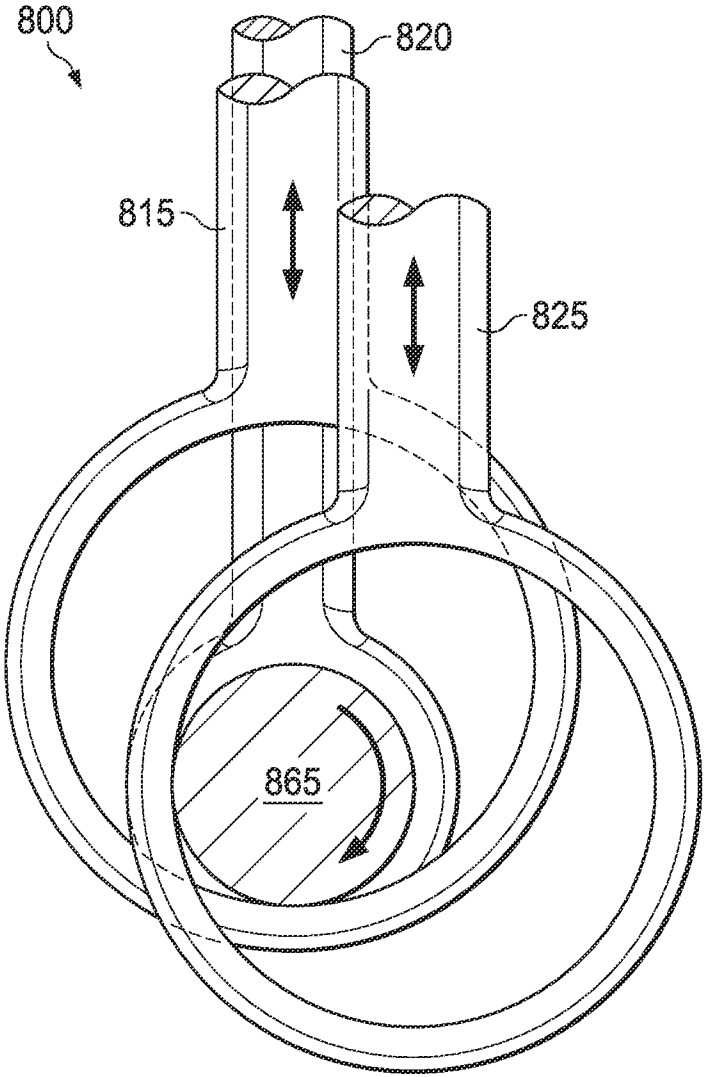
FIG. 7C depicts a schematic illustration of a front view of an example rod drive crankshaft and/or rods assembly at a drive crankshaft end, in accordance with an embodiment.
Figure 7D:
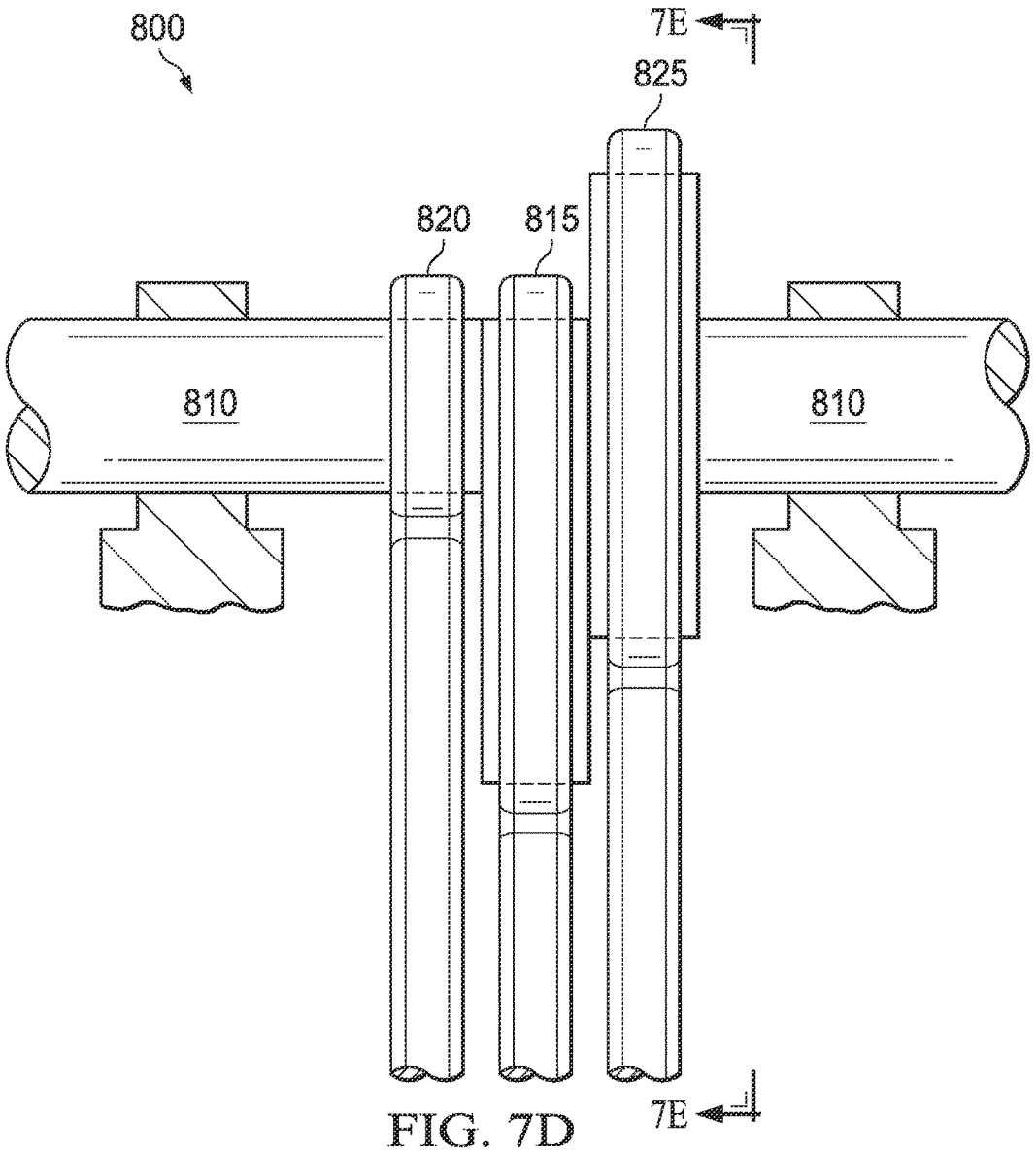
FIG. 7D depicts a schematic illustration of a side view of an example rod drive of a driven crankshaft, in accordance with an embodiment.

As alluded to previously, an all-stroke-variable internal combustion engine may accommodate a rod drive to drive a camshaft, such as camshaft 113 shown in FIG. 1, for example, to open and/or close intake and/or exhaust valves during a four-stroke cycle process. FIG. 7A illustrates a front view of an example embodiment 800 of a rod drive to drive a camshaft. FIG. 7B illustrates a plan view of example embodiment 800 of a rod drive to drive a camshaft. FIG. 7C illustrates a front view of example embodiment 800 of a rod drive crankshaft and/or rods assembly at a drive crankshaft end. FIG. 7D illustrates a side view of example embodiment 800 of a rod drive at a driven crankshaft. FIG. 7E illustrates a front view of example embodiment 800 of a rod drive driven crankshaft and/or rods assembly at a driven crankshaft end. For ease of discussion, where appropriate, the same aspects of FIGS. 7A-7E are given the same reference numbers.

In some rod drive implementations, distance rod 820 may be used to maintain a distance between a centerline 863 of drive camshaft driver crankshaft 865 and/or a centerline of driven camshaft driver crankshaft 805. Distance rod 820 may be made of material that has a substantially similar coefficient of thermal expansion as two drive rods. A distance to be maintained may be the same as a distance between two centerlines of bores of two drive rods. More precisely, drive rods 815, 825 and/or distance rod 820, for example, may have substantially identical centerline distances with and/or without use of gear carrier frame 835. Additionally, present art rod drive implementations may not include a pivotal carrier frame, such that centerline 863 of crankshaft 865 may be fixed. Drive camshaft driver crankshaft 865 may be considered to be positioned at fixed location while a distance to camshaft 810 from drive camshaft driver crankshaft 865 changes a different amount than changes in a distance between centers of distance rod bores as temperature changes, for example. In a particular implementation, driven camshaft driver crankshaft 805 may be held in place by distance rod 820. Driven camshaft 810 may receive power from driven camshaft driver crankshaft 805 by way of a pin that may be offset from a centerline of driven camshaft driver crankshaft 805. Such a pin may comprise a fixed part of a driven crankshaft. A pin may engage a radial slot in an end of a camshaft, for example. Such a pin may transfer torque from driven camshaft driver crankshaft 805 to camshaft 810. In an embodiment, a slot in an end of camshaft 810 may compensate for an offset of driven camshaft driver crankshaft 805 from camshaft 810. In a particular implementation, a drive pin and/or slot may be switched from a crankshaft and/or camshaft. An alternative to a pin and/or slot offset drive may employ a staggered and/or dog leg drive pin. Such a drive may utilize one or more holes that may be offset from centerlines of driven camshaft driver crankshaft 805 and/or camshaft 810. A pin having a jog so as to have two offset and/or parallel centerlines may be pivotally connected to driven camshaft driver crankshaft 805 and/or camshaft 810 by way of one or more holes so that torque may be transferred through the pin from driven camshaft driver crankshaft 805 to camshaft 810. Further, in a particular implementation, an offset pin may be pivotally connected to driven camshaft driver crankshaft 805 and/or camshaft 810 by way of two holes and/or may oculate to compensate for out-of-alignment of the driven camshaft driver crankshaft 805 and/or camshaft 810. Implementations described herein, including, for example, rod drives and/or carrier frame 835 described above, may utilize a reduced amount of power due and/or experience less noise, vibration, and/or harshness (NVH) due at least in part to compensation for dimensional changes as they occur. For example, particular implementations, as described below, may include options for pivotal carrier frame 835 that may help ensure that driven camshaft driver crankshaft 805 is substantially and/or consistently in line with camshaft 810.

As discussed, particular implementations of pivotal carrier frame 835 may reduce and/or substantially eliminate potential out-of-alignment issues. Some implementations, such as those that compensate for rather than eliminate out-of-alignment issues may have parts which may be substantially consistently in relative motion with each other, thereby resulting in some friction power loss and/or some increase in NVH. A substantially consistently compensating version of a rod drive, for example, may include elements that may transfer torque from driven camshaft driver crankshaft 805 to camshaft 810 which may substantially consistently change a distance from a centerline of a particular shaft which may result in a substantially consistent change of an angular rotational speed of a camshaft throughout individual revolutions, thereby resulting in additional NVH. A particular implementation of a rod driver that includes an implementation of pivotal carrier frame 835 to substantially eliminate and/or reduce out-of-alignment issues may include pivotal carrier frame 835 rotatably attached to half-speed crankshaft 865 so that it may pivot on or about a primary crankshaft 870 at the same time that half-speed crankshaft 865 is rotating. In a particular implementation, pivotal carrier frame 835 pivotal attachments may be located to a suitable arrangement on a main bearing housing of an engine frame. In a particular implementation, pivotal carrier frame 835 may pivot about centerline 845 of half-speed crankshaft 870 and/or may be pivotally attached to an engine frame and/or main bearing 871. Such a location may reduce and/or substantially eliminate power-consuming bearing drag that may result from pivotal carrier frame 835 being rotatably connected to primary crankshaft 870.

In example embodiment 800, a rod drive mechanism may, for example, drive parallel shafts at a one-to-one ratio with relatively low NVH as compared to a chain drive and/or a gear drive. A rod drive mechanism in accordance with example embodiment 800 may exhibit improved durability as compared to a belt drive, for example. A rod drive mechanism may include a two-throw drive crankshaft 865, including throws 865A and/or 865B, and/or a two-throw driven crankshaft 805, including throws 805A and/or 805B. Such crankshafts may be on parallel axes, for example, and/or corresponding crank pins may be in line. For example, crank pins 866 and/or 806 may correspond, as may crank pins 867 and/or 807. Further, throw 865A may correspond with throw 805A and/or throw 865B may correspond with throw 805B, for example. In at least one implementation, crank pins on each crankshaft may, for example, be separated from each other by a similar, and/or the same angle, which may be about ninety degrees, as one example. Corresponding throws of the two crankshafts, such as throw 865A corresponding with throw 805A and/or throw 865B corresponding with throw 805B, may be the same and/or similar length. Corresponding crank pins, such as crank pin 866 corresponding with crank pin 806 and/or crank pin 867 corresponding with crank pin 807, may be rotatably connected to each other by connecting rods of the same and/or similar length. A design of a rod drive may accommodate one or more variations in distance between drive and/or driven shafts, which may result from assembly and/or thermal expansion, to name just a couple examples among many. Accordingly, a description as set forth below describes a particular example implementation which may reduce and/or eliminate one or more issues that may result from variation in a distance between a drive crankshaft and/or a driven crankshaft.

Thus, in an implementation, to adapt a rod drive to drive a camshaft of an all-stroke-variable internal combustion engine, pivotal carrier frame 835, for example, may be rotatably connected to half-speed crankshaft 865 and/or pivotably connected to an engine frame such that pivotal carrier frame 835 may pivot a relatively small amount about centerline 845 of crankshaft main bearing housing 871 while an assembly comprising drive camshaft driver crankshaft 865 and/or driven gear 830 are caused to rotate via drive gear 840. A relatively small amount of pivot of pivotal carrier frame 835 about crankshaft 870 may compensates for above-mentioned variations in length of an engine assembly. Driven gear 830 may be rotatably mounted to pivotal carrier frame 835 and/or may be mechanically coupled to and/or otherwise engaged with drive camshaft driver crankshaft 865. Driven gear 830 and/or drive camshaft driver crankshaft 865 may be rotatably mounted within pivotal carrier frame 835, for example, and/or may be mechanically coupled to and/or otherwise engaged with drive gear 840 such that driven gear 830 and/or drive camshaft driver crankshaft 865 may rotate within pivotal carrier frame 835 as an assembly and/or unit.

A camshaft may include and/or have affixed thereto a driven two throw crankshaft. For example, such above-mentioned drive and/or driven crankshafts may rotate on parallel axes. Corresponding throws of two crankshafts may be the same and/or approximately the same length and/or may be in line with each other such that an angle between throws of each crankshaft is the same and/or approximately the same. In one particular example implementation, an angle between throws may be about ninety degrees, though claimed subject matter is not so limited. Corresponding crank pins of two crankshafts may be rotatably connected to each other by drive rods, such as rods 815 and/or 825, of approximately equal length and/or of a length that positions pivotal carrier frame 835 so that variation in a distance from a driven camshaft to a half-speed crankshaft may be compensated for by free pivoting of pivotal carrier frame 835 about centerline 845 of a crankshaft main bearing 871, for example. Room for pivotal carrier frame 835 to pivot may be adequate to compensate for variations caused by thermal expansion and/or resulting from allowed tolerances and/or other variations in assembled units, for example. Such a mechanism may allow for a force to hold a pivotal carrier frame 835 in place to be borne by two connecting rods, for example. An additional load may allow rods to be heavier than rods which do not bear an additional load of maintaining a drive to driven crankshaft distance, for example. A third connecting rod, such as distance rod 820, may maintain a drive to driven crankshaft distance, which, at times, may be equal to the length of first and/or second drive rods 815, 825, respectively, and/or may be added, for example, to bear a load of pivotal carrier frame 835. A distance rod 820 may, for example, rotatably connect a drive crankshaft and/or driven camshaft main bearings. A reduced load on drive rods may permit rods and/or bearings to be lighter. In addition, a balance weight may also be lighter. A distance rod 820, for example, may be fabricated of material that may have a similar (or the same) coefficient of thermal expansion as the two drive rods.

Thus, as discussed herein, an all-stroke-variable internal combustion engine may provide advantages. For example, a partial-stroke-variable internal combustion engine may involve relatively longer drive rods to drive a camshaft. Relatively longer drive rod systems may experience increased NVH due at least in part to additional mass and/or length of drive rods that may travel in relatively higher-speed circular motions. In contrast, example embodiments of an all-stroke-variable internal combustion engine such as discussed herein may include relatively compact drive rod configurations having one or more drive rods of relatively short dimension for relatively lower NVH.

Further, in particular implementations, a rod drive system may include a carrier frame that may pivot about a driven camshaft as opposed to pivoting about a primary crankshaft or other drive gear. In an implementation wherein a carrier frame may pivot about a camshaft, a rod drive may serve as a final drive unit to the camshaft and/or a reduction gear set (e.g., 2:1) in the carrier frame may serve as a final drive unit to the camshaft. For example, for particular implementations, a relatively lower NVH rod drive system may include a rod drive extending from a half-speed gear and/or crankshaft to or near a camshaft wherein a pivotal drive unit may pivot about the camshaft. In an implementation, a rod drive may connect to a pivotal drive unit and/or may be driven by a rod drive which in turn may drive a camshaft. Further, in an implementation, a pivotal drive unit may comprise a second relatively short rod drive, for example.

Particular implementations of an all-stroke-variable internal combustion engine may be designed and/or configured to accommodate particular fuels. Such implementations may involve relatively lower compression ratios and/or relatively higher exhaust ratios, for example. Particular implementations of an all-stroke-variable internal combustion engine may also be designed and/or configured to accommodate additional fuels which may involve relatively higher compression ratios and/or relatively lower exhaust ratios. A partial-stroke-variable internal combustion engine, on the other hand, would not be able to provide these advantages.

Further, although example embodiments described herein discuss a secondary crankshaft rotated at half the speed of a primary crankshaft, claimed subject matter is not limited in scope in these respects. For example, other embodiments may implement secondary crankshafts and/or linkage mechanisms that may operate at speeds other than half-speed. Such embodiments may be advantageously utilized as mixer pumps, in medical devices and/or in other applications, for example. Also, all-stroke-variable implementations may include more than one secondary crankshaft and/or linkage mechanisms that may operate on one or more joints in one or more rods that may join various pistons and/or crankshafts and/or linkages. Such implementations may include stroke lengths and/or TDC and/or BDCs that may meet a wide variety of applications.

Further, particular implementations of an all-stroke-variable internal combustion engine may be designed and/or configured to take advantage of valve designs, such as example relatively lower restriction poppet valves described below, which may not have parts intruding into a cylinder as a piston within cylinder is at and/or near an exhaust-intake TDC. Such an example feature may allow for internal combustion engines that may have relatively very high exhaust ratio and/or intake ratio values (e.g., nearly infinite). Valve designs with such a feature may include various rotary valve designs and/or configurations, for example. Relatively higher exhaust ratios, for example, are not a feature and/or result of a partial-stroke-variable internal combustion engine design and/or are rather explicitly designed out of partial-stroke-variable internal combustion engines.

Additionally, for particular implementations of an all-stroke-variable internal combustion engine, a half-speed crankshaft may include a sprocket, gear and/or other power transmission device to drive one or more camshaft with reduced number of parts and/or with reduced expense.

Also, an internal combustion engine that may operate using both gasoline and/or diesel concurrently may benefit from flexibility that may be provided by being able to have two TDCs and/or two BDCs that may be positioned independently of one another. A combination of multiple fuel types may have a relatively more suitable fit combination of four stroke ratios, similar in manner to how individual fuels may have respective relatively more suitable fit combinations of stroke ratios. In addition, for particular implementations, one or more phase changers may be used to adjust stroke ratios while an internal combustion engine is operating. Further, for a particular implementation, a particular gasoline-to-diesel ratio may be altered to more suitably meet desired performance characteristics. In particular implementations, a duel fuel concept may extend to a point of running an all-stroke-variable internal combustion engine on substantially all diesel and/or substantially all gasoline. Additional desired performance characteristics for other combinations of two or more fuels may be achieved at least in part via adjustment of a phase changer, for example.

Below, example valves for use with internal combustion engines are described. In particular implementations, valves may comprise relatively lower restriction poppet valves. "Poppet valve" refers to a valve comprising a hole (e.g., round and/or oval) and/or a tapered plug that may include a disk-type cross-sectional shape, for example, affixed to a valve stem. In an embodiment, a piston engine and/or piston pump having one or more pistons may employ relatively lower-restriction poppet valves having relatively higher exhaust and/or intake ratios and/or having relatively higher efficiency. In particular implementations, all-stroke-variable internal combustion engines may employ relatively lower restriction poppet valves, such as those described below, for example, although claimed subject matter is not limited in scope in this respect. In particular implementations, relatively lower restriction poppet valves may be operated via cam motion, hydraulics, solenoids, and/or other mechanisms. Also, in particular implementations, relatively lower restriction poppet valves may allow for a relatively very wide range of intake and/or exhaust ratios in internal combustion engines, including relatively very high intake and/or exhaust ratios, for example. Further, in particular implementations, relatively lower restriction poppet valves may operate advantageously in environments of relatively extreme heat, cold, pressure, vacuum and/or impurities.

Figure 8:
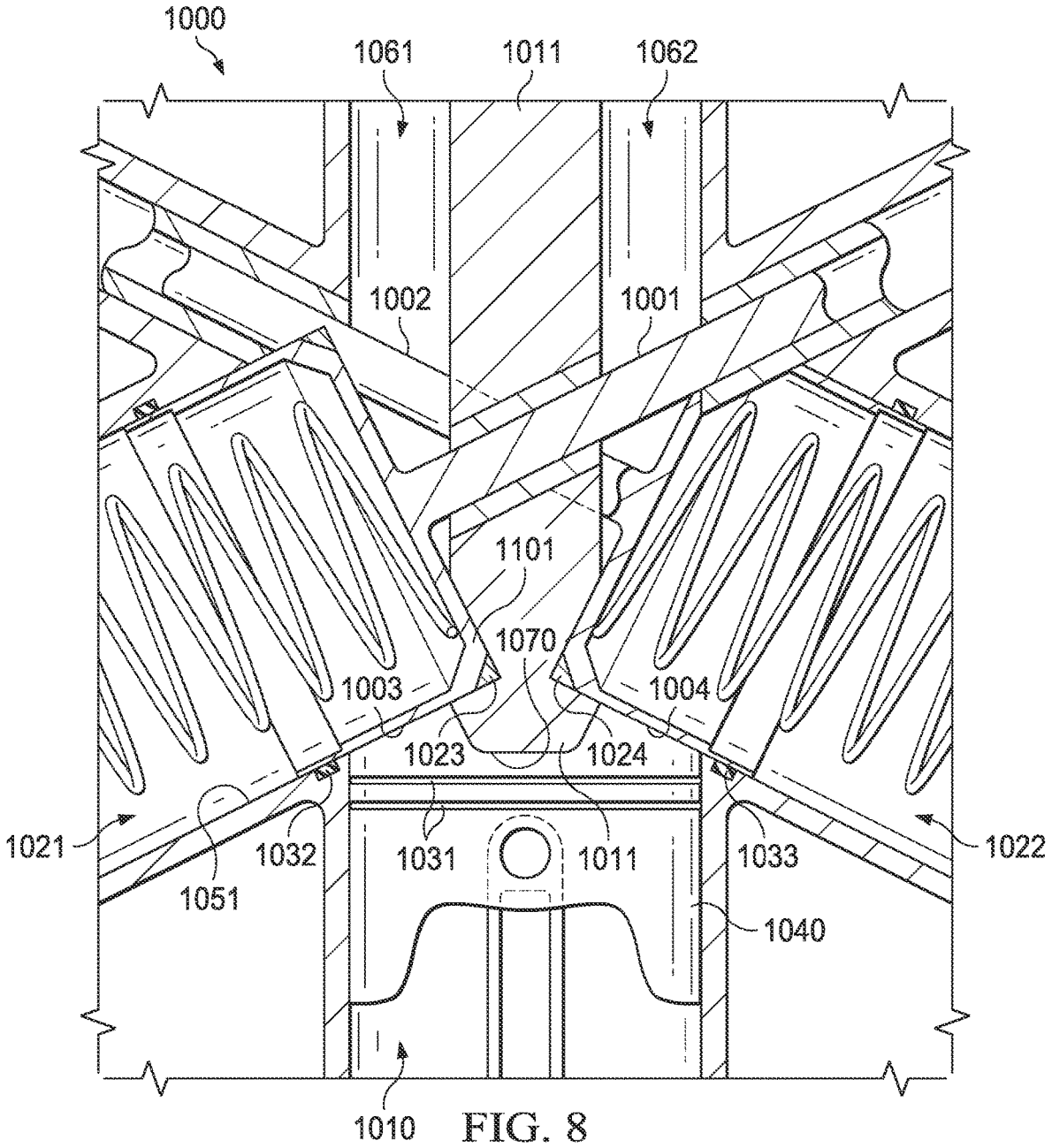
FIG. 8 depicts a schematic illustration of a front view of an example valve system, in accordance with an embodiment.

FIGS. 8-11 depict an embodiment 1000 of a relatively low restriction poppet valve system that may facilitate relatively higher intake and/or exhaust ratios. An all-stroke-variable configuration described at least in part in connection with Table 1 may have an exhaust ratio of 159, for example, for an angle KF of 191° as depicted in Table 2. See also FIGS. 6A-6E. In a particular implementation, one or more intake valves 1001 may be positioned so as to cross one or more exhaust valves 1002 above a cylinder 1010, as depicted at FIG. 8. Of course, claimed subject matter is not limited in scope in these respects. Intake valve 1001 and/or exhaust valve 1002 may be exercised (e.g., opened and/or closed) via one or more cam and/or camshaft and/or rocker arm mechanisms, for example. Example camshaft drive mechanisms are described above, such as depicted in FIGS. 7A-7E, although claimed subject matter is not limited in scope in these respects. In a particular implementation, valve spring 1072 positioned within valve spring cavity 1021 may provide a relatively constant force to intake valve 1001. Similarly, valve spring positioned within valve spring cavity 1022 may provide relatively constant force to exhaust valve 1002.

In embodiment 1000, intake valve 1001 may comprise a valve head that may have a substantially cylindrical shape and/or may be substantially cup-shaped, such as depicted in FIG. 8, for example. Similarly, exhaust valve 1002 may comprise a valve head that may have a substantially cylindrical shape and/or may be substantially cup-shaped. Also, in embodiment 1000, intake valve head surface 1003 and/or exhaust valve head surface 1004 may make up part of combustion chamber 1070, wherein chamber 1070 is defined, at least in part, by a top surface of piston 1040, intake valve head surface 1003 and/or exhaust valve head surface 1004. Chamber 1070 may further be defined, at least in part, by cylinder 1010 and/or cylinder head 1011.

In embodiment 1000, intake valve 1001 and/or exhaust valve 1002 may open and/or close during engine operation without intruding into combustion chamber 1070 and/or cylinder 1010. Air and/or an air/fuel mixture may be introduced into cylinder 1010 via intake port 1061 as intake valve 1001 is opened. Intake port 1061 may comprise a substantially straight passageway for air to be transferred to cylinder 1010, thereby potentially reducing pressure drop across intake valve 1001 during an intake stroke. Exhaust gases and/or particles may exit cylinder 1010 via exhaust port 1062 as exhaust valve 1002 is opened. Exhaust port 1062 may comprise a substantially straight passageway for exhaust gases to exit cylinder 1010. Due at least in part to characteristics of combustion chamber 1070, defined, at least in part, by intake valve head surface 1003 and/or exhaust valve head surface 1004, embodiment 1000 and/or other embodiments implementing relatively lower restriction poppet valve systems may provide for relatively higher intake and/or exhaust ratios. Various implementations may employ various combinations of features and/or elements described herein and/or depicted in FIGS. 8-11 to achieve relatively higher intake and/or exhaust ratios. In embodiments, such as embodiment 1000, piston seals 1031 and/or valve seals 1032 and/or 1033 may help maintain the integrity of combustion chamber 1070 during engine operation. Valve seats 1023 and/or 1024 may also contribute to maintaining the integrity of combustion chamber 1070. As such, piston seals 1031, valve seals 1032 and/or 1033 and/or valve seats 1023 and/or 1024 may contribute at least in part to achievement of relatively higher intake and/or exhaust ratios, for example.

Figure 9:
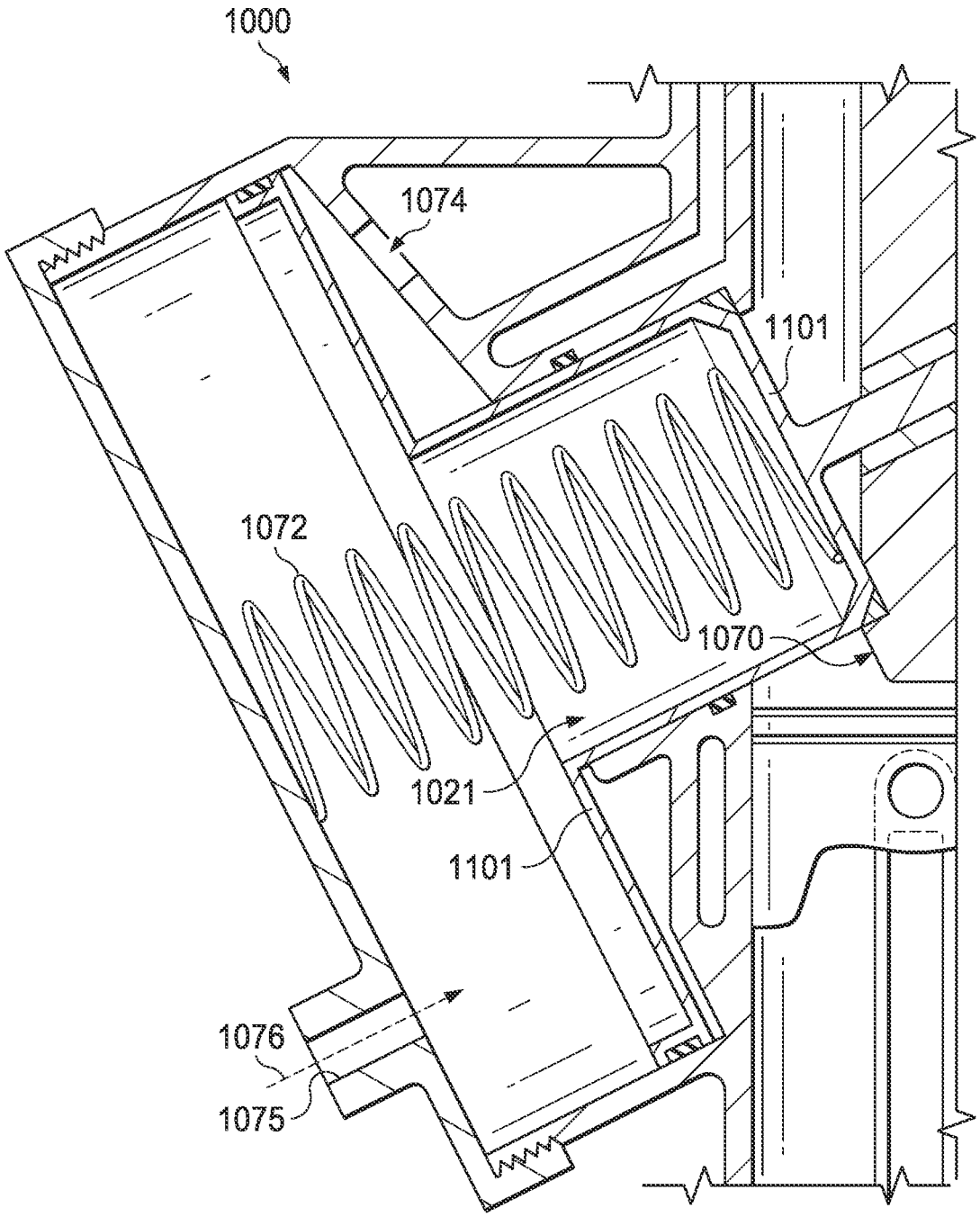
FIG. 9 depicts a schematic illustration of a front view of an example valve system, in accordance with an embodiment.

As depicted in FIG. 9, in an embodiment, a valve spring may be combined with a pneumatic spring. For example, valve spring 1072 may be aided by gas pressure that may result from gas 1076 introduced into valve spring cavity 1021 via port 1075. In implementations, gas and/or gas pressure may be diverted to port 1075, for example, from a combustion chamber and/or from an ancillary source. In an implementation, intake valve head 1101 may be enlarged in diameter, thereby allowing for an increase in valve closing force resulting from gas pressure. Vent 1074 may regulate, at least in part, back pressure applied to valve head 1101 as valve head 1101 moves back and forth within valve spring cavity 1021. A valve closing force provided by gas 1076 may be added to a closing force provided by valve spring 1072, in a particular implementation. In an embodiment, pneumatic valve spring pressure may be variable to provide for reduced closing force, for example, thereby reducing friction, wear and/or power consumption.

Figure 10:
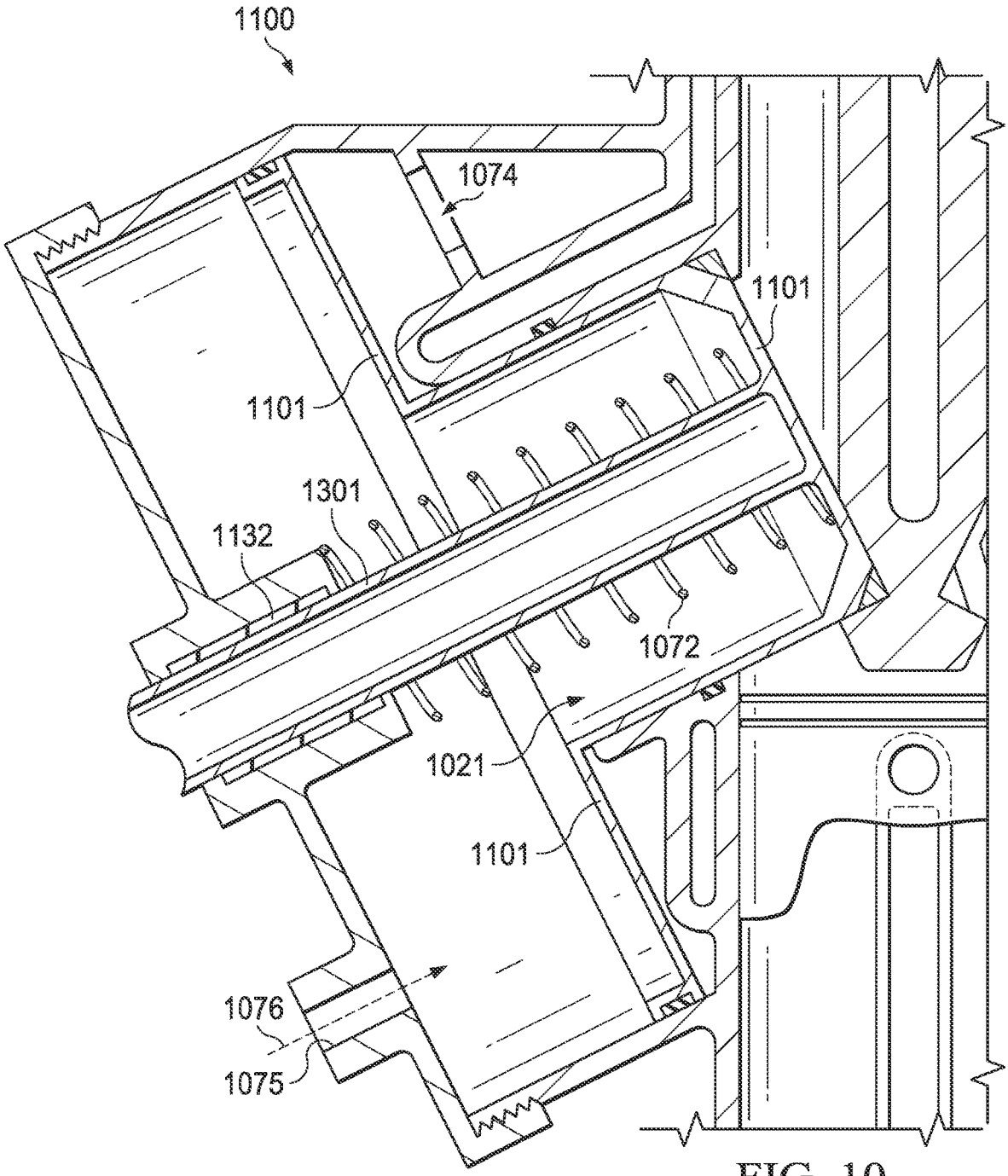
FIG. 10 depicts a schematic illustration of a front view of an example valve system, in accordance with an embodiment.

FIG. 10 depicts an example embodiment 1100 similar in many respects to embodiment 1000. For example, embodiment 1100 includes valve head 1101 moving within valve spring cavity 1021. However, embodiment 1100 includes intake valve stem 1301 that attaches to a surface of valve head 1101 that is opposite that depicted in embodiment 1000. For example, rather than having valve stem 1301 intersect one or more of intake port 1061 and/or exhaust port 1062, as depicted in FIG. 8, valve stem 1301 may attach to a valve spring cavity-side of valve head 1101. Further, valve stem 1301 may pass through valve spring cavity 1021. As with other embodiments, valve stem 1301 may be exercised via cam and/or rocker arm mechanisms, for example, to open and/or close intake valve 1001. Embodiments may implement similar mechanisms for exhaust valve 1002, although not depicted in FIG. 10.

In a particular implementation, valve spring cavity 1021 may operate solely as a pneumatic valve spring chamber (e.g., no metal coil-type valve spring). Valve spring cavity 1021 may be implemented, for example, as an enclosed chamber. Seal 1132 may prevent gas 1076 from escaping valve spring cavity 1021 via valve stem 1301.

In embodiment 1100, for example, an amount of gas pressure (e.g., resulting from introduction of gas 1076 into valve spring cavity 1021) within valve spring cavity 1021 may be adjustable. Further, an amount of gas pressure 1076 to provide to valve spring chamber 1021 may depend, at least in part, on a specified amount of combustion pressure developed within combustion chamber 1070. For a particular implementation, for every 1,000 units of combustion pressure, 7.8 units of gas pressure may be applied to valve spring cavity 1021, although claimed subject matter is not limited in scope in this respect. Gas pressure within valve spring cavity 1021 may be adjusted to meet specified closing force and/or may be adjusted to reduce and/or minimize friction losses. Valve closing force may be altered at least in part in response to changes in combustion chamber pressure. For example, particular implementations of internal combustion engines, including particular implementations of all-stroke-variable internal combustion engines, may operate with changing loads and/or speeds. Valve closing force may be adjusted (e.g., by adjusting gas pressure within valve spring cavity 1021) based at least in part on changing loads and/or speeds, in an embodiment.

Figure 11:
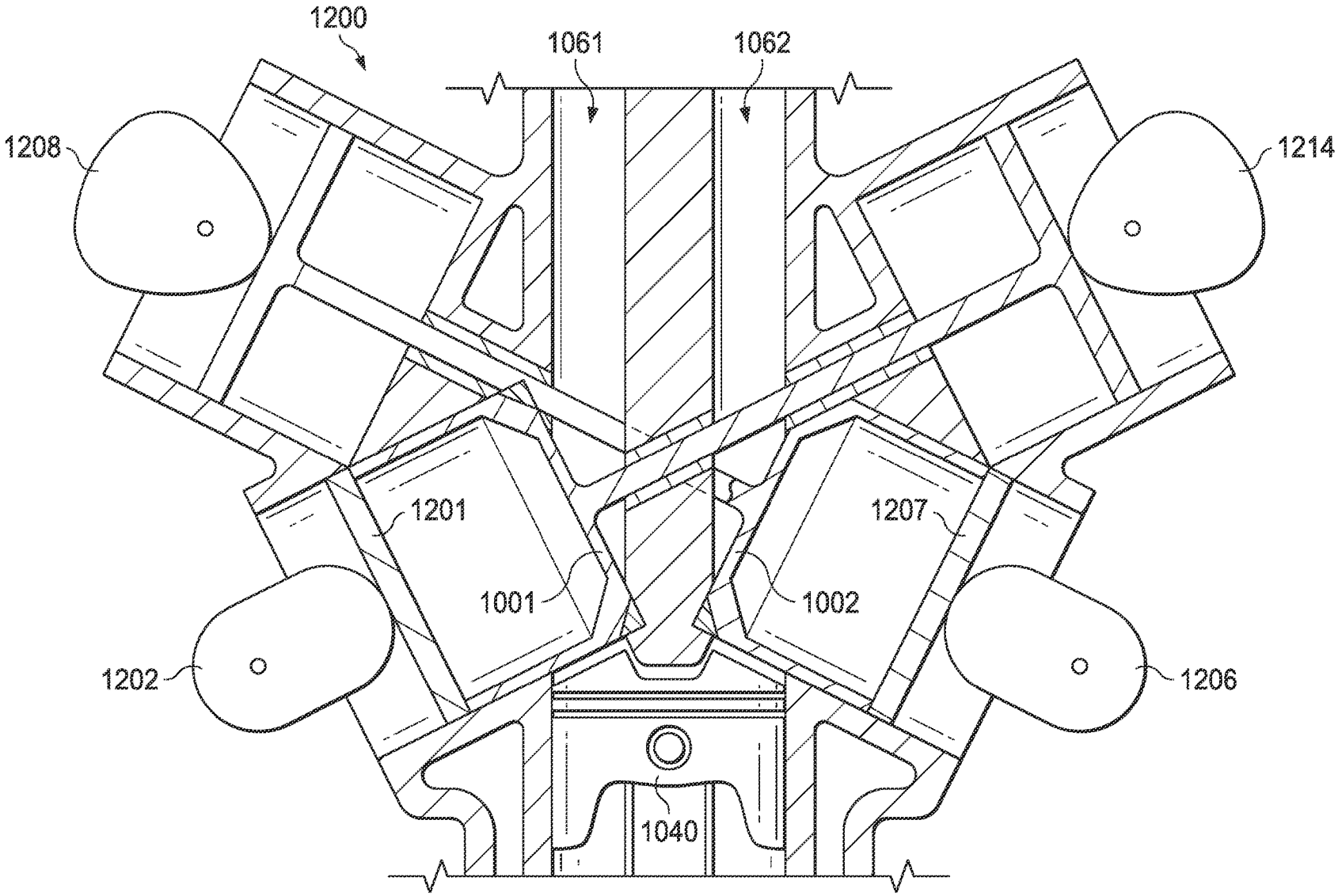
FIG. 11 depicts a schematic illustration of a front view of example cam mechanisms for an example valve system, in accordance with an embodiment.

FIG. 11 depicts at embodiment 1200 similar in many respects to embodiment 1000. Embodiment 1200 includes an example control valve operating system including cam mechanisms for operating on both ends of intake valves and/or exhaust valves, such as intake valve 1001 and/or exhaust valve 1002. For embodiment 1200, valve opener cams 1208 and/or 1214 are depicted, as are valve closer cams 1202 and/or 1206. In embodiment 1200, valve closer cam 1202 may apply a force to flex plate 1201, which in turn may apply a force to intake valve 1001. Valve opener cam 1214 may also apply a force, substantially opposite of that applied by valve closer cam 1202, to intake valve 1001. Valve opener cam 1214 may operate in concert with valve closer cam 1202 to open and/or close intake valve 1001, in an embodiment. Similarly, valve closer cam 1206 may apply a force to flex plate 1207, which in turn may apply a force to exhaust valve 1002. Valve opener cam 1208 may also apply a force, substantially opposite of that applied by valve closer cam 1206, to exhaust valve 1002. Valve opener cam 1208 may operate in concert with valve closer cam 1206 to open and/or close exhaust valve 1002, in an embodiment. Embodiment 1200, including valve opener cams 1208 and/or 1214 and/or valve closer cams 1202 and/or 1206, may obviate a need for spring-coil type valve springs and/or pneumatic valve springs, for example.

In particular implementations, hydraulics and/or other mechanisms and/or materials may be utilized to control dimensional variations in a valve operating system, such as embodiment 1200, and/or to help control valve closing forces. For example, a valve operating system, such as embodiment 1200, may include a device similar to a hydraulic valve-lifter and/or other suitable mechanism to reduce and/or substantially eliminate slack within the valve operating system. For example, particular implementations of embodiment 1200 may reduce noise as compared to other desmodromic valve operating systems. "Desmodromic valve" refers to a valve that is actuated in different directions via corresponding different control mechanisms. For example, desmodromic valves in an internal combustion engine may be positively closed by cam and/or leverage mechanisms rather than by a springs.

In particular implementations, a device similar in at least some respects to a hydraulic valve lifter that may be implemented as part of a valve system may have relatively high hydraulic pressure applied to it during an expansion stroke. In a particular implementation, a pressure creation and/or delivery system may be similar in at least some respects to direct fuel injection systems that may be implemented in diesel engines, for example. In an implementation, a valve system that may or may not include desmodromic valve actuation may have adjustable closing force that may be applied when the combustion chamber is under pressure during an expansion stroke, for example. Hydraulic pressure utilized to hold a valve closed may be varied in response to factors similar to those that may cause variation in combustion chamber pressure and/or in response to other engine performance parameters, for example.

Embodiments, such as example embodiments 1000, 1100 and/or 1200 depicted in FIGS. 8-11, may provide a range of potentially advantageous characteristics. For example, particular implementations may provide for relatively higher intake and/or exhaust ratios, as previously mentioned. Also, particular implementations may utilize no head gasket or head-to-cylinder block joint and/or may utilize simplified casting, machining and/or assembly as compared with at least some other internal combustion engine types that do incorporate head gaskets and/or head-to-cylinder block joints. Thus, for example, temperature gradients throughout a combustion chamber, such as combustion chamber 1070, may not be effected by head gaskets, gasket surfaces, head bolts, etc. Further, for example, by eliminating head bolts and/or other structures related to head bolts, design and/or implementation of coolant passages may be simplified. Design and/or implementation of intake and/or exhaust passages may be similarly simplified. For example, engine designers may not have to deal with finding effective compromises with respect to location and/or design of head bolts such that they may have an acceptable amount of interference with selected designs for cooling, intake, exhaust, lubrication, ignition, injection, main bearing fasteners, cylindrical distortion, abrupt changes in temperature gradients and/or other considerations related to implementation of head-to-cylinder block joints. Additionally, embodiments, such as example embodiments 1000, 1100 and/or 1200 depicted in FIGS. 8-11, may provide relatively simplified valve control mechanisms that may be more robust than other desmodromic valve operating systems.

Figure 12A:
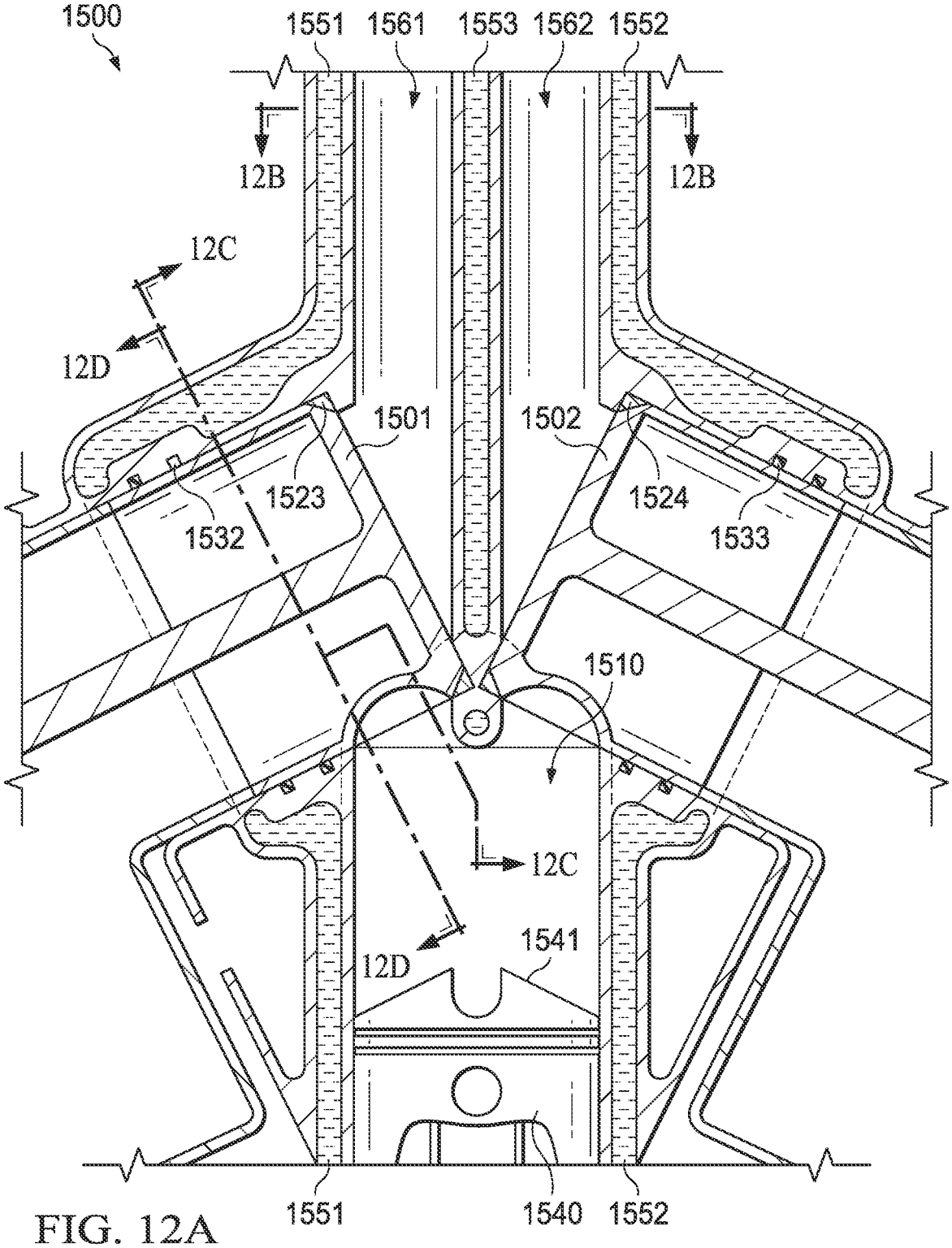
FIG. 12A depicts a schematic illustration of a front view of example coolant passageways for an example valve system, in accordance with an embodiment.

FIG. 12A depicts a schematic illustration of a front view of an embodiment 1500 of example coolant passageways for an example valve system. Embodiment 1500 may include a number of characteristics similar to embodiments 1000, 1100 and/or 1200 depicted in FIGS. 8-11. However, embodiment 1500 may include characteristics that differ from other embodiments. For example, embodiment 1500 may include a number of passages through which coolant may flow. Embodiment 1500 may include, for example, coolant passages 1551, 1552, and/or 1553. Of course, claimed subject matter is not limited in scope to the particular amount and/or configuration of coolant passageways depicted and/or described herein.

In an embodiment, coolant passages 1551, 1552, and/or 1553 may surround and/or may otherwise be positioned substantially adjacent to intake port 1561 and/or exhaust port 1562. Coolant passages 1551, 1552, and/or 1553 may also surround and/or may otherwise be positioned substantially adjacent to cylinder 1510, for example. Further, coolant passages 1551, 1552, and/or 1553 may surround and/or may be otherwise positioned substantially adjacent to intake valve 1501 and/or exhaust valve 1502. Due at least in part to a particular implementation wherein intake port 1561 and/or exhaust port 1562 comprise substantially straight passageways, coolant passages 1551, 1552, and/or 1553 may be implemented in a manner that provides substantial portions that may parallel and/or surround ports 1561 and/or 1562, thereby providing enhanced cooling capabilities.

Figure 12B:
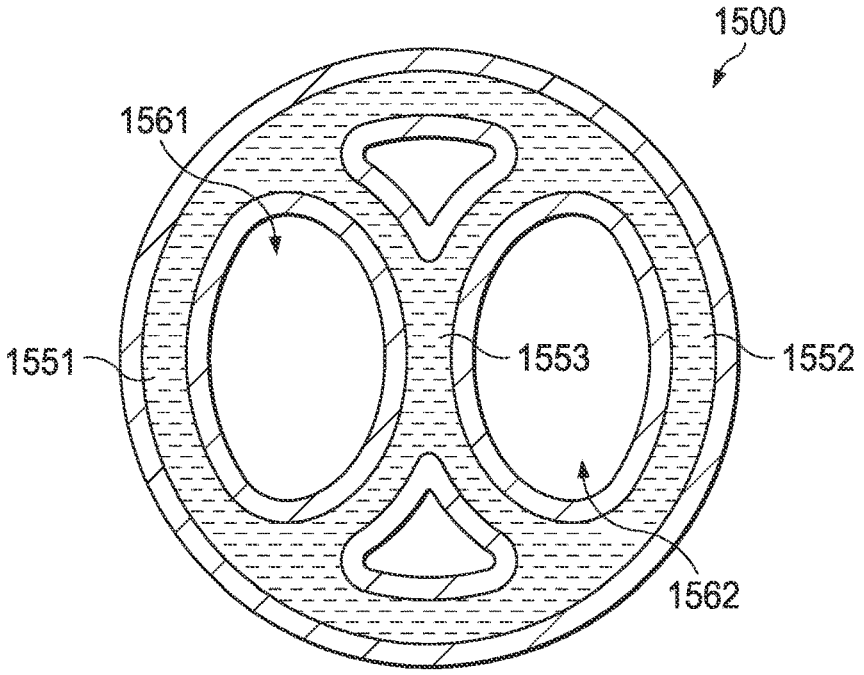
FIG. 12B depicts a schematic illustration of a cross-sectional view of example coolant passageways for an example valve system, in accordance with an embodiment.

In a particular implementation, coolant passages 1551, 1552 and/or 1553 may be interconnected and/or may otherwise comprise a single contiguous passage. In other words, a coolant system for embodiment 1500 may be described in terms of several distinct and/or interconnected passages, such as coolant passages 1551, 1552 and/or 1553, but may be thought of as a single contiguous passage. For example, FIG. 12B is a schematic illustration of embodiment 1500 depicting a cross-sectional view (view 12B-12B, as indicated in FIG. 12A) of coolant passages 1551, 1552, and/or 1553, as well as intake port 1561 and/or exhaust port 1562. As depicted in FIG. 12B, intake port 1561 and/or exhaust port 1562 may be surrounded by coolant passages 1551, 1552, and/or 1553.

Referring again to FIG. 12A, coolant passage 1551 may be implemented in a manner to provide cooling for intake valve 1501. For example, coolant passage 1551 may be located in relative close proximity to intake valve seat 1523 and/or may be located in relative close proximity to one or more intake valve seals 1532. Similarly, coolant passage 1552 may provide cooling for exhaust valve 1502. For example, coolant passage 1552 may be located in relative close proximity to exhaust valve seat 1524 and/or may be located in relative close proximity to one or more exhaust valve seals 1533. By implementing coolant passages in relative close proximity to valve seals 1532 and/or 1533 and/or by implementing coolant passages in relative close proximity to valve seats 1523 and/or 1524, cooler operation for valve seals 1532 and/or 1533 and/or valve seats 1523 and/or 1524 may result, thereby increasing reliability and/or longevity of the various components.

Figure 12D:
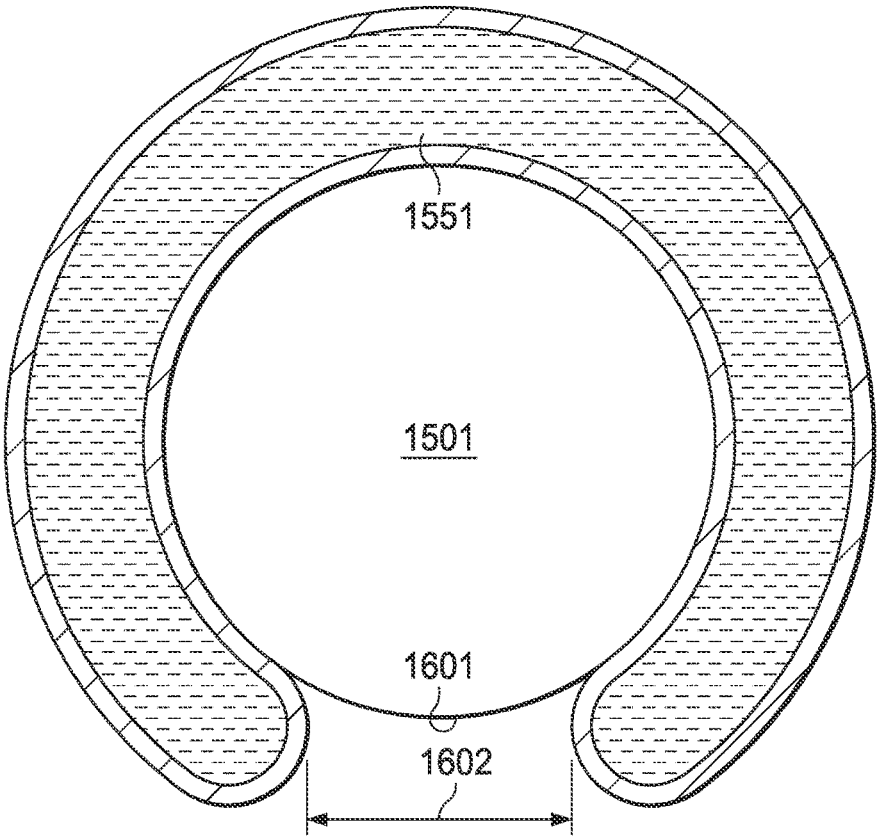
FIG. 12D depicts a schematic illustration of a cross-sectional view of an example coolant passageway for an example valve, in accordance with an embodiment.
Figure 12C:
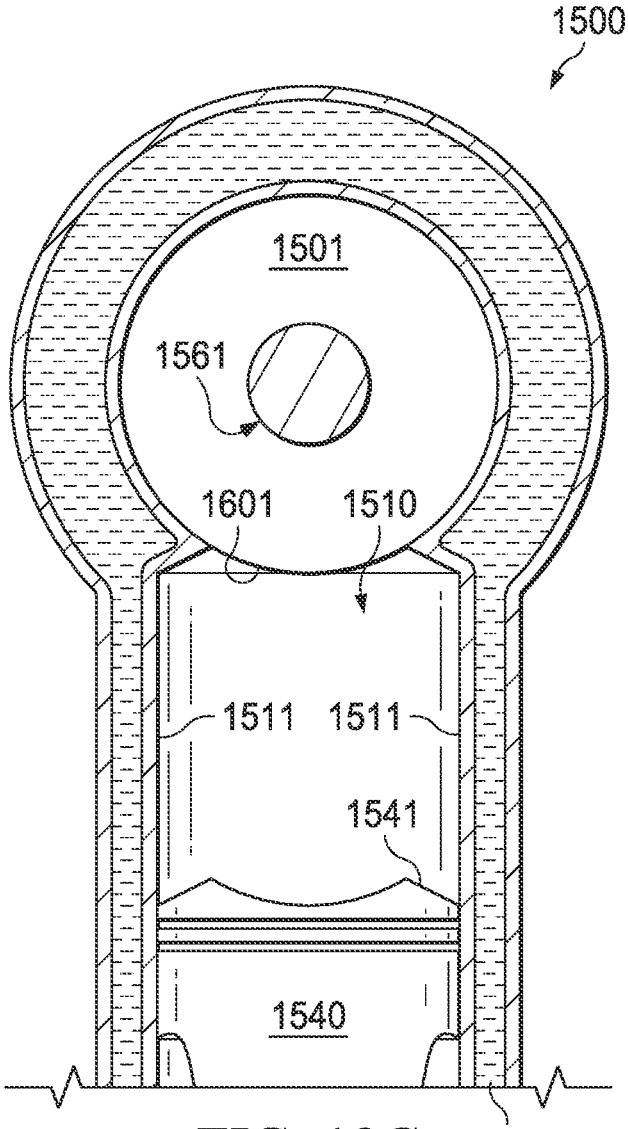
FIG. 12C depicts a schematic illustration of a cross-sectional view of example coolant passageways for an example valve, in accordance with an embodiment.

FIG. 12C depicts a schematic illustration of embodiment 1500 depicting a cross-sectional view (view 12D-12D, as indicated in FIG. 12A) of coolant passage 1551 and/or valve 1501, looking away from intake port 1561. FIG. 12D depicts a schematic illustration of embodiment 1500 depicting a cross-sectional view (view 12C-12C, as indicated in FIG. 12A) of coolant passage 1551 and/or valve 1501, looking towards intake port 1561. In a particular implementation, and as mentioned above, coolant passage 1551 may substantially surround intake valve 1501. Similarly, although not shown in FIGS. 12C and/or 12D, coolant passage 1552 may substantially surround exhaust valve 1502. Potential advantages resulting from such an implementation may include increased cooling capabilities that may result in increased reliability and/or longevity of various components, such as, for example, intake valve seals 1532. Additionally, FIGS. 12C and/or 12D illustrate that, for a particular implementation, valve 1501 may comprise a substantially circular cross-section. A particular surface 1601 of valve 1501 may define, at least in part, a combustion chamber within cylinder 1510. A gap 1602 in coolant passage 1551 may provide a window into cylinder 1510 for intake and/or exhaust ports, for example. Further, in an embodiment, piston 1540 may have a shape that may conform at least in part to valve 1501. Surface 1541 of piston 1540 may further define a combustion chamber as piston 1540 approaches and/or reaches TDC. Additionally, in an embodiment, coolant passage 1551 may be implemented in relative close proximity to cylinder walls 1511, thereby providing enhanced cooling and/or advantages derived therefrom.

Embodiment 1500, for example, may be implemented as a unitary cylinder block and/or head. In such an implementation, a lack of a head gasket joint may provide improved temperature control and/or improved temperature gradients in proximity to a cylinder, such as cylinder 1510. Further, combustion pressure may not be limited by a head-to-cylinder block seal, due at least in part to such a seal and/or gasket not existing in such an implementation.

In a unitary cylinder block and/or head implementation, valves such as those discussed above in connection with FIGS. 8-12D, may allow for relatively high exhaust ratios. Valve seats, such as valve seats 1023, 1024, 1523 and/or 1524, may be relatively more simple to machine and/or assemble for unitary cylinder block and/or head implementations. For example, unitary cylinder block and/or head implementations having other conventional present art valve systems may include pockets for valve seats that may be machined by a relatively complicated procedure including introducing a machine spindle into a cylinder head by way of a valve guide hole and further including assembling a tool bit to the machine spindle. A valve seat pocket may be back-machined similar to a back spot face machining operation. Such a procedure may include repeated cuttings, including a rough cut and/or finishing cut, for example. Further, for the relatively more complicated procedure for non-unitary cylinder block and/or head implementations with conventional present art valves, it may be difficult to machine more than one valve seat pocket concurrently and/or to install more than one valve seat concurrently. In contrast, for an example unitary cylinder block and/or head implementation, such as depicted in FIGS. 12A-12D, relatively more simple and/or efficient techniques may be employed, including, for example, concurrent machining of valve seat pockets and/or concurrent assembly of valve seats.

Figure 13B:
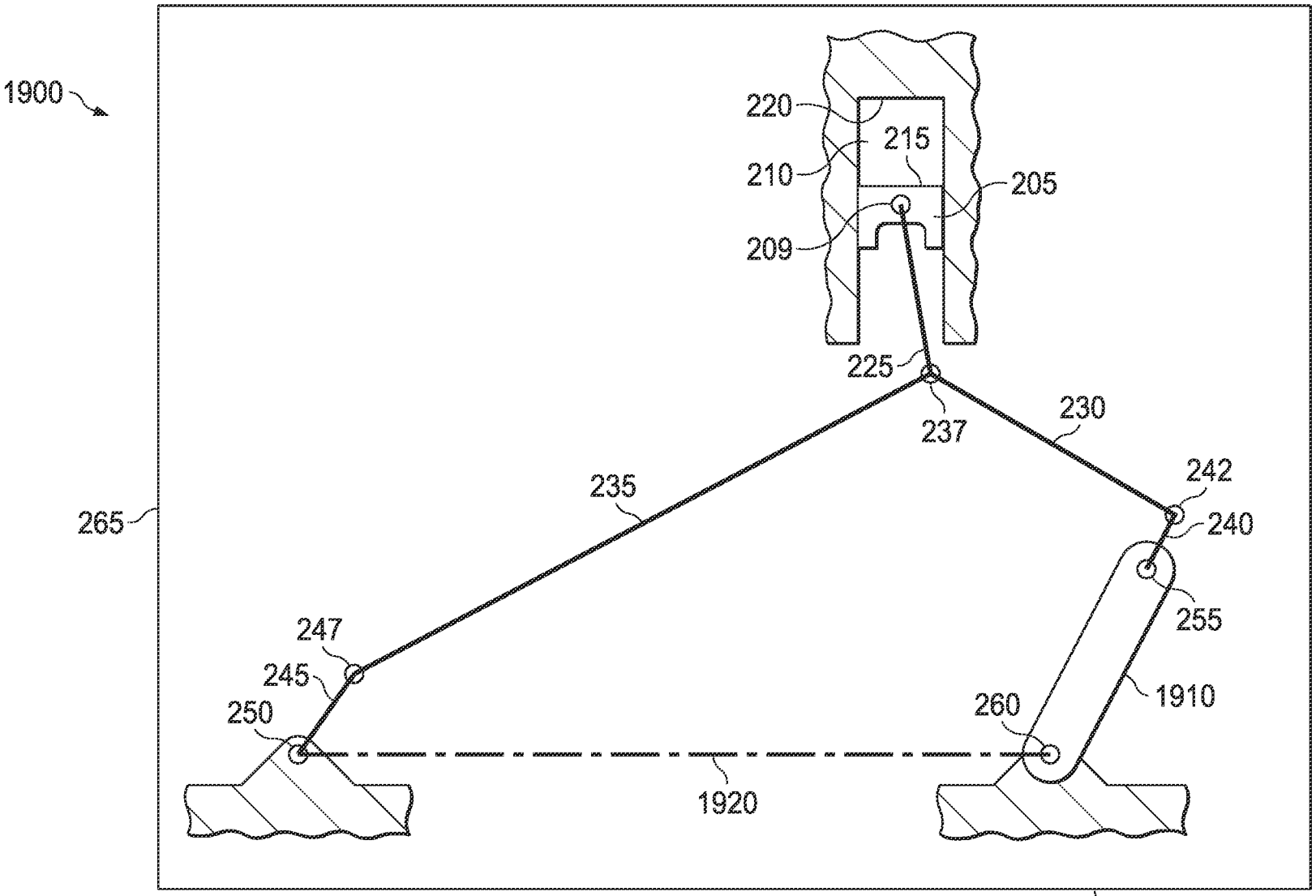
FIG. 13B depicts a schematic illustration of an all-stroke-variable internal combustion engine, in accordance with an embodiment.

FIGS. 13A and 13B depict an embodiment 1800 of an example all-stroke-variable engine that may provide for variable compression ratio. For example, in a particular implementation, a compression ratio for an all-stroke-variable engine may vary in accordance and/or in response to various parameters such as, for example, load, engine speed and/or atmospheric conditions to improve one or more aspects of engine performance. In a particular implementation, adjustable compression ratio may be provided, at least in part, via a gear carrier, such as gear carrier 1810, that may drive half-speed crankshaft 240, such as depicted in FIG. 13A. In a particular implementation, gear carrier 1810 may be actuated by a 2:1 mechanical drive mechanism, although claimed subject matter is not limited in this respect. In a particular implementation, gear carrier 1810 may pivot about primary crankshaft main bearing 250, as depicted in FIG. 13A. In a particular implementation, as center line 255 moves in response to a pivot of gear carrier 1810 about primary crankshaft main bearing 250, a variation in compression ratio may result.

Although a device that may be utilized to pivot and retain gear carrier 1801 in place is not depicted in FIGS. 13A-13B, it is to be understood that as gear carrier 1810 pivots about primary crankshaft main bearing 250, angle KF (e.g., depicted in FIG. 2C) may not change if for a particular implementation the gear train includes an odd number of gears. Further, in an implementation, angle KF may not change if power transmission devices are implemented to cause a final drive to rotate in the same direction as a primary drive. It is further to be understood that a particular implementation of a variable compression ratio engine may include a mechanical drive mechanism extending from primary crankshaft main bearing 250 centerline to a position that may provide a more advantageous pivot point. For example, FIG. 13B depicts an embodiment 1900 including mechanical drive 1920 extending from primary crankshaft mean bearing 250 to gear carrier pivot point 260. In a particular implementation, mechanical drive 1920 may actuate one or more gears at gear carrier pivot point 260. In a particular implementation, gear carrier 1910 may include an odd number of gears to avoid having angle KF (e.g., see FIG. 2C) change as gear carrier 1910 pivots about gear carrier pivot point 260. Using the disclosure herein, those who practice the art will be able to include an even number of gears in the above-mentioned gear carrier frame to simultaneously and/or concurrently change the compression ratio and the relative angle between the primary and half-speed crankshafts. A similar pivotable carrier frame as the above gear carrier frame may be included with all-stroke-variable configurations such as embodiment 500 depicted in FIGS. 5A-5F by those who practice the art. Also, those who practice the art will understand that the above discussion does not include a bevel gears and shaft drive arrangement, in an embodiment.

In particular implementations, an all-stroke-variable internal combustion engine, such as described above, may implement a stroke length that may be independently variable via varying corresponding top and/or bottom dead centers of the four distinct strokes. An all-stroke-variable internal combustion engine, such as described above, may include corresponding top and/or bottom dead centers of the four distinct strokes that may be determined based, at least in part, on a compression ratio and/or respective locations of a top and/or a bottom of the compression stroke, for example.

In particular implementations, an exhaust-intake TDC of an all-stroke-variable internal combustion engine, such as described above, may be located above, even with or below the compression-expansion TDC. For an all-stroke-variable internal combustion engine, such as described above, a location of the top of the at least one cylinder may be based, at least in part, on a sum of a location of the compression-expansion TDC with a length of the compression stroke divided by a compression ratio, for example. Also, in particular implementations, for an all-stroke-variable internal combustion engine, such as described above, an intake stroke of the four distinct strokes may be longer than, the same as, or shorter than a compression stroke of the four distinct strokes. For an all-stroke-variable internal combustion engine, such as described above, the volume of the engine cylinder with the piston at exhaust/intake TDC may be less than, the same as, or greater than a volume of the engine cylinder at the beginning of an expansion stroke of the four distinct strokes, for example.

In particular implementations, an all-stroke-variable internal combustion engine, such as described above, may implement a predetermined compression ratio to accommodate particular engine performance characteristic for a particular fuel. An all-stroke-variable internal combustion engine, such as described above, may implement or approximately implement a predetermined expansion ratio during a combustion stroke to improve conversion of energy from combustion of fuel into mechanical energy before an exhaust valve opens during an exhaust stroke, for example. Further, in particular implementations, an all-stroke-variable internal combustion engine, such as described above, may include a phase changer to adjust one or more stroke ratios for the all-stroke variable internal combustion engine. Also, in particular implementations, to adjust one or more stroke rations for an all-stroke-variable internal combustion engine, such as described above, a phase changer may alter a half-speed crankshaft offset angle of a half-speed crankshaft. Additionally, for an all-stroke-variable internal combustion engine, such as described above, a primary crankshaft and/or a half-speed crankshaft may be operatively engaged via a gear train, for example.

In particular implementations, for an all-stroke-variable internal combustion engine, such as described above, a gear train may comprise a first gear fixedly mounted on a primary crankshaft and/or a second gear fixedly mounted on a half-speed crankshaft. Further, for an all-stroke-variable internal combustion engine, such as described above, teeth of a first gear may be operatively engaged with teeth of a second gear for rotation of a primary crankshaft in a same angular direction as a half-speed crankshaft, for example. In particular implementations, for an all-stroke-variable internal combustion engine, such as described above, teeth of a first gear may be operatively engaged with teeth of a second gear for rotation of a primary crankshaft in an opposite angular direction relative to a half-speed crankshaft. Also, an all-stroke-variable internal combustion engine, such as described above, may further comprise a sprocket to drive one or more camshafts within an engine cylinder, for example.

In particular implementations, an all-stroke-variable internal combustion engine, such as described above, may further comprise a camshaft rod drive to drive parallel shafts at approximately a 1:1 ratio. An all-stroke-variable internal combustion engine, such as described above, may further comprise a half-speed crankshaft drive and change the compression ratio without change or with minimal and/or reduced change in relative angle between primary and half-speed crankshafts, for example. In particular implementations, for an all-stroke-variable internal combustion engine, such as described above, a half-speed crankshaft drive system may drive a half-speed crankshaft and/or may change a compression ratio and/or a relative angle between primary and half-speed crankshafts. Further, in particular implementations, an all-stroke-variable internal combustion engine, such as described above, may include a rod drive system that accommodate length changes that may eliminate shaft misalignment. An all-stroke-variable internal combustion engine may further comprise a poppet valve of relatively lower restriction intake and/or exhaust, for example.

In particular implementations, for an all-stroke-variable internal combustion engine, such as described above, valves may operate (e.g., open and/or close) without intruding into a combustion chamber. An all-stroke-variable internal combustion engine, such as described above, may further comprise a unit head-block, for example. In particular implementations, an all-stroke-variable internal combustion engine, such as described above, may be implemented at least in part via relatively simplified machining and/or via relatively simplified assembly. Additionally, in particular implementations, an all-stroke-variable internal combustion engine, such as described above, may comprise a unit coolant cavity unobstructed by a head-to-block joint.

An example process for determining parameters of an all-stroke-variable internal combustion engine may include: selecting compression, expansion, exhaust and/or intake ratios for the all-stroke-variable internal combustion engine; identifying parameters that may yield a graph of observed piston position relative to an angular position of a primary crankshaft of the all-stroke-variable internal combustion engine in which respective stroke lengths of expansion, exhaust, intake and/or compression operations and/or respective locations of top and/or bottom dead centers for the expansion, exhaust, intake and/or compression operations may have a predetermined and/or specified shape; calculating a location of a top of an engine cylinder of the all-stroke-variable internal combustion engine for individual parameters using, at least in part, a selected compression ratio; and examining one or more graphs of parameters that may yield a predetermined and/or specified compression ratio with the top of the cylinder illustrated in a particular location to identify one or more parameters that may exhibit predetermined and/or specified combination of expansion ratio, exhaust ratio and/or intake ratio.

In an embodiment of a process for determining parameters of an all-stroke-variable internal combustion engine, such as described above, selecting a compression ratio may be based, at least in part, on expected and/or specified performance characteristics for an intended and/or specified fuel and/or engine application.

In an embodiment of a process for determining parameters of an all-stroke-variable internal combustion engine, such as described above, selecting an expansion ratio may be based, at least in part, on an expectation that the expansion ratio is to improve a conversion of energy of combustion expansion into mechanical energy.

In an embodiment of a process for determining parameters of an all-stroke-variable internal combustion engine, such as described above, selecting an exhaust ratio may be based, at least in part, on an expectation that the efficiency and/or effectiveness of an intake stroke may be improved and/or that the efficiency and/or effectiveness may be improved for an expulsion of a particular amount of exhaust gas for a particular valve design and/or valve timing.

In an embodiment of a process for determining parameters of an all-stroke-variable internal combustion engine, such as described above, a length of a compression stroke may be determined at least in part by subtracting a position of an intake-compression BDC from a position of a compression-expansion TDC.

In an embodiment of a process for determining parameters of an all-stroke-variable internal combustion engine, such as described above, a length of a compression stroke may be divided by a compression ratio and/or a resulting fraction of the compression stroke may be summed with a compression-expansion TDC to determine a location of a top of an engine cylinder.

An example embodiment of a drive system for an internal combustion engine may comprise: a drive gear on a crankshaft; a driven gear to drive a camshaft, wherein the driven gear is to drive one or more cam drive driven cranks via an arrangement of rods comprising at least two parallel drive rods and/or a distance rod; and a gear carrier frame to pivot about a crank main bearing to drive the driven gear; wherein the drive system is arranged to drive the at least two parallel drive rods at a one-to-one ratio. In particular implementations, a rod drive system, such as described above, may drive at least two parallel drive rods with relatively low noise, vibration and/or harshness.

Embodiments described herein, including, for example, the various example implementations mentioned, may include an all-stroke-variable internal combustion engine comprising: an engine cylinder; a piston slidably positioned within the engine cylinder for asymmetrical reciprocation; a piston rod having proximal and/or distal ends and/or may be pivotally connected to the piston at the proximal end; and a reciprocating assembly movably connected to the distal end of the piston rod to produce the asymmetrical reciprocation characterized at least in part via varying locations of all top dead centers and/or all bottom dead centers throughout a complete four stroke cycle of the all-stroke-variable internal combustion engine. In particular implementations, a reciprocating assembly may comprise a primary crankshaft rod pivotally connected to the piston rod at the distal end and/or rotatably connected to a primary crankshaft at an opposite end.

Embodiments described herein may include particular implementations comprising, for example, a mechanism including a primary crankshaft and/or one or more half-speed crankshafts having linkage mechanisms that may couple the primary and/or the one or more half-speed crankshafts to a piston to cause the piston to reciprocate with strokes that may have different top and/or bottom dead centers and/or different lengths to implement an all-stroke-variable internal combustion engine. Embodiments may also include example processes for identifying particular parameters for an all-stroke-variable internal combustion engine. In particular implementations, an all-stroke-variable internal combustion engine may have a variable compression ratio, for example. For particular implementations, an all-stroke-variable internal combustion engine may implement strokes that may be variable during engine operation and/or while stationary, for example. Further, particular implementations may include a rod drive that may intergrade with an all-stroke-variable internal combustion engine, wherein the rod drive may drive a driven shaft directly, wherein the driven crankshaft is part of the driven shaft, for example.

Embodiments described herein may also include particular implementations comprising, for example, valves that may operate without intrusion into a combustion chamber and/or that may intergrade with an all-stroke-variable internal combustion engine, such as described above, and/or may serendipitously provide a relatively easily machined and/or assembled unit head and/or cylinder block configuration. Further, particular embodiments may include variable rate pneumatic valve springs that may be intergraded with particular implementations of all-stroke-variable internal combustion engines, such as discussed above. Additionally, particular implementations may comprise a variable force system to hold valves closed with a relatively higher force utilized during a relatively higher pressure period of combustion. In particular implementations, a variable force system to hold valves closed may be implemented in an all-stroke-variable internal combustion engine, for example.

In the context of the present patent application, the term "connection," the term "component" and/or similar terms are intended to be physical but are not necessarily always tangible. Whether or not these terms refer to tangible subject matter, thus, may vary in a particular context of usage. As an example, a tangible connection and/or tangible connection path may be made, such as by a tangible, electrical connection, such as an electrically conductive path comprising metal and/or other conductor, that is able to conduct electrical current between two tangible components. Likewise, a tangible connection path may be at least partially affected and/or controlled, such that, as is typical, a tangible connection path may be open or closed, at times resulting from influence of one or more externally derived signals, such as external currents and/or voltages, such as for an electrical switch. Non-limiting illustrations of an electrical switch include a transistor, a diode, etc. However, a "connection" and/or "component," in a particular context of usage, likewise, although physical, can also be non-tangible, such as a connection between a client and/or a server over a network, which generally refers to the ability for the client and/or server to transmit, receive, and/or exchange communications, as discussed in more detail later.

In a particular context of usage, such as a particular context in which tangible components are being discussed, therefore, the terms "coupled" and/or "connected" are used in a manner so that the terms are not synonymous. Similar terms may also be used in a manner in which a similar intention is exhibited. Thus, "connected" is used to indicate that two or more tangible components and/or the like, for example, are tangibly in direct physical contact. Thus, using the previous example, two tangible components that are electrically connected are physically connected via a tangible electrical connection, as previously discussed. However, "coupled," is used to mean that potentially two or more tangible components are tangibly in direct physical contact. Nonetheless, is also used to mean that two or more tangible components and/or the like are not necessarily tangibly in direct physical contact, but are able to co-operate, liaise, and/or interact, such as, for example, by being "optically coupled." Likewise, the term "coupled" is also understood to mean indirectly connected. It is further noted, in the context of the present patent application, since memory, such as a memory component and/or memory states, is intended to be non-transitory, the term physical, at least if used in relation to memory necessarily implies that such memory components and/or memory states, continuing with the example, are tangible.

In the present patent application, in a particular context of usage, such as a situation in which tangible components (and/or similarly, tangible materials) are discussed above, a distinction exists between being "on" and/or being "over." As an example, deposition of a substance "on" a substrate refers to a deposition involving direct physical and/or tangible contact without an intermediary, such as an intermediary substance, between the substance deposited and/or the substrate in this latter example; nonetheless, deposition "over" a substrate, while understood to potentially include deposition "on" a substrate (since being "on" may also accurately be described as being "over"), is understood to include a situation in which one or more intermediaries, such as one or more intermediary substances, are present between the substance deposited and/or the substrate so that the substance deposited is not necessarily in direct physical and/or tangible contact with the substrate.

A similar distinction is made in an appropriate particular context of usage, such as in which tangible materials and/or tangible components are discussed, between being "beneath" and/or being "under." While "beneath," in such a particular context of usage, is intended to necessarily imply physical and/or tangible contact (similar to "on," as just described), "under" potentially includes a situation in which there is direct physical and/or tangible contact, but does not necessarily imply direct physical and/or tangible contact, such as if one or more intermediaries, such as one or more intermediary substances, are present. Thus, "on" is understood to mean "immediately over" and/or "beneath" is understood to mean "immediately under."

It is likewise appreciated that terms such as "over" and/or "under"," as used herein, are understood in a similar manner as the terms "up," "down," "top," "bottom," and/or so on, previously mentioned. These terms may be used to facilitate discussion but are not intended to necessarily restrict scope of claimed subject matter. For example, the term "over," as an example, is not meant to suggest that claim scope is limited to only situations in which an example embodiment is right side up, such as in comparison with the example embodiment being upside down, for example. Thus, if an object, as an example, is within applicable claim scope in a particular orientation, such as upside down, as one example, likewise, it is intended that the latter also be interpreted to be included within applicable claim scope in another orientation, such as right side up, again, as an example, and/or vice-versa, even if applicable literal claim language has the potential to be interpreted otherwise. Of course, again, as always has been the case in the specification of a patent application, particular context of description and/or usage provides helpful guidance regarding reasonable inferences to be drawn.

It is further noted that the terms "type" and/or "like," as used herein, such as with a feature, structure, characteristic, and/or the like, means at least partially of and/or relating to the feature, structure, characteristic, and/or the like in such a way that presence of minor variations, even variations that might otherwise not be considered fully consistent with the feature, structure, characteristic, and/or the like, do not in general prevent the feature, structure, characteristic, and/or the like from being of a "type" and/or being "like," if the minor variations are sufficiently minor so that the feature, structure, characteristic, and/or the like would still be considered to be substantially present with such variations also present. It should be noted that the specification of the present patent application merely provides one or more illustrative examples and/or claimed subject matter is intended to not be limited to one or more illustrative examples; however, again, as has always been the case with respect to the specification of a patent application, particular context of description and/or usage provides helpful guidance regarding reasonable inferences to be drawn.

Unless otherwise indicated, in the context of the present patent application, the term "or" if used to associate a list, such as A, B, or C, is intended to mean A, B, and/or C, here used in the inclusive sense, as well as A, B, or C, here used in the exclusive sense. With this understanding, "and" is used in the inclusive sense and/or intended to mean A, B, and/or C; whereas "and/or" can be used in an abundance of caution to make clear that all of the foregoing meanings are intended, although such usage is not required. In addition, the term "one or more" and/or similar terms is used to describe any feature, structure, characteristic, and/or the like in the singular, "and/or" is also used to describe a plurality and/or some other combination of features, structures, characteristics, and/or the like. Likewise, the term "based on" and/or similar terms are understood as not necessarily intending to convey an exhaustive list of factors, but to allow for existence of additional factors not necessarily expressly described.

Furthermore, it is intended, for a situation that relates to implementation of claimed subject matter and/or is subject to testing, measurement, and/or specification regarding degree, to be understood in the following manner. As an example, in a given situation, assume a value of a physical property is to be measured. If alternative reasonable approaches to testing, measurement, and/or specification regarding degree, at least with respect to the property, continuing with the example, are reasonably likely to occur to one of ordinary skill, at least for implementation purposes, claimed subject matter is intended to cover those alternatively reasonable approaches unless otherwise expressly indicated. As an example, if a plot of measurements over a region is produced and/or implementation of claimed subject matter refers to employing a measurement of slope over the region, but a variety of reasonable and/or alternative techniques to estimate the slope over that region exist, claimed subject matter is intended to cover those reasonable alternative techniques unless otherwise expressly indicated.

To the extent claimed subject matter is related to one or more particular measurements, such as with regard to physical manifestations capable of being measured physically, such as, without limit, temperature, pressure, voltage, current, electromagnetic radiation, etc., it is believed that claimed subject matter does not fall with the abstract idea judicial exception to statutory subject matter. Rather, it is asserted, that physical measurements are not mental steps and, likewise, are not abstract ideas.

It is noted, nonetheless, that a typical measurement model employed is that one or more measurements may respectively comprise a sum of at least two components. Thus, for a given measurement, for example, one component may comprise a deterministic component, which in an ideal sense, may comprise a physical value (e.g., sought via one or more measurements), often in the form of one or more signals, signal samples and/or states, and/or one component may comprise a random component, which may have a variety of sources that may be challenging to quantify. At times, for example, lack of measurement precision may affect a given measurement. Thus, for claimed subject matter, a statistical or stochastic model may be used in addition to a deterministic model as an approach to identification and/or prediction regarding one or more measurement values that may relate to claimed subject matter.

In the preceding description, various aspects of claimed subject matter have been described. For purposes of explanation, specifics, such as amounts, systems and/or configurations, as examples, were set forth. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all modifications and/or changes as fall within claimed subject matter.

What is claimed is:

1. An apparatus, comprising:

an internal combustion engine that, during operation, includes at least one piston moving reciprocally within a cylinder, and a valve system comprising one or more intake and/or exhaust valves that operate without intrusion into a combustion chamber defined at least in part by a top surface of the piston, the cylinder, an inner surface of a cylinder head, and a surface of the one or more intake and/or exhaust valves;

wherein when the piston reaches an end of an exhaust stroke the top surface of the piston is substantially flush with the inner surface of the cylinder head, such that substantially all exhaust gases are forced from the cylinder.

2. The apparatus of claim 1, wherein the one or more intake and/or exhaust valves individually comprise a substantially cup-shaped valve head and further comprise a valve stem, wherein the substantially cup-shaped valve head includes a substantially planar portion and a substantially cylindrical portion, wherein the substantially planar portion is fixed to a first end of the substantially cylindrical portion, and wherein the valve stem is fixed to a first surface of the planar portion.

3. The apparatus of claim 1, wherein the valve system further comprises a pneumatic valve spring.

4. The apparatus of claim 3, wherein the pneumatic valve spring to have a variable rate.

5. The apparatus of claim 3, wherein the pneumatic valve spring to include a gas diverted from the combustion chamber.

6. The apparatus of claim 5, wherein a gas pressure to be applied to a valve spring cavity to depend at least in part on an amount of combustion pressure.

7. The apparatus of claim 1, wherein the valve system further comprises a valve stem that does not intrude and/or encroach in and/or on intake or exhaust passages of the internal combustion engine.

8. The apparatus of claim 1, wherein the valve system further comprises desmodromic valve actuation such that valve actuation is by push only.

9. The apparatus of claim 8, wherein the valve system to include first and second camshafts to affect operation of opposite ends of the one or more intake and/or exhaust valves.

10. The apparatus of claim 9, wherein the first camshaft to affect operation of the one or more intake and/or exhaust valves to open the one or more intake and/or exhaust valves and wherein the second camshaft to affect operation of the one or more intake and/or exhaust valves to close the one or more intake and/or exhaust valves.

11. The apparatus of claim 1, wherein the valve system further permits a valve closure force to be adjusted responsive at least in part to a change in a pressure of combustion.

12. The apparatus of claim 11, wherein the valve system is further configured to increase the valve closure force responsive at least in part to an increase in the pressure of combustion.

13. The apparatus of claim 1, wherein the internal combustion engine to comprise an all-stroke variable combustion engine.

14. The apparatus of claim 1, wherein the valve system comprises a poppet valve system.

15. The apparatus of claim 1, wherein the internal combustion engine comprises a unitary cylinder block head design.

16. The apparatus of claim 15, wherein the unitary cylinder block head design comprises a single coolant jacket.

17. The apparatus of claim 16, wherein the coolant jacket includes one or more interconnected coolant passages to form a contiguous coolant passage.

18. The apparatus of claim 15, wherein the unitary cylinder block head is manufactured without a back spot face machining operation.

19. The apparatus of claim 15, wherein the unitary cylinder block head comprises plural valve seat pockets, and the valve seat pockets are manufactured by concurrent machining.

* * * * *